US006630655B2

(12) United States Patent
Fukunaga et al.

(10) Patent No.: US 6,630,655 B2
(45) Date of Patent: Oct. 7, 2003

(54) MICROWAVE OVEN WITH INFRARED DETECTION ELEMENT

(75) Inventors: Eiji Fukunaga, Otsu (JP); Masaru Noda, Shiga (JP); Kazuo Taino, Shiga (JP); Kenji Kume, Otsu (JP); Masahiro Tanaka, Otsu (JP); Eiji Mukumoto, Kusatsu (JP)

(73) Assignee: Sanyo Electric Co., Ltd., Osaka (JP)

( * ) Notice: Subject to any disclaimer, the term of this patent is extended or adjusted under 35 U.S.C. 154(b) by 56 days.

(21) Appl. No.: 09/842,239

(22) Filed: Apr. 26, 2001

(65) Prior Publication Data

US 2002/0005406 A1 Jan. 17, 2002

(30) Foreign Application Priority Data

Apr. 28, 2000 (JP) ..... 2000-130912
Jan. 30, 2001 (JP) ..... 2001-022418

(51) Int. Cl.[7] ..... H05B 6/68

(52) U.S. Cl. ..... 219/711; 219/494; 99/325; 374/149

(58) Field of Search ..... 219/710, 711, 219/492, 494; 99/325; 374/149, 121, 124

(56) References Cited

U.S. PATENT DOCUMENTS 5,796,081 A * 8/1998 Carlsson et al. ..... 219/711
5,986,249 A * 11/1999 Yoshino et al. ..... 219/746
6,132,084 A * 10/2000 Whipple, III et al. ..... 374/149

FOREIGN PATENT DOCUMENTS

JP 62-165893 7/1987
JP 4-68756 11/1992
JP 2000-130766 5/2000

* cited by examiner

*Primary Examiner*—Philip H. Leung
(74) *Attorney, Agent, or Firm*—Armstrong, Westerman & Hattori, LLP

(57) ABSTRACT

A heating chamber has a width in a direction of a two-head arrow X, a depth in a direction of a two-head arrow Y and a height in a direction of a two-head arrow Z. An infrared sensor includes 25 infrared detection elements each having a field of view. Since the 25 infrared detection elements are arranged, five by five in directions Y and Z, on the heating chamber's bottom plate there are projected a total of 25 fields of view, five by five in directions Y and X. Thus the bottom plate has any area thereof covered by one of the 25 fields of view.

4 Claims, 42 Drawing Sheets

MICROWAVE OVEN WITH INFRARED DETECTION ELEMENT

BACKGROUND OF THE INVENTION

1. Field of the Invention

The present invention relates generally to microwave ovens and particularly to microwave ovens having an infrared detection element and operative in response to an output from the infrared detection element to provide a heat-cooking operation.

2. Description of the Background Art

Japanese Patent Publication No. 4-68756 discloses a conventional microwave oven employing an infrared detection element to detect a temperature profile on the turntable to detect the position and temperature of a food to be heated that is placed on the turntable.

In such a conventional microwave oven, however, the infrared detection element can only detect the amount of infrared radiation in a limited area (or a field of view), i.e., on the turntable. As such, if such a microwave oven does not have a turntable and a food is placed in the oven's heating chamber at a location at which a turntable would otherwise be provided, the infrared detection element's output cannot fully be used to detect the temperature of the food in the heating chamber.

Furthermore, in a conventional microwave oven, with an infrared sensor arranged in a manner, the heating chamber often can have a large number of areas that cannot be covered by the field of view of the infrared detection element. If in such a case a food is placed at a location that the field of view cannot cover, the infrared sensor's output can also not fully used to detect the condition of the object to be heated.

Furthermore, if juice and the like scattering from a food in the heating chamber adheres to the component of the infrared detection element receiving infrared radiation, it can prevent the infrared detection element from accurately detecting the temperature of the object to be heated. In such a case, the infrared sensor's output can also not fully be used to detect the condition of the object to be heated.

SUMMARY OF THE INVENTION

The present invention has been made to overcome such disadvantages as above and it contemplates a microwave oven employing an infrared sensor having an infrared detection element mounted thereto to ensure that the temperature of an object to be heated is detected to make full use of an output of the infrared sensor to detect the condition of the object to be heated.

The present invention in one aspect provides a microwave oven having a heating chamber accommodating an object to be heated, includes a plurality of infrared detection elements having their respective fields of view in the heating chamber to detect an amount of infrared radiation in the fields of view, the plurality of infrared detection elements being arranged to have the fields of view covering an area in the heating chamber in a first direction from one end to the other end.

In the present invention in one aspect wherever in the heating chamber in the first direction there may exist the object to be heated the infrared detection elements are not required to be moved and their outputs can be used to detect the temperature of the object to be heated.

Thus the infrared detection elements' outputs can be made full use of to detect the condition of the object to be heated.

The present invention in another aspect provides a microwave oven having a heating chamber accommodating an object to be heated includes: an infrared detection element having a field of view in the heating chamber and attached to the heating chamber in a first direction on one side to detect an amount of infrared radiation in the field of view; and a drive unit driving the infrared detection element to move in a second direction traversing the first direction.

Thus if the infrared detection element is moved its field of view can have an area free of a significant variation in size in the heating chamber.

This can enhance the precision of the temperature of the object to be heated that is derived from an output of the infrared detection element.

The present invention in another aspect provides a microwave oven having a heating chamber accommodating an object to be heated, includes: an infrared detection element having a field of view in the heating chamber and attached to the heating chamber in a first direction on one side to detect an amount of infrared radiation in the field of view; and a drive unit driving the infrared detection element to pivot around an axis corresponding to a line orthogonal to a plane formed by the field of view and extending in one direction closest to one side.

With the drive unit driving the infrared detection element to pivot by a predetermined angle, the heating chamber in the first direction on one side and the other side can have less area that is not covered by the field of view of the infrared detection element. More specifically, the heating chamber can be entirely covered by the field of view of the infrared detection element that pivots by a further reduced angle.

Thus temperature can be detected throughout the heating chamber over a wide area.

The present invention in still another aspect provides a microwave oven having a heating chamber accommodating an object to be heated includes: an infrared detection element having a field of view in the heating chamber to detect an amount of infrared radiation in the field of view; a decision unit determining from an output received from the infrared detection element whether the field of view covers the object to be heated; and a drive unit driving the infrared detection element to move the field of view in the heating chamber, wherein if with the drive unit moving the field of view at a first rate the decision unit determines that in the heating chamber at an area there exists the object to be heated then the drive unit is controlled to move the field of view in the area at a second rate to determine that in the area at a specific subarea there exists the object to be heated, the second rate being lower than the first rate.

Thus in the heating chamber the object to be heated can soon be located.

Thus if the object in the heating chamber is heated for a short period of time its temperature can be detected accurately. That is, if the object in the heating chamber is heated for a short period of time the output of the infrared detection element can be made full use of.

The present invention in another aspect provides a microwave oven having a heating chamber having a wall provided with a window, and accommodating an object to be heated, includes: an infrared detection element provided external to the heating chamber and having a field of view in the heating chamber via the window to detect an amount of infrared radiation in the field of view; a cylinder surrounding the window and extending from the window outwardly of the heating chamber; and a drive unit driving the infrared detection element to move. The cylinder has a specific portion increased in height than a remaining portion of the cylinder. The infrared detection element has a detection window introducing infrared radiation into the infrared detection element. The drive unit drives the infrared detection element to move to allow the detection window to face the specific portion if the infrared detection element is not operated to detect infrared radiation.

Thus the cylinder can be formed by barring a sidewall of the heating chamber and at the specific portion of the cylinder increased in height than the remaining portion of the cylinder the infrared detection element can wait when it is not operated for detection.

As such when it is not operated for detection the infrared detection element can be free from contamination otherwise resulting in an impaired precision in detection. Thus the infrared detection element can provide an output that can more effectively be used to detect the temperature of the object to be heated. Furthermore, readily, without using any additional member and at low cost, and at a location closer to the position of the infrared detection element when it is operated for detection, there can be provided a location for the infrared detection element to wait at when it is not operated for detection.

The present invention in still another aspect provides a microwave oven having a heating unit, a fan provided to cool the heating unit, and a heating chamber having a wall provided with a window, and accommodating an object to be heated, includes: an infrared detection element provided external to the heating chamber and having a field of view in the heating chamber via the window to detect an amount of infrared radiation in the field of view; and a drive unit driving the infrared detection element to move windward of the window as the fan operates.

Thus without using any additional member and at low cost the infrared detection element when it is not operated for detection can be free of contamination otherwise resulting in an impaired precision in detection.

Thus the infrared detection element can provide an output that can more effectively be used to detect the temperature of the object to be heated.

The present invention in a different aspect provides a microwave oven having a chamber with a wall provided with a window, and accommodating an object to be heated, includes a plurality of infrared detection elements provided external to the heating chamber and having a field of view in the heating chamber via the window to detect an amount of infrared radiation in the field of view, the plurality of infrared detection elements having their respective fields of views with their respective centerlines traversing each other in a vicinity of the window.

Thus the heating chamber can have a window minimized in diameter.

This ensures that the infrared detection element can be free of an impaired precision in detection otherwise attributed for example to juice of the object to be heated in the heating chamber that scatters outside the heating chamber. Thus the infrared detection element can provide an output that can more effectively be used to detect the temperature of the object to be heated.

The present invention in a still different aspect provides a microwave oven having a heating unit, a heating chamber with a wall provided with a window, and accommodating an object to be heated, and a plurality of infrared detection elements provided external to the heating chamber and having a field of view in the heating chamber via the window to detect an amount of infrared radiation in the field of view, of the plurality of infrared detection elements a predetermined infrared detection element having a field of view having a portion external to the heating chamber, includes: a decision unit determining whether the object to be heated is covered by the field of view of the predetermined infrared detection element; and a unit stopping a heating operation of the heating unit if the decision unit determines that the object to be heated is covered by the field of view of the predetermined infrared detection element.

Thus in the microwave oven the infrared detection elements includes an infrared detection element having a field of view partially external to the heating chamber and thus incapable of accurately detecting the temperature of the object to be heated and if in the field of view of the infrared detection element there exists the object to be heated the microwave oven stops the current heating operation.

As such, wherever in the heating chamber the object to be heated may be placed, the infrared detection elements' outputs can be effectively used to control a heating operation, as appropriate.

The present invention in one aspect provides a method of controlling a microwave oven employing an infrared detection element having a field of view corresponding to a respective one of a plurality of areas internal to a heating chamber, to detect a temperature of an object attained in the field of view, including the steps of: calculating for each the area a variation in the temperature introduced within a predetermined temporal period; and referring only to the temperature in the area corresponding to the variation having a largest value and the temperature in the area corresponding to the variation having a value of at least a predetermined percentage relative to the variation having the largest value, to control a heating operation.

Thus of the fields of view of the plurality of infrared detection elements a field of view with a largest variation in temperature within a predetermined temporal period and a field of view with a variation having at least a predetermined percentage relative to the largest variation are extracted as specific fields of view and therein temperature is detected and used to control a heating operation.

Thus the outputs of the plurality of infrared detection elements can be used effectively.

The present in another aspect provides a method of controlling a microwave oven having a heating chamber with an infrared detection element attached thereto in a first direction on one side to detect a temperature of an object in the heating chamber, includes the step of controlling the infrared detection element to detect the temperature of the object in the heating chamber while moving the infrared detection element in a second direction traversing the first direction.

Thus if the infrared detection element is moved its field of view can have an area free of a significant variation in size in the heating chamber.

This can enhance the precision of the temperature of the object to be heated that is derived from an output of the infrared detection element.

The present invention in still another aspect provides a method of controlling a microwave oven having a heating chamber with an infrared detection element attached thereto in one direction on one side and having a field of view to detect a temperature of an object in the heating chamber, includes the step of controlling the infrared detection element to pivot around an axis corresponding to a line orthogonal to a plane formed by the field of view and extending in the first direction closest to one side, to detect the temperature of the object in the heating chamber.

With the drive unit driving the infrared detection element to pivot by a predetermined angle, the heating chamber in the first direction on one side and the other side can have less area that is not covered by the field of view of the infrared detection element. More specifically, the heating chamber can be entirely covered by the field of view of the infrared detection element that pivots by a further reduced angle.

Thus temperature can be detected throughout the heating chamber over a wide area.

The present invention in another aspect provides a method of controlling a microwave oven having a heating chamber with an infrared detection element having a field of view moving to allow the infrared detection element to detect a temperature of an object in the heating chamber, includes the steps of: referring to an output of the infrared detection element with the field of view moving at a first rate to determine that in the heating chamber at an area there exists the object to be heated; and referring to an output of the infrared detection element with the field of view moving in the area at a second rate to determine that in the area at a specific subarea there exists the object to be heated, the second rate being lower than the first rate.

Thus in the heating chamber the object to be heated can soon be located.

Thus if the object in the heating chamber is heated for a short period of time its temperature can be detected accurately. That is, if the object in the heating chamber is heated for a short period of time the output of the infrared detection element can be made full use of.

The present invention in still another aspect provides a method of controlling a microwave oven having a heating unit provided to heat an object to be heated, a fan provided to cool the heating unit, and an infrared detection element having a field of view in the heating chamber via a window provided in a wall of the heating chamber, the infrared detection element having the field of view moving to allow the infrared detection element to detect a temperature of an object in the heating chamber, includes the steps of: determining whether the infrared detection element is being operated to detect temperature; and if the infrared detection element is not being operated to detect temperature, moving the infrared detection element windward of the window as the fan operates.

Thus without using any additional member and at low cost the infrared detection element when it is not operated for detection can be free of contamination otherwise resulting in an impaired precision in detection.

Thus the infrared detection element can provide an output that can more effectively be used to detect the temperature of the object to be heated.

The present invention in a different aspect provides a method of controlling a microwave oven having a heating unit provided to heat an object to be heated and a plurality of infrared detection elements having their respective fields of view in a heating chamber, of the plurality of infrared detection elements a predetermined infrared detection element having a field of view partially external to the heating chamber, includes the steps of: determining whether the object to be heated is covered by the field of view of the predetermined infrared detection element; and stopping a heating operation if the object to be heated is covered by the field of view of the predetermined infrared detection element.

Thus in the microwave oven the infrared detection elements includes an infrared detection element having a field of view partially external to the heating chamber and thus incapable of accurately detecting the temperature of the object to be heated and if in the field of view of the infrared detection element there exists the object to be heated the microwave oven stops the current heating operation.

As such, wherever in the heating chamber the object to be heated may be placed, the infrared detection elements' outputs can be effectively used to control a heating operation, as appropriate.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter the embodiments of the present invention will be described with reference to the drawings.

1. Structure of Microwave Oven

Figure 1:
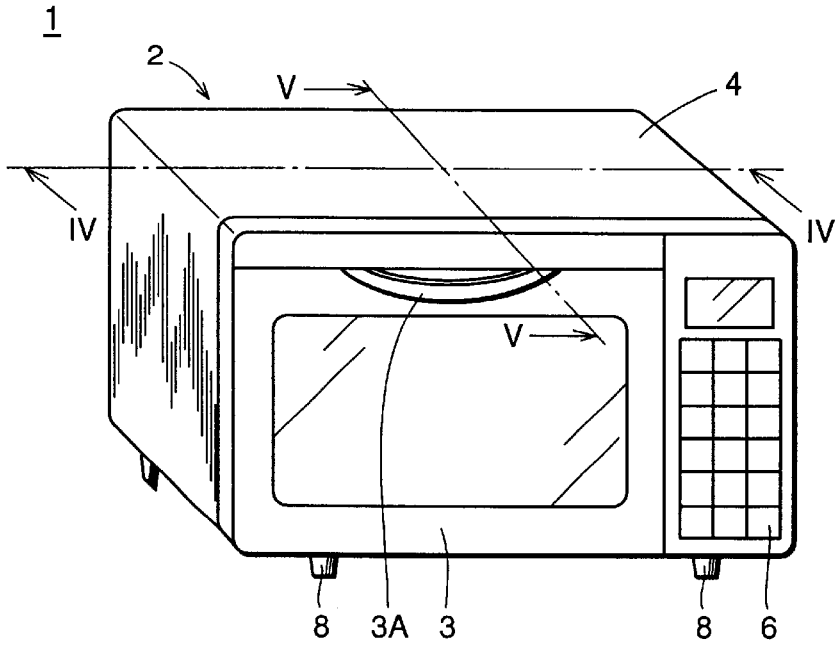
FIG. 1 is a perspective view of a microwave oven as one embodiment of the present invention.

With reference to FIG. 1, a microwave oven 1 is formed mainly of a body 2 and a door 3. Body 2 has its outer surface covered by an exterior 4. Body 2 has a front side provided with an operation panel 6 allowing a user to input various information to microwave oven 1. Body 2 is supported on a plurality of legs 8.

Door 3 can be opened and closed with its lower end serving as an axis. Door 3 has an upper portion provided with a handle 3A.

Figure 2:
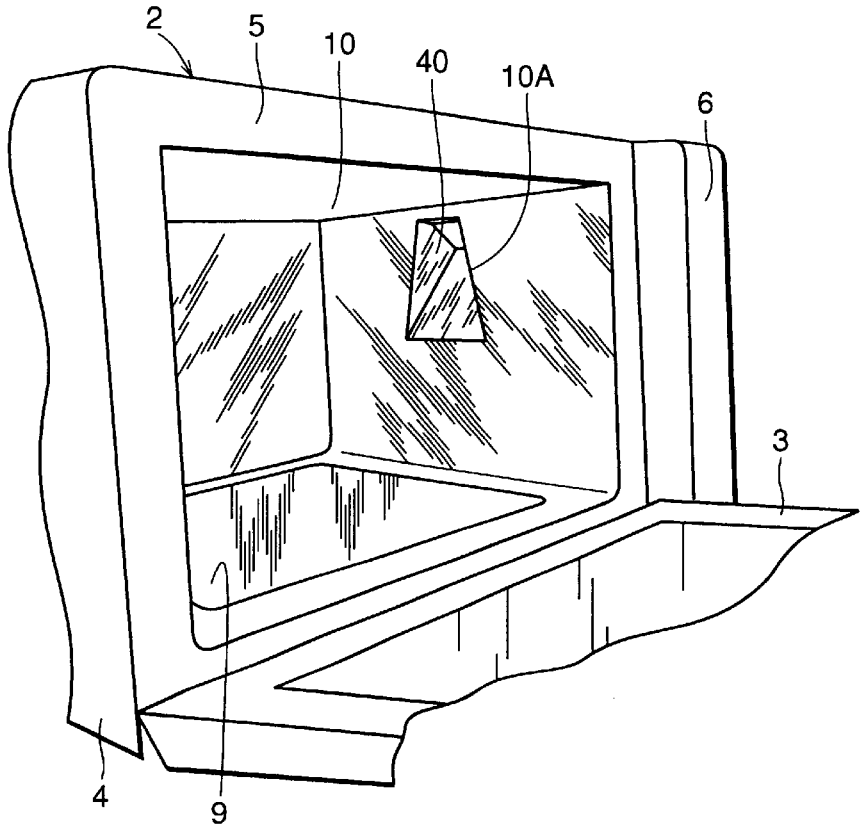
FIG. 2 is a perspective view of the FIG. 1 microwave oven with its door open.

Furthermore, with reference to FIG. 2, body 2 is internally provided with a body frame 5. Body frame 5 surrounds a heating chamber 10. Heat chamber 10 has an upper right side portion provided with a hole 10A. Hole 10A connects with a detection path member 40 external to heating chamber 10. Heating chamber 10 has a bottom provided with a bottom plate 9.

Figure 3:
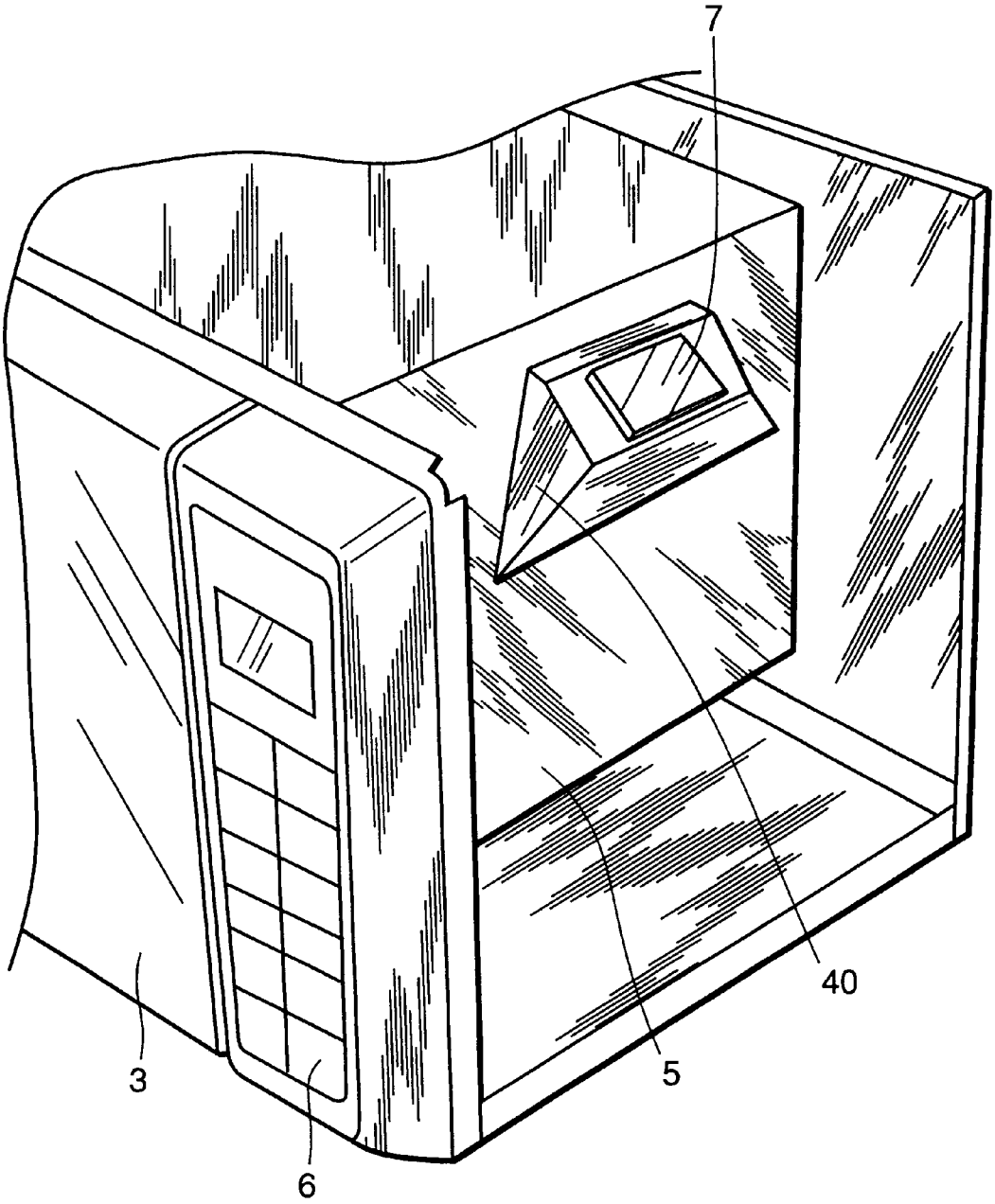
FIG. 3 is a perspective view of the FIG. 1 microwave oven with its exterior removed.

Although not shown in FIG. 3, on the right side of body frame 5 a magnetron 12 (see FIG. 4) and other various components are mounted adjacent to heating chamber 10.

Figure 4:
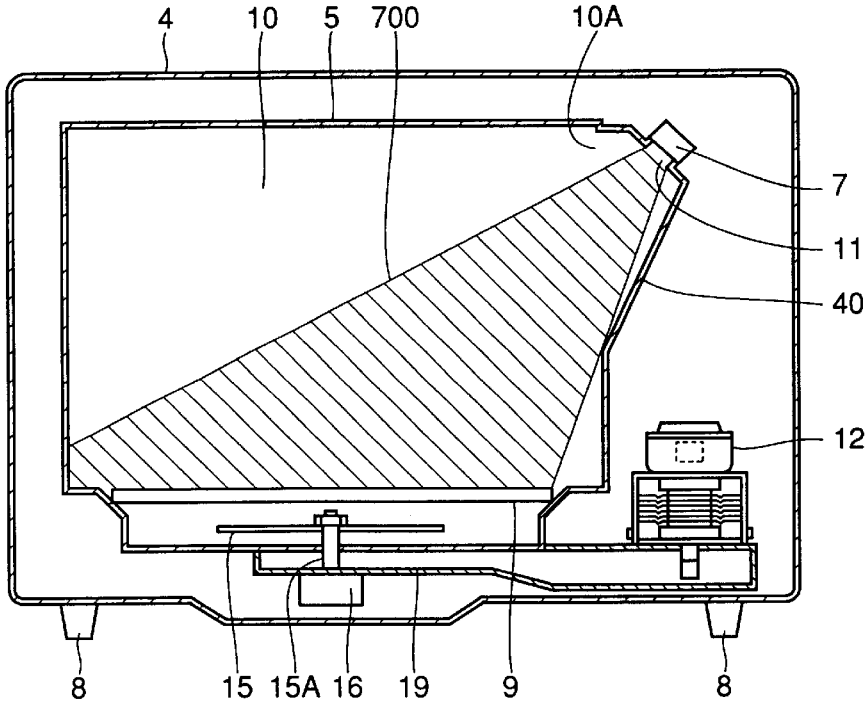
FIG. 4 is a cross section of the FIG. 1 microwave oven, taken along line IV—IV.
Figure 5:
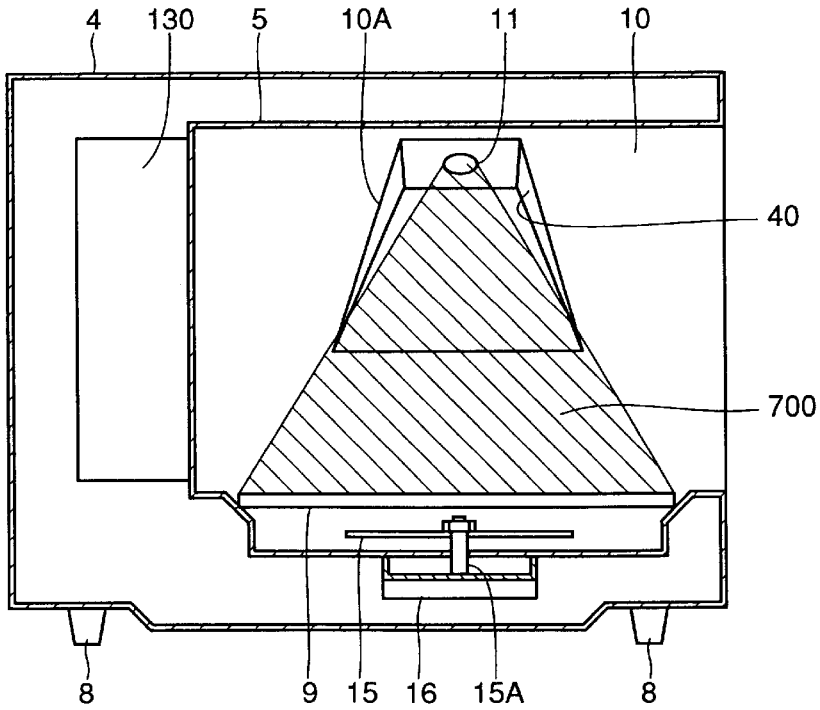
FIG. 5 is a cross section of the FIG. 1 microwave oven, taken along line V—V.

With reference to FIGS. 3–5, detection path member 40 connected to hole 10A has an opening connected to hole 10A and it is provided in the form of a box. The form of the box corresponding to detection path member 40 has a bottom side with an infrared sensor 7 attached thereto and a detection window 11 formed therein. Through detection window 11 infrared sensor 7 senses infrared radiation in heating chamber 10.

Inside exterior 4 magnetron 12 is provided adjacent to a lower right portion of heating chamber 10. Furthermore, below heating chamber 10 a waveguide 19 is provided to connect magnetron 12 and a lower portion of body frame 5 together. Magnetron 12 supplies microwave to heating chamber 10 via waveguide 19.

Furthermore, a rotative antenna 15 is provided between the bottom of body frame 5 and bottom plate 9. Under waveguide 19 is provided an antenna motor 16. Rotative antenna 15 and antenna motor 16 are connected by a spindle 15A. When antenna motor 16 is driven, rotative antenna 15 rotates.

In heating chamber 10 on bottom plate 9 a food is placed. Magnetron 12 generates a microwave which is in turn transmitted via waveguide 19, agitated by rotative antenna 15 and thus supplied to heating chamber 10 to heat the food on bottom plate 9.

Furthermore, behind heating chamber 10 is provided a heater unit 130 housing a heater and a fan provided to efficiently transfer to heating chamber 10 the heat generated by the heater. Although not shown in the figure, a heater is also provided above heating chamber 10 to burn the surface of the food.

2. Field of View of Infrared Sensor

Infrared sensor 7 includes a plurality of infrared detection elements (infrared detection elements 7A described hereinafter). Each infrared detection element has a field of view. Infrared sensor 7 can thus have a field of view considered the fields of view of the infrared detection elements that are combined together. FIGS. 4 and 5 schematically illustrate a field of view of infrared sensor 7 as a total field of view 700.

Infrared sensor 7 has a field of view covering the entirety on bottom plate 9. Thus, wherever in microwave oven 1 on bottom plate 9 a food may be placed, infrared sensor 7 is not required to move its field of view to cover the food.

As has been described above, infrared sensor 7 includes a plurality of infrared detection elements.

Figure 6:
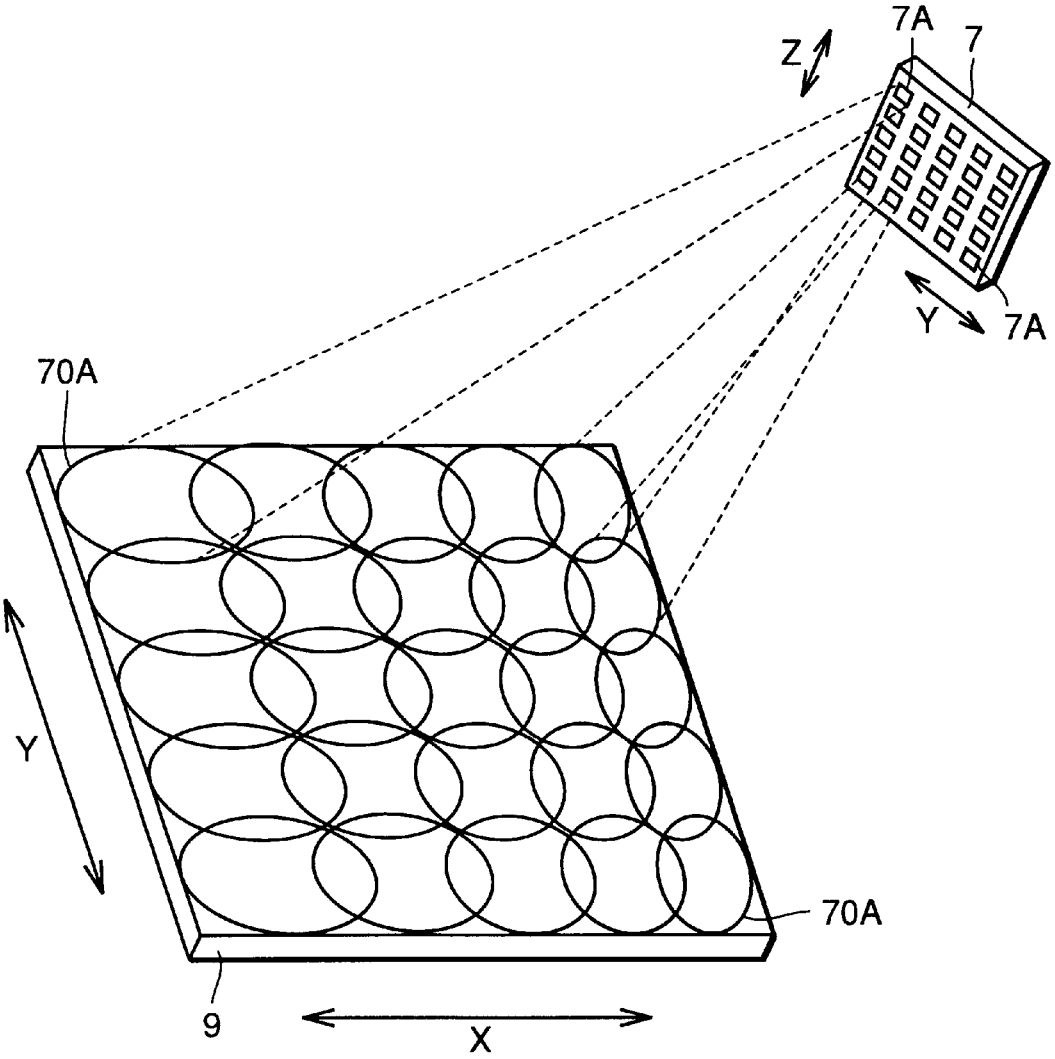
FIG. 6 schematically shows a field of view of an infrared detection element of the FIG. 1 microwave oven that is included in an infrared sensor thereof.

FIG. 6 schematically shows bottom plate 9 and infrared sensor 7. Note that in FIG. 6 a two-head arrow X corresponds to the width of microwave oven 1, a two-head arrow Y corresponds to the depth of microwave oven 1, and a two-head arrow Z corresponds to the height of microwave oven 1. Arrows X, Y and Z are orthogonal to each other.

Infrared sensor 7 includes a total of 25 infrared detection elements 7A, five in direction Y and five in direction Z. Infrared detection elements 7A each have a field of view 70A.

25 infrared detection elements 7A have their respective fields of view 7A projected on bottom plate 9, on which a total of 25 fields of view 70A are projected, five in direction Y and five in direction X. Note that corresponding to five infrared detection elements 7A arranged in direction Y, on bottom plate 9 five fields of view 70A are arranged in direction Y. Furthermore, corresponding to five infrared detection elements 7A arranged in direction Z, on bottom plate 9 there are five fields of view 70A arranged in direction X.

Note that on bottom plate 9 in direction X a field of view 70A projected that is closer to the right side has a smaller area, since as seen in direction X bottom plate 9 closer to the right side is closer to infrared detection element 7A.

A single infrared detection element 7A cannot have the field of view 70A covering the entirety of bottom plate 9. However, as shown in FIG. 6, infrared sensor 7 having 25 infrared detection elements 7A with the 25 fields of view 70A combined together allows substantially the entirety of bottom plate 9 to be covered by the field of view 70A. Note that the 25 fields of view 70A combined together correspond to the total field of view 700 shown in FIG. 4 or 5.

3. Control Block Diagram

Figure 7:
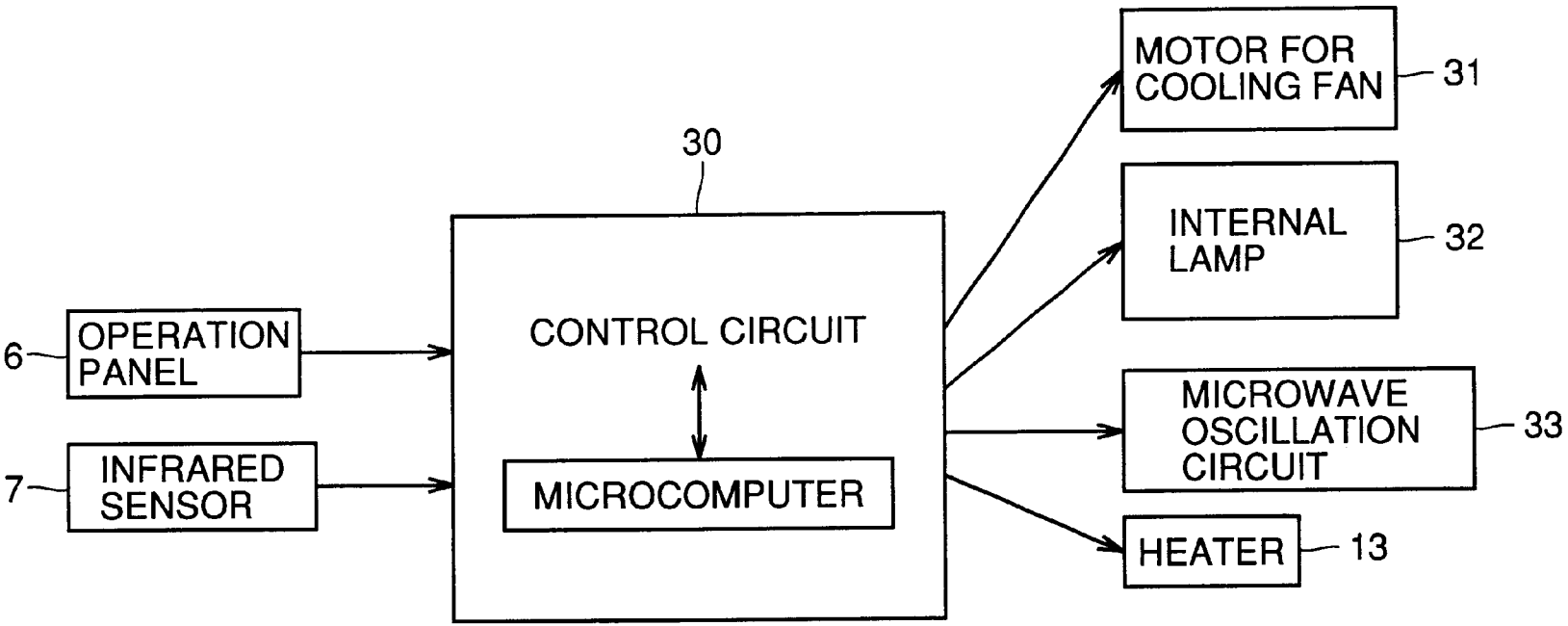
FIG. 7 is a block diagram of the control of the FIG. 1 microwave oven.

With reference to FIG. 7, microwave oven 1 includes a control circuit 30 generally controlling the operation of microwave oven 1. Control circuit 30 includes a microcomputer.

Control circuit 30 receives various information via operation panel 6 and infrared sensor 7. Control circuit 30 uses the received information and the like to control a motor for a cooling fan, an internal lamp 32, a microwave oscillation circuit 33 and a heater 13. Motor 31 drives a fan provided to cool magnetron 12. Internal lamp 32 illuminates heating chamber 10. Microwave oscillation circuit 33 allows magnetron 12 to oscillate a microwave. Heater 13 is a heater provided in heater unit 130 and a heater provided over heating chamber 10.

Note that control circuit 30 receives an output of each infrared detection element 7A, individually.

4. Automatic Cooking Process

Microwave oven 1 provides a heat-cooking process with infrared sensor 7 operating to sense the temperature of a food in heating chamber 10 to automatically terminate the heating operation. This process will now be described mainly by describing a process executed by control circuit 30.

Figure 8:
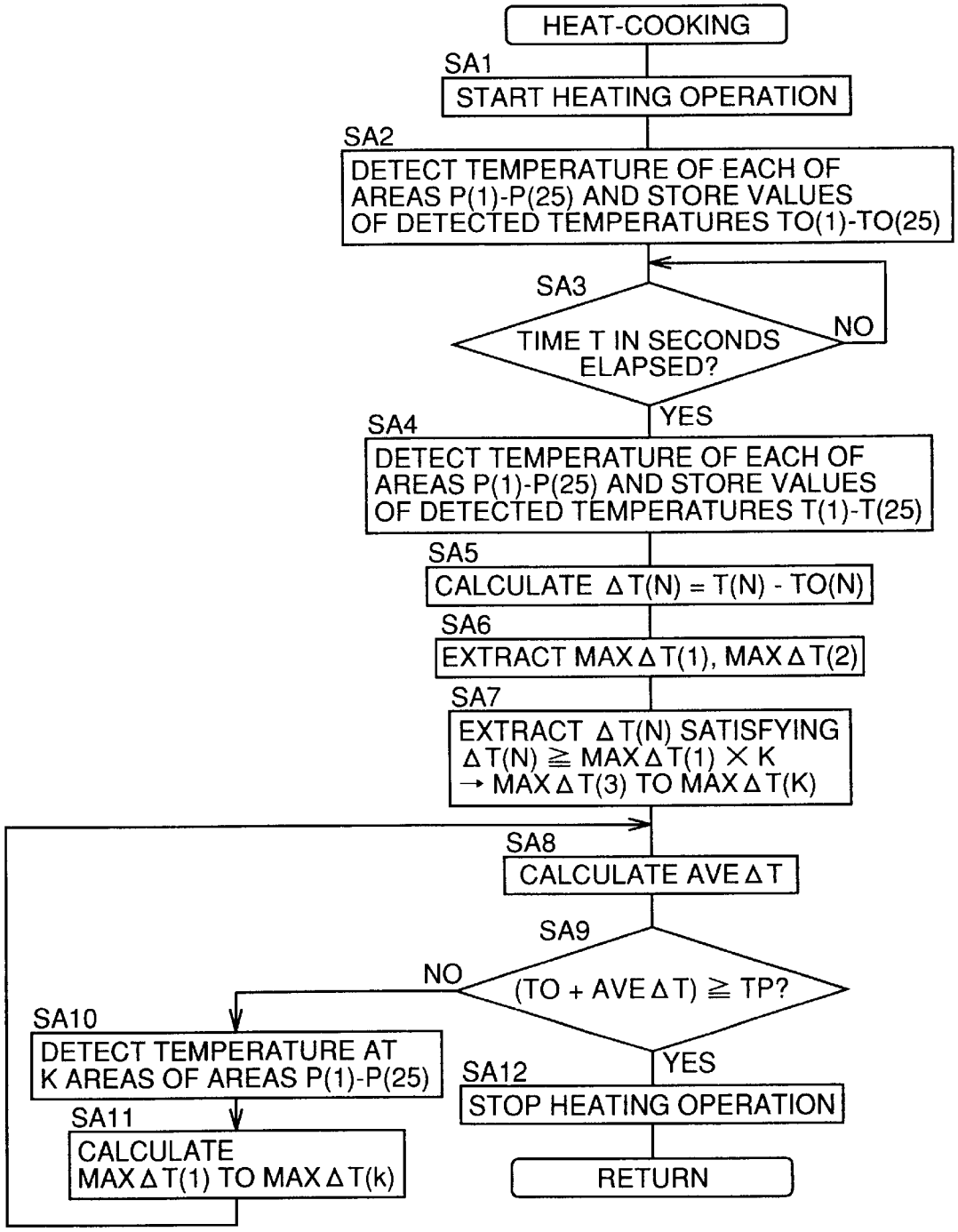
FIG. 8 is a flow chart of a heat-cooking process executed by a control circuit of the FIG. 1 microwave oven.

With reference to FIG. 8, when operation panel 6 is operated to start a heat-cooking operation, control circuit 3 initially at step SA1 controls magnetron 12 to start a heating operation and then moves to step SA2.

Figure 25:
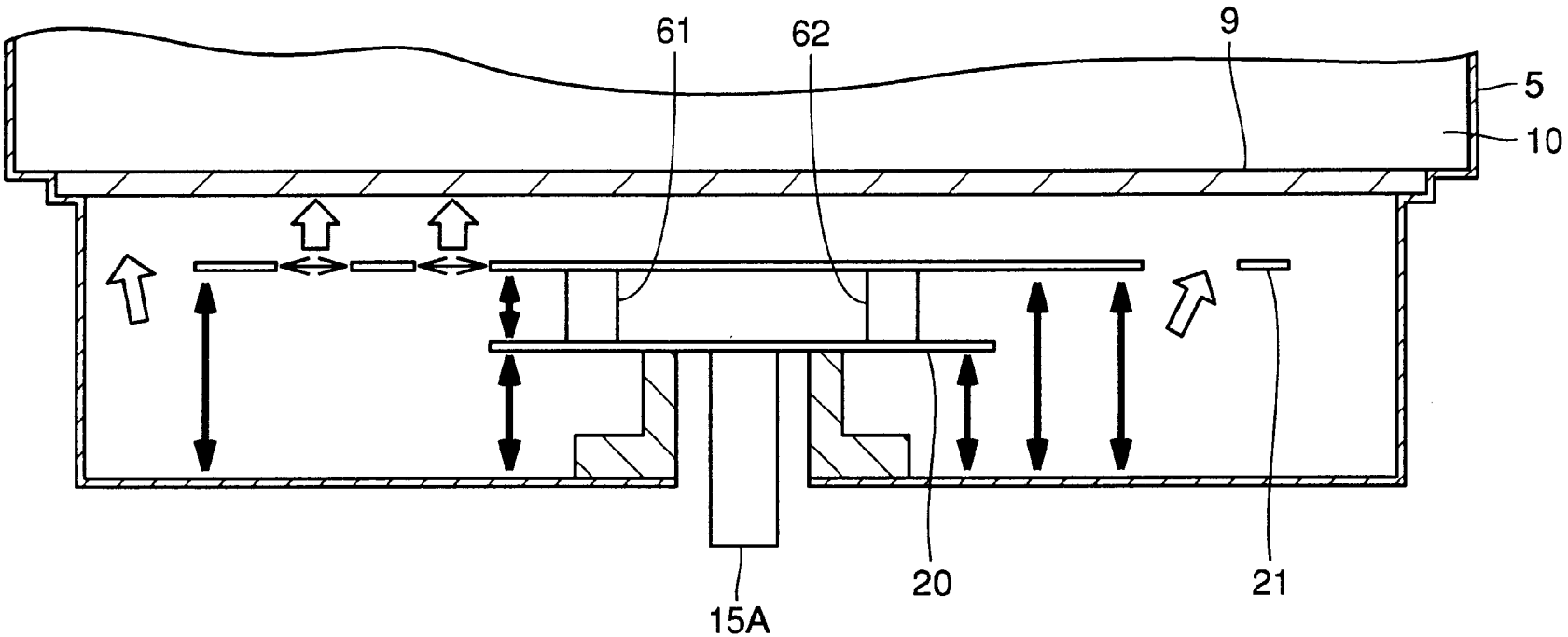
FIG. 25 is an enlarged view below the FIG. 22 heating chamber.

At step SA2, the FIG. 6 25 infrared detection elements 7*a* provide their respective detection results which are in turn used to detect the temperature of the object in each field of view 70A, and the control circuit then goes to step SA3. Note that the FIG. 6 25 infrared detection elements 7A are labeled P(1)–P(25), respectively, depending on their respective positions. Thus, at step SA2, P(1)–P(25) provide their respective detection results, which are in turn stored as TO(1)–TO(25).

At step SA3, control circuit 30 determines whether a predetermined period of time of T in seconds has elapsed since a heating operation started at step SA1. If so then the control circuit goes to step SA4.

At step SA4, control circuit 30 detects temperature based on the detection results from infrared detection elements 7A labeled P(1)–P(25) as above, and stores the values of temperature detected T(1)–T(25), and the control circuit then goes to step SA5.

At step SA5, control circuit 30 calculates for each of P(1)–P(25) the difference between value T(N) stored at step SA4 immediately previously executed and TO(N) measured immediately after the heating operation is started, wherein N is 1 to 25, and the control circuit then goes to step SA6.

At step SA6, control circuit 30 extracts from 25 ΔT(N)s calculated at step SA5 a maximal value (MAXΔT1) and a second maximal value (MAXΔT2) and the control circuit then goes to step SA7.

At step SA7, control circuit 30 extracts from the 23 ΔT(N)s remaining at step SA6 a ΔT(N) satisfying the following expression (1), and the control circuit then goes to step SA8. In expression (1) MAXΔT1 represents the maximal ΔT(N) extracted at step SA6 and K represents a constant satisfying $0<K\leqq 1$. Microwave oven 1 provides heat-cooking processes according to a plurality of cooking menus. Constant K has a value varying to reflect a cooking menu to be provided.

$$\Delta T(N) \geqq \mathrm{MAX}\Delta T1 \times K \quad (1)$$

Note that at step SA7, (K−2) ΔT(N)s satisfying expression (1) are extracted as MAXΔT3 to MAXΔTk. More specifically, at steps SA6 and SA7, from 25 ΔT(N)s the k largest ΔT(N)s, i.e., MAXΔT1 to MAXΔTk are extracted.

At step SA8, control circuit 30 uses the following expression (2) to calculate AVEΔT and then goes to step SA9.

$$AVE\Delta T = \frac{\sum_{x=1}^{k} (\mathrm{MAX}\Delta Tx)}{k} \quad (2)$$

As can be understood from expression (2), AVEΔT corresponds to an average of temperature differences of the k largest values, as measured since the heating operation was started.

At step SA9, control circuit 30 determines whether the following expression (3) is satisfied. In expression (3) TP represents a temperature set for an object to be heated and referred to to terminate a heating operation when infrared sensor 7 senses the set temperature as the object to be heated is considered as having been sufficiently heated. Set temperature TP has a value set for each individual cooking menu.

$$TO + AVE\Delta \geqq TP \quad (3)$$

Then, if control circuit 30 at step SA9 determines that expression (3) is not satisfied then the control circuit goes to step SA10.

At step SA10, control circuit 30 detects the current T (N) (a temperature based on an output of infrared detection element 7) at each of the k positions at which MAXΔT1 to MAXΔTk are extracted at steps SA6 and SA7. The control circuit then goes to step SA11.

At step SA11, control circuit 30 calculates MAXΔT1 to MAXΔTk from the temperature detected at the step SA10 immediately previously performed and TO detected at steps SA2 and the control circuit then goes to step SA8. The SA10–SA11 steps continue until at step SA9 the control circuit determines that expression (3) is satisfied.

If at step SA9 the control circuit determines that expression (3) is satisfied then at step SA12 the control circuit controls magnetron 12 to terminate the heating operation and then returns.

In the above described heat-cooking process, as has been described as the SA8–SA11 steps, whether an object to be heated has been completely heated is determined ultimately from the outputs of k of 25 infrared detection elements 7A. As has been described in the SA3–SA7 steps, the k outputs allow temperature elevation ΔT(N), as measured after a heating operation starts and before a predetermined period of time (t in seconds) has elapsed, to satisfy expression (1), which is that ΔT(N) has a value equal to or exceeding a maximal temperature elevation MAXΔT1 multiplied by K.

In the present embodiment, control circuit 30 configures a temperature calculation unit using an output of each infrared detection element to calculate an "in field of view" temperature corresponding to a temperature of an object in a field of view of the infrared detection element, and a heating control unit referring to the "in field of view" temperature to control the heating unit.

Furthermore, at step SA5 ΔT(N) is detected for each of 25 infrared detection elements 7A, and it corresponds to a variation in "in field of view" temperature within a predetermined period of time.

Furthermore, at steps SA6 and SA7 MAXΔT1 to MAXΔTk are extracted, and they correspond to specific variations in the predetermined period of time. Note that the specific variations within the predetermined period of time include a maximal variation within the predetermined period of time and a variation within the predetermined period of time which has a value having a predetermined percentage relative to the maximal variation within the predetermined period of time.

Furthermore at step SA10 the fields of view 70A of k infrared detection elements 7A are subject to temperature detection, and they correspond to specific fields of view. Note that the specific field of view is one of the fields of views of the multiple infrared detection elements that corresponds to a specific variation within the predetermined period of time.

Then at the SA8–SA11 steps control circuit 30 refers to the "in field of view" temperatures in the specific fields of view to control the heating unit.

In the present embodiment, as shown in FIG. 6, infrared sensor 7 has 25 infrared detection elements 7A arranged in a 5×5 matrix and having the fields of view 70A each corresponding to a different area on bottom plate 9 to together cover substantially the entirety of bottom plate 9. In other words, wherever on bottom plate 9 a food may placed, the food can be covered by at least one of the 25 fields of view 75A.

Thus, in the present embodiment, wherever in the heating chamber an object to be heated may be placed, the plurality of infrared detection elements are not required to move their fields of view to cover at least a portion of the food placed in the heating chamber.

In the present embodiment an area having experienced a largest temperature variation since a heating operation started (i.e., an area in which MAXΔT1 is detected) is considered as bearing a food thereon and thus has its temperature continuously detected until the heating operation ends(steps SA8–SA11).

Furthermore, an area having experienced a second largest temperature variation since the heating operation started (i.e., an area in which MAXΔT2 is detected) is also considered as bearing a food thereon and thus has its temperature continuously detected until the heating operation ends (steps SA8–SA11).

Furthermore, if an area has a temperature variation relative to the largest temperature variation that is equal to or exceeds a predetermined percentage (K, see step SA7), then the area also has its temperature continuously detected until the heating operation ends (steps SA8–SA11).

Thus, if a plurality of objects to be heated are placed on bottom plate 9, their temperatures can all be referred to to execute a heat-cooking process.

It should be noted, however, that while in the present embodiment the area with MAXΔT2 detected has its temperature continuously detected until the heating operation ends, whether or not MAXΔT2 is equal to or exceeds K times MAXΔT1, the present embodiment is not limited as above.

More specifically, while in the present embodiment at least two areas (those at which MAXΔT1 and MAXΔT2 are detected) have their respective temperatures continuously detected until the heating operation ends, only a single area may alternatively have its temperature continuously detected until the heating operation ends. In this example, step SA6 is changed to extract only MAXΔT1 and furthermore at step SA7 are extracted (k−1) values, MAXΔT2 to MAXΔTk.

If infrared sensor 7 includes a plurality of infrared detection elements 7A, it is not a requirement that bottom plate 9 has substantially any area thereof covered by the field of view 70A of infrared detection element 7A, as shown in FIG. 6.

Hereinafter, as a first variation of the present embodiment, infrared sensor 7 including a plurality of infrared detection elements 7A arranged in a predetermined direction in a line will now be described by way of example.

5. First Variation

Figure 9A:
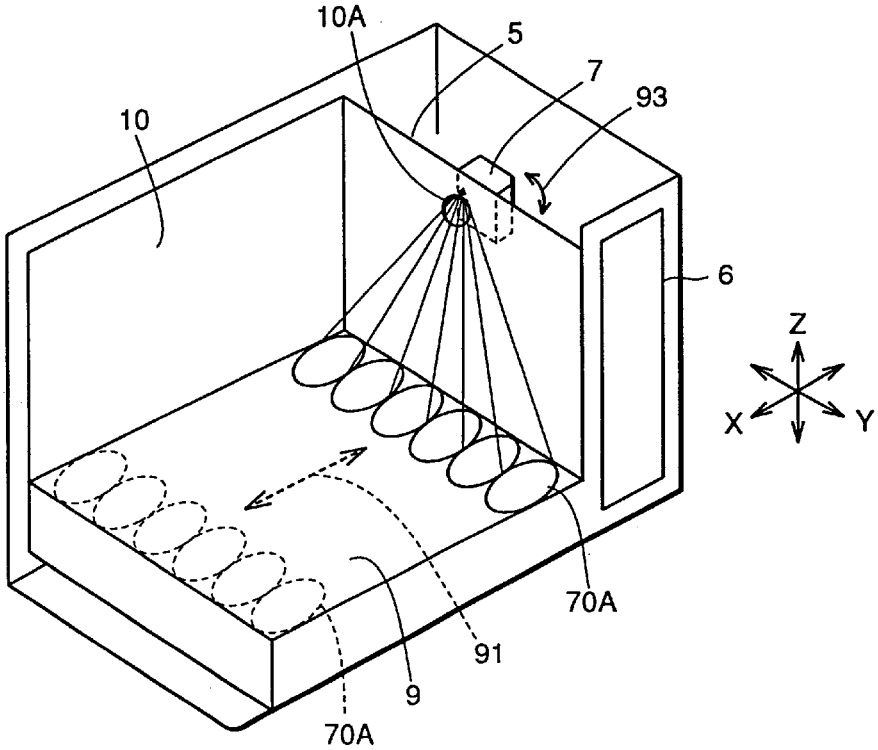
FIG. 9A shows a first variation of the FIG. 1 microwave oven.

In FIG. 9A, infrared sensor 7 has infrared detection elements 7A arranged in a line in the direction of the depth of heating chamber 10, although not shown in the figure. In FIG. 9A, exterior 4 and door 3 are omitted and so is a portion of body frame 5 corresponding to a left-side wall of heating chamber 10, to allow heating chamber 10 to have it interior readily visually observed. Furthermore, in FIG. 9A axes X, Y and Z are defined to correspond to the width, depth and height of heating chamber 10, respectively. These three axes are orthogonal to each other.

Figure 9B:
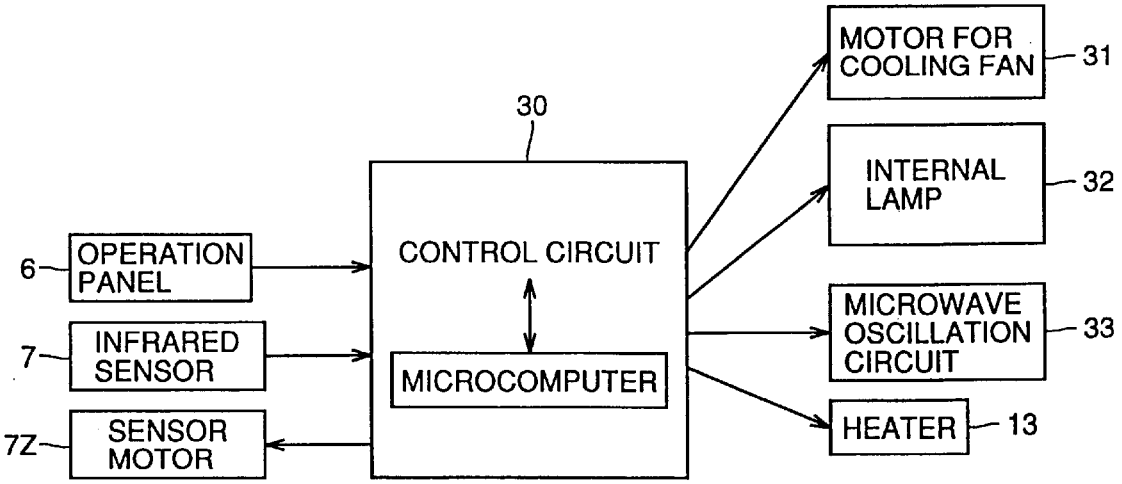
FIG. 9B is a block diagram showing the control of the first variation of the FIG. 1 microwave oven.

In the present variation, microwave oven 1 includes infrared sensor 7 having six infrared detection elements 7A arranged in direction Y and in addition to the FIGS. 1 and 7 microwave oven 1 a sensor motor 7Z is provided to move a field of view of infrared detection element 7A, (see FIG. 9B).

With infrared sensor 7 having six infrared detection elements 7A, on bottom plate 9 are simultaneously projected six fields of view 70A arranged in direction Y, as represented by solid lines. Bottom plate 9 is covered by six fields of view 70A in direction X at an area extending in direction Y from one end to the other end.

Furthermore microwave oven 1 is also provided with a member (sensor motor 7Z) capable of moving infrared sensor 7 in the direction indicated by a two-head arrow 93 corresponding to a direction of rotation on the X-Z plane. Sensor motor 7Z operates as controlled by control circuit 30.

Since infrared sensor 7 moves in direction 93, infrared detection element 7A also positionally moves and the field of view 70A projected on bottom plate 9 thus has a position moving in a direction indicated by a two-head arrow 91 (i.e., in direction X). More specifically, moving infrared sensor 7 in direction 93 allows the field of view 70A to move from a position indicated by the solid line to a position indicated by the broken line.

Figure 10:
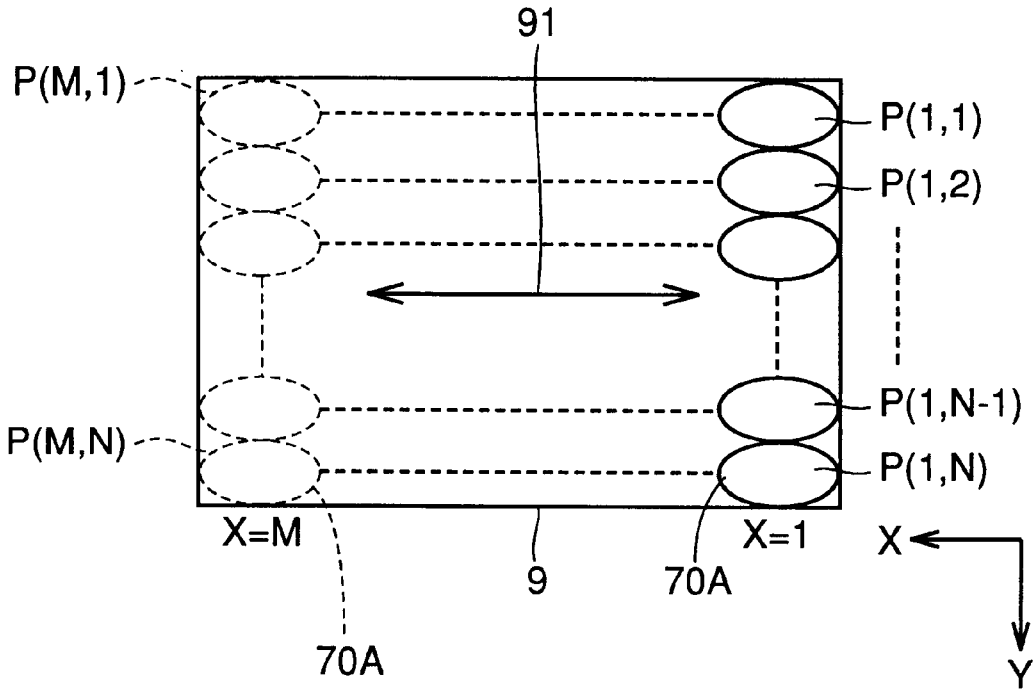
FIG. 10 schematically shows the first variation of the FIG. 1 microwave oven with an infrared detection element having a field of view moving on the bottom plate.
Figure 11:
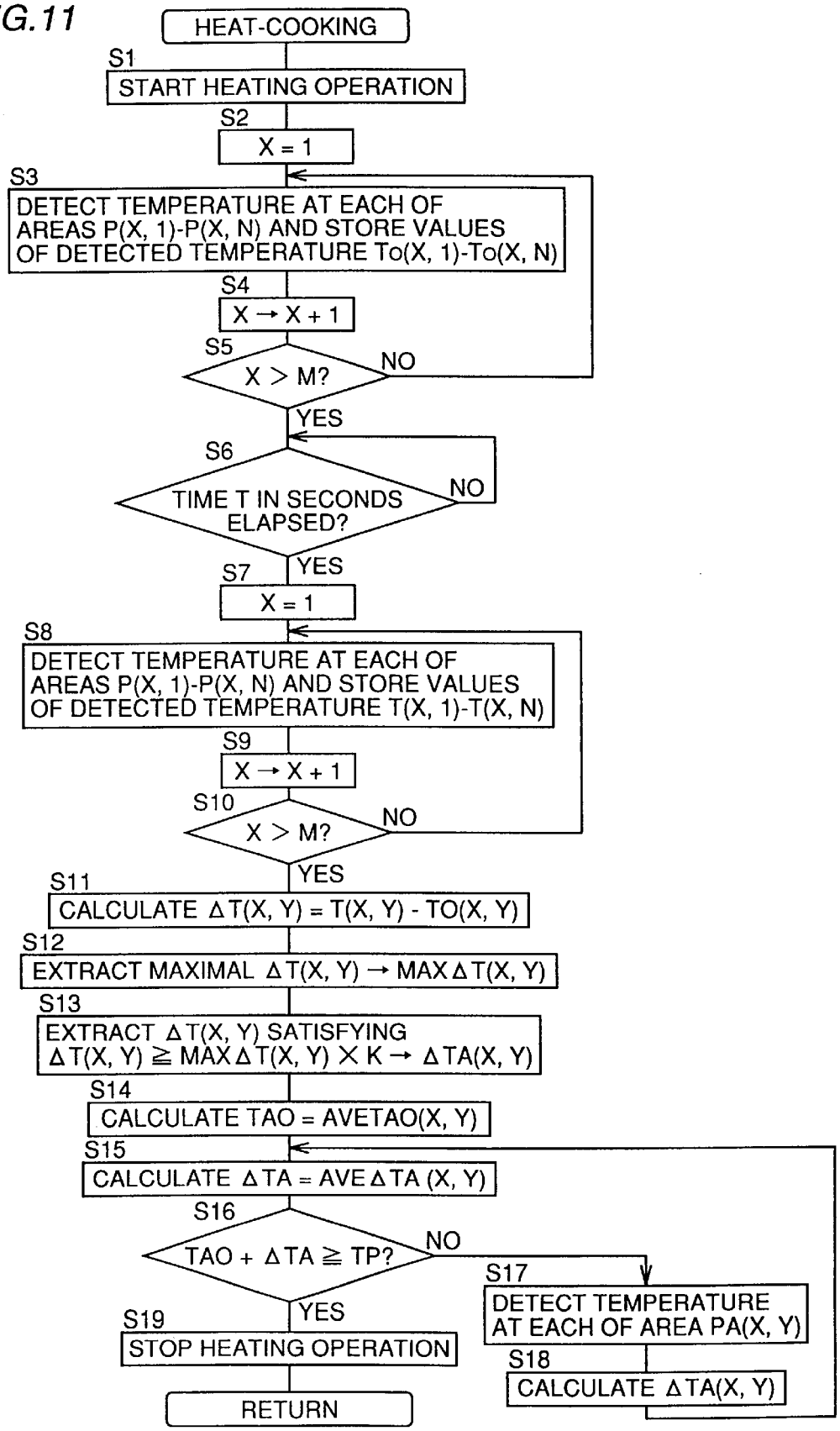
FIG. 11 is a flow chart of a heat-cooking process executed by the control circuit in the first variation of the FIG. 1 microwave oven.

Reference will now be made to FIGS. 10 and 11 to describe in the present variation how an output of each infrared detection element 7A of infrared sensor 7 is used to provide a heat-cooking operation.

Note that the following description will be made generally for microwave oven 1 having infrared detection element 7A arranged in the direction of the depth of heating chamber 10 and accordingly in FIG. 10 the number of infrared detection elements 7A is not limited to any particular number and there exist N fields of view 70A aligned in direction Y. Furthermore, in FIG. 10, the field of view 70A can take M positions as it moves in direction X. More specifically, if a coordinate system P (X, Y) is applied, then on bottom plate 9 the field of view 70A has a position represented by P (1, 1) to P (M, N).

Furthermore in the present variation the plurality of infrared detection elements 7A have their respective fields of views arranged to simultaneously cover bottom plate 9 in direction Y from one end to the other end. As such, the plurality of infrared detection elements 7A have their fields of view in the coordinate system P (X, Y) with a coordinate X having a uniform value and a coordinate Y having N values ranging from one to N.

When operation panel 6 is used to provide a heat-cooking operation, control circuits 30 initially at S1 controls magnetron 12 to start a heating operation.

Then at S2 control circuit 30 moves infrared sensor 7 to allow infrared detection elements 7A to have their fields of view 70A having coordinate X equal to one. The position (X=1) corresponds to a rightmost area of bottom plate 9. If infrared detection element 7A have their fields of view 70A having coordinate X equal to one, the fields of view 70A, as shown in FIGS. 9 and 10, correspond to the areas indicated by the solid lines and the plurality of infrared detection elements 7A have their fields of view having coordinates P(1, 1) to P(1, N).

Then at S3 control circuit 30 uses outputs of the infrared detection elements for the current positions of their fields of view 70A to detect the temperature of an object in the fields of view 70A, and stores detected temperatures TO(X, 1) to TO(X, N). TO(X, 1) to TO(X, N) each have value X substituted by the value of the current coordinate X of a respective one of the fields of view 70A.

Then at S4 control circuit 30 increments the value of coordinate X of each field of view 70A by one to update it. This moves coordinate X of the field of view 70A to the position of coordinate X resulting from the increment.

Then at S5 control circuit 30 determines whether the value of coordinate X obtained at S4 exceeds M. If not then the control circuit returns to S3 and if so then the control circuit moves to S6. Thus the S3 and S4 steps continue until the field of view 70A having coordinate X of one attains that of M. Thus bottom plate 9 has its entirety covered N×M fields of view 70A.

At S6 control circuit 30 determines whether a predetermined temporal period of T in seconds has elapsed since temperature was detected at S3 for X=1, and if so then the control circuit moves to S7.

At S7 control circuit 30 moves infrared sensor 7 to allow infrared detection element 7A to each have a field of view 70A with a coordinate X equal one.

At S8, the outputs from the infrared detection elements for the current positions of the fields of view 70A are used to detect the temperature of an object in each field of view 70A and detected temperatures T(X, 1) to T(X, N) are stored.

Then at S9 control circuit 30 increments the value of coordinate X of each field of view 70A by one to update it.

Then at S10 control circuit 30 determines whether the value of coordinate X obtained at S9 exceeds M. If not then the control circuit returns to S8 and if so then the control circuit moves to S11. Thus the S8 and S9 steps continue until the fields of view 70A having coordinate X of one attains coordinate X of N.

At S11 control circuit 30 uses TO(1, 1) to TO(M, N) stored at S3 and T(1, 1) to T(M, N) stored at S8 to calculate ΔT(X, Y) for each coordinate and then move to S12. More specifically, at S11 are calculated N×M ΔT(X, Y)s. Note that ΔT(X, Y) is calculated according to the following expression (4):

$$\Delta T(X, Y)=T(X, Y)-TO(X, Y) \quad (4)$$

wherein TO(X, Y) represents temperature at each coordinate (X, Y) detected immediately after the process is started, and T(X, Y) represents temperature at each coordinate (X, Y) detected when time T in seconds have elapsed since TO(X, Y) was detected. More specifically, ΔT(X, Y) represents a temperature elevation at each coordinate for time T in seconds.

At S12 control circuit 30 extracts a maximal one of N×M ΔT(X, Y)s and stores it as MAXΔT(X, Y).

Then at S13 control circuit 30 extracts any of N×M ΔT(X, Y)s calculated at S11 that satisfy the following expression (5) and stores the same as TA(X, Y).

$$\Delta T(X, Y) \geqq MAX\Delta T(X, Y) \times K \quad (5)$$

wherein K represents a constant satisfying $0<K\leqq 1$ and varies in value to reflect a cooking menu to be executed.

Hereinafter, the position of the field of view 70A corresponding to ΔTA(X, Y) will be referred to as a "specific position."

At S14, for specific positions extracted at S13 corresponding to ΔTA(X, Y), control circuit 30 calls for temperature TO(X, Y) detected immediately after the heating operation is started that is stored at S3 and control circuit 30 provides it as TAO(X, Y) and calculates an average thereof (AVETAO (X, Y)) and stores the average as TAO.

Then at S15 control circuit 30 calculates an average AVEΔTA(X, Y) of ΔTA(X, Y)s extracted at S13 and stores the average as ΔTA.

Then at S16 control circuit 30 determines whether TAO calculated at S14 plus ΔTA calculated at S15 attains TP. If not then the control circuit moves to S17 and if so then the control circuit goes to S19. TP represents a temperature set for an object to be heated, adopted to terminate a heating operation when the temperature is attained as the object to be heated is considered as having been sufficiently heated.

At S19 control circuit 30 controls magnetron 12 to terminate the heating operation and the control circuit thus ends the heat-cooking process and returns.

In contrast at S17 control circuit 30 detects temperature at a specific position (referred to as a coordinate PA(X, Y)) extracted at S13 as TA(X, Y).

Then at S18 control circuit 30 calculates for each specific position a difference ΔTA(X, Y) between temperature detected at the immediately previously executed S17 and that detect at S3 and then returns to S15.

In the present variation, temperature detection within the field of view 70A is provided on bottom plate 9 at N×M areas labeled P (1, 1) to P (M, N). Note that the temperature detection at each of N×M areas is provided immediately after a heating operation is started (S2–S5) and when a predetermined period of time has elapsed since the heating operation was started (S7–S10).

Then, for each of N×M areas, temperature variation is calculated for a predetermined period of time (T in seconds) elapsing after the heating operation is started and it is provided as ΔT(1, 1) to ΔT(M, N) (S11).

Then from ΔT(1, 1) to ΔT(M, N) is extracted ΔTA(X, Y) having a value having at least a predetermined percentage of K relative to maximum value MAXΔT(X, Y) (S12, S13). Note that MAXΔT(X, Y) is a maximal value of ΔT(1, 1) to Δ(M, N) and ΔTA(X, Y) includes MAXΔT(X, Y). Furthermore, of N×M areas on bottom plate 9, an area corresponding to extracted ΔTA(X, Y) is referred to as a "specific position" for the sake of convenience.

In the present variation in the process following the above described process a specific one(s) of N×M areas is/are subject to temperature detection.

More specifically, TAO is calculated as an average of temperatures TAO(X, Y)s for specific positions that are measured when a heating operation is started (S14). Furthermore, ΔTA is calculated as an average of temperature elevations ΔTA(X, Y)s at the specific positions. Whether TAO plus ΔTA exceeds set temperature TP is referred to to determine whether the heating operation should be terminated (S16).

Note that the specific positions are solely subjected to temperature detection until TAO plus ΔTA exceeds set temperature TP (S17, S18, S15).

More specifically, in the present variation, an area having experienced a largest temperature variation since a heating operation was started is considered as bearing a food thereon and its temperature is continuously detected until the heating operation ends. Furthermore, if an area has a temperature variation having at least a predetermined percentage (K, see S13) relative to the largest temperature variation the area also have its temperature continuously detected until the heating operation ends.

In the present variation, the area with the largest temperature variation and that with the temperature variation of at least a predetermined percentage relative to the largest temperature variation, are generally referred to as a "specific area."

Thus, if a plurality of objects to be heated are placed on bottom plate 9 their temperatures can all be referred to to execute a heat-cooking process.

As has been described above, in the present variation the plurality of infrared detection elements 7A has their fields of view 70A combined together to cover bottom plate 9 in direction X (the direction of the width of heating chamber 10) in an area in direction Y (the direction of the depth of heating chamber 10) from one end to the other end. Furthermore, in the present variation, as has been described with reference to FIGS. 9 and 10, the field of view 70A moves in direction X.

Figure 12:
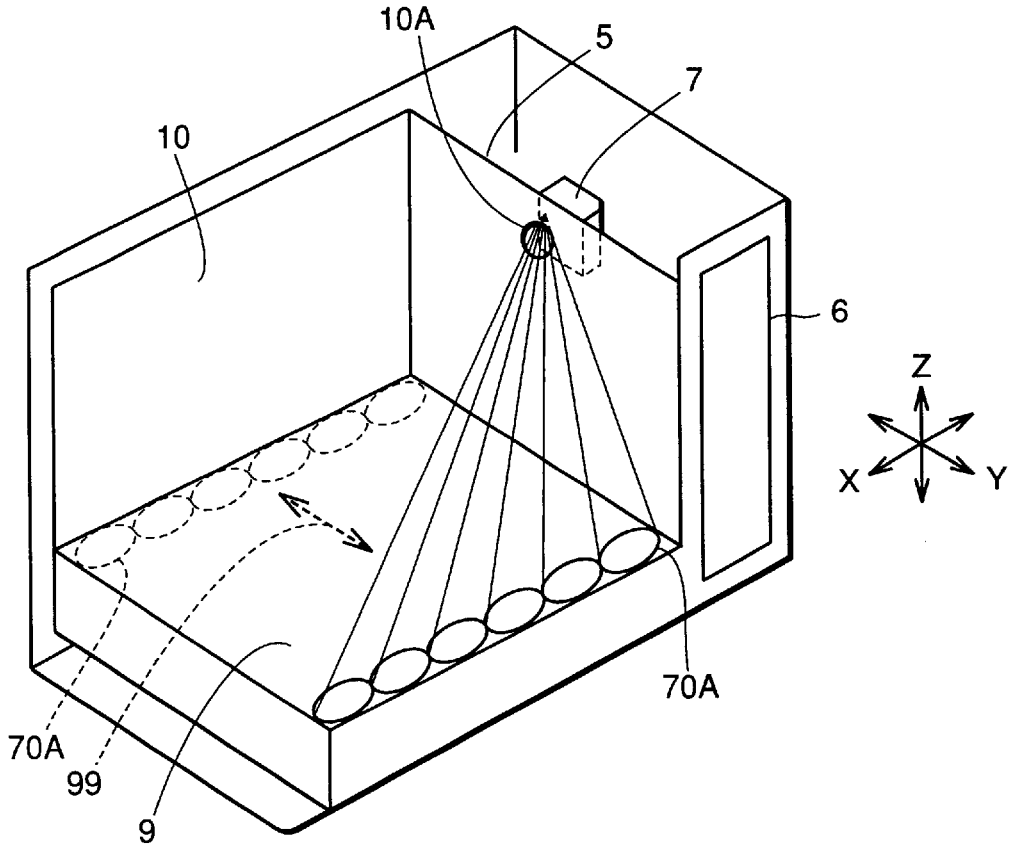
FIG. 12 shows the FIGS. 9A and 9B microwave oven with the infrared detection element having its field of view moving in a different direction.
Figure 13:
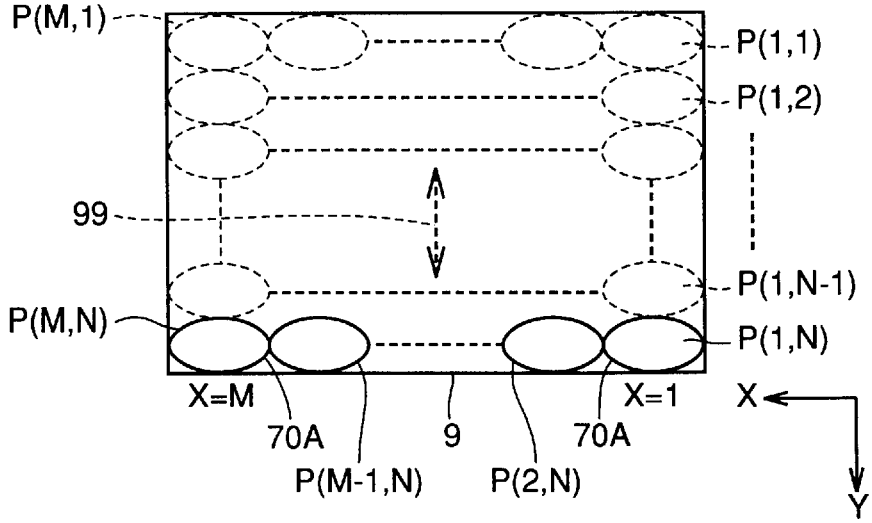
FIG. 13 shows in the FIG. 10 microwave oven the infrared detection element's field of view moving in a different direction.

Note that in microwave oven 1, as shown in FIGS. 12 and 13, infrared detection elements 7A may be provided to allow fields of view 70A to together cover bottom plate 9 in X direction from one end to the other end and also move in direction Y. More specifically, with reference to FIGS. 12 and 13, in heating chamber 10 the plurality of fields of view 70A moves in the direction of a two-head arrows 99, i.e., direction Y. Thus, if a field of view has a position represented in an X-Y coordinate system by P(X, Y), fields of view located at P(1, N) to P(M, N) moves to change their coordinates Ys.

Furthermore, the plurality of infrared detection elements 7A may not be provided to allow the fields of view 70A to cover bottom plate 9 in direction Y or X from one end to the other end. Hereinafter a description will be made of a microwave oven of a second variation, including a plurality of infrared detection elements 7A having their fields of view 70A smaller in size than bottom plate 9 in both directions X and Y when the fields of view are combined together.

6. Second Variation

Figure 14:
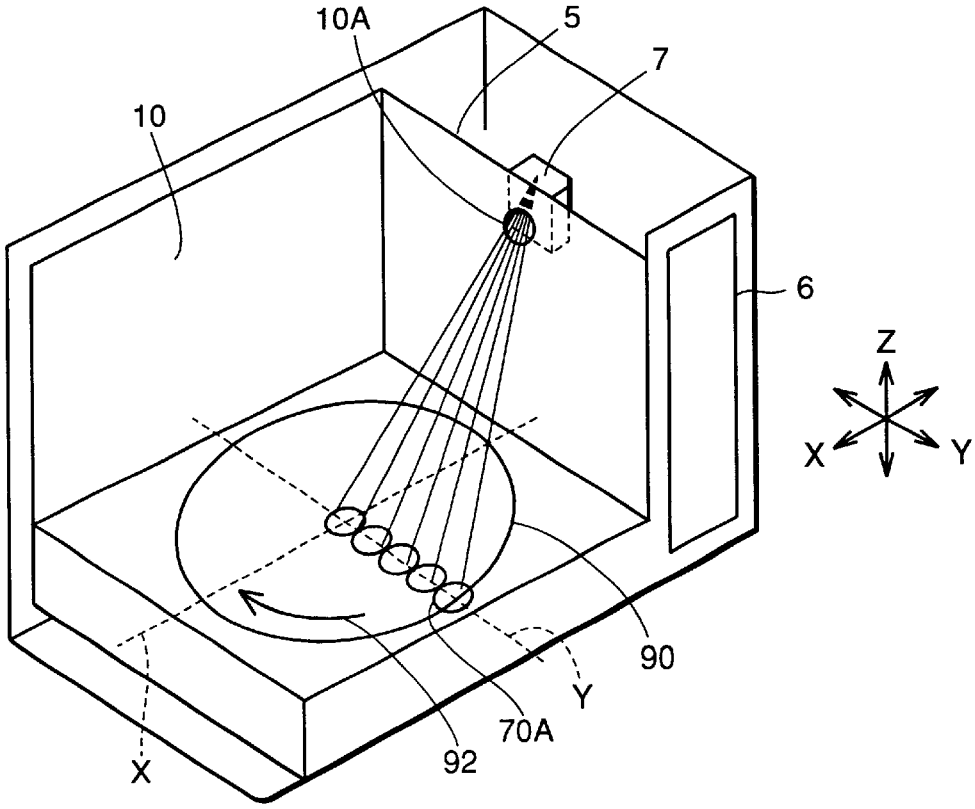
FIG. 14 shows a second variation of the FIG. 1 microwave oven.

In FIG. 14, infrared sensor 7 includes five infrared detection elements 7A arranged in a line in the direction of the depth of heating chamber 10, although not shown in the figure. As well as FIG. 9, FIG. 14 omits various components of microwave oven 1 to allow heating chamber 10 to have its interior readily, visually observed. Furthermore, in FIG. 14, heating chamber 10 has its width, depth and height defined to correspond to three axes X, Y and Z orthogonal to each other. Note that FIG. 14 shows in heating chamber 10 axes X and Y in the form of broken lines X and Y, traversing each other at the center of turntable 90. An arrow 92 indicates a direction in which turntable 90 rotates.

In the present variation, microwave oven 1 includes heating chamber 10 having a bottom side provided with a round turntable 90. As such, microwave oven 1 is preferably configured to have magnetron 12 supplying heating chamber 10 with microwave at a side surface of heating chamber 10. Accordingly, waveguide 19 and rotative antenna 15 are preferably attached to the side surface of heating chamber 10.

In the present variation five infrared detection elements 7A are arranged to have their fields of view 70A aligned in direction Y. Five fields of view 70A projected on turntable 90 that are combined together are successively projected from the center of turntable 90 to a periphery thereof. As such, when turntable 90 turns, turntable 90 has its entire area covered by five fields of view 70A.

Figure 15:
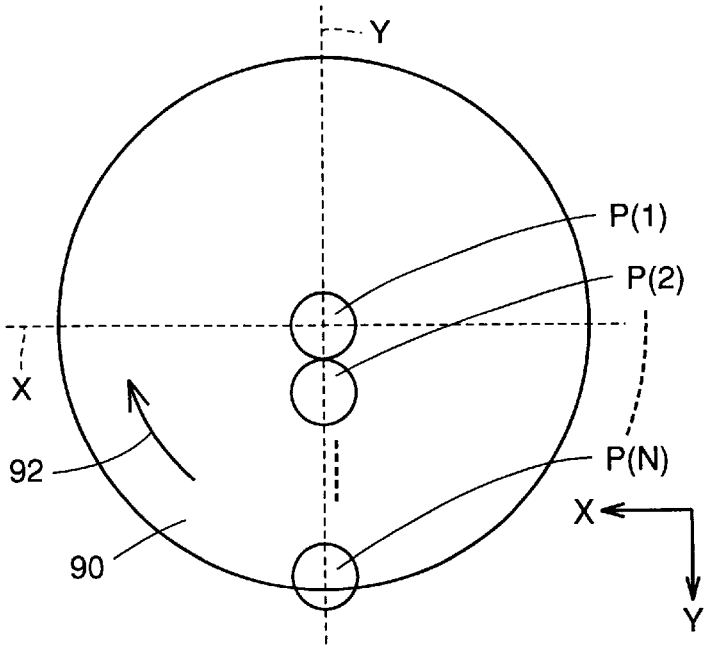
FIG. 15 schematically shows the second variation of the FIG. 1 microwave oven, illustrating a positional relationship between the field of view of the infrared detection element and the bottom plate.
Figure 16:
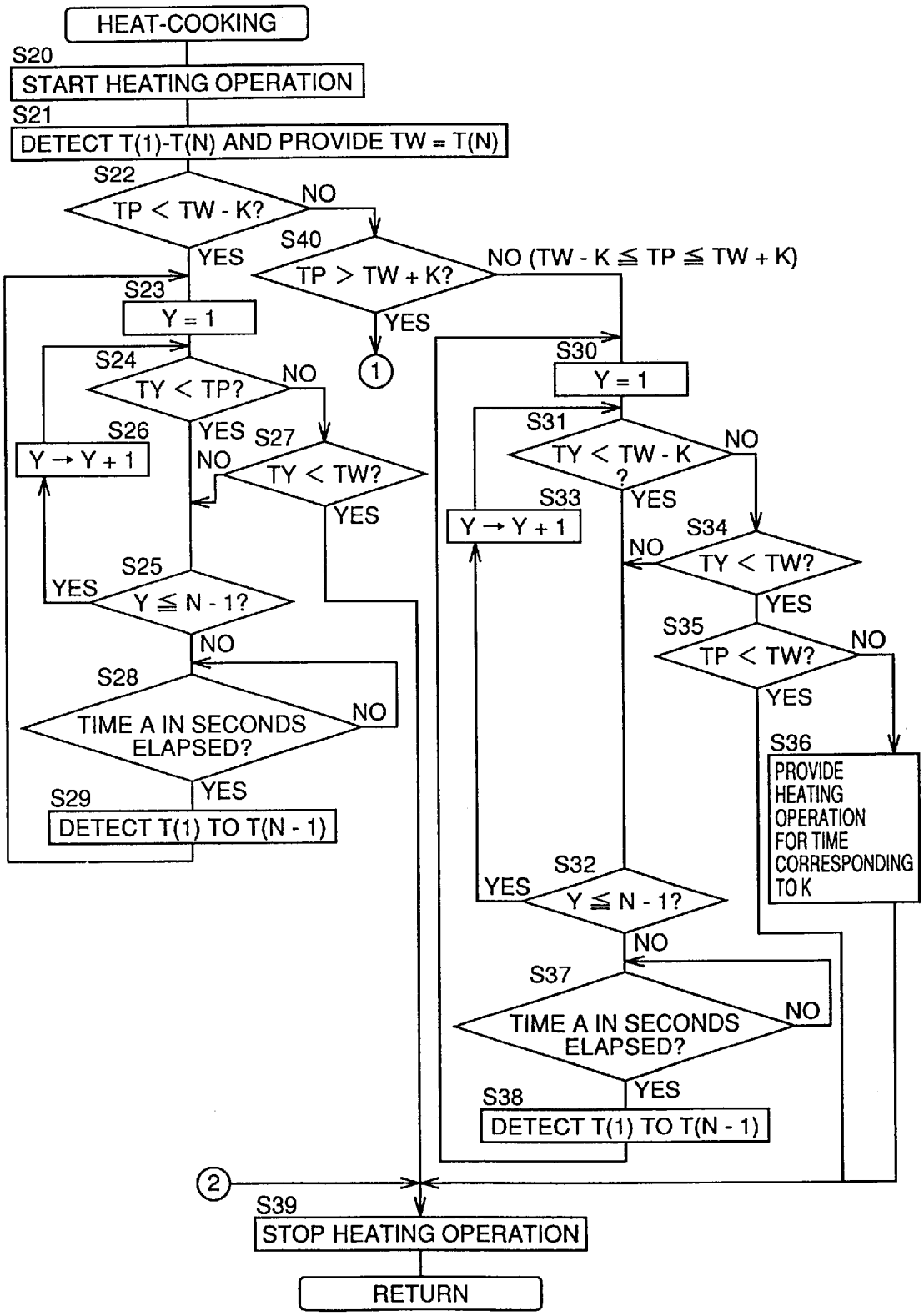
FIG. 16 is a flow chart of a heat-cooking process executed by a control circuit in the second variation of the FIG. 1 microwave oven.
Figure 17:
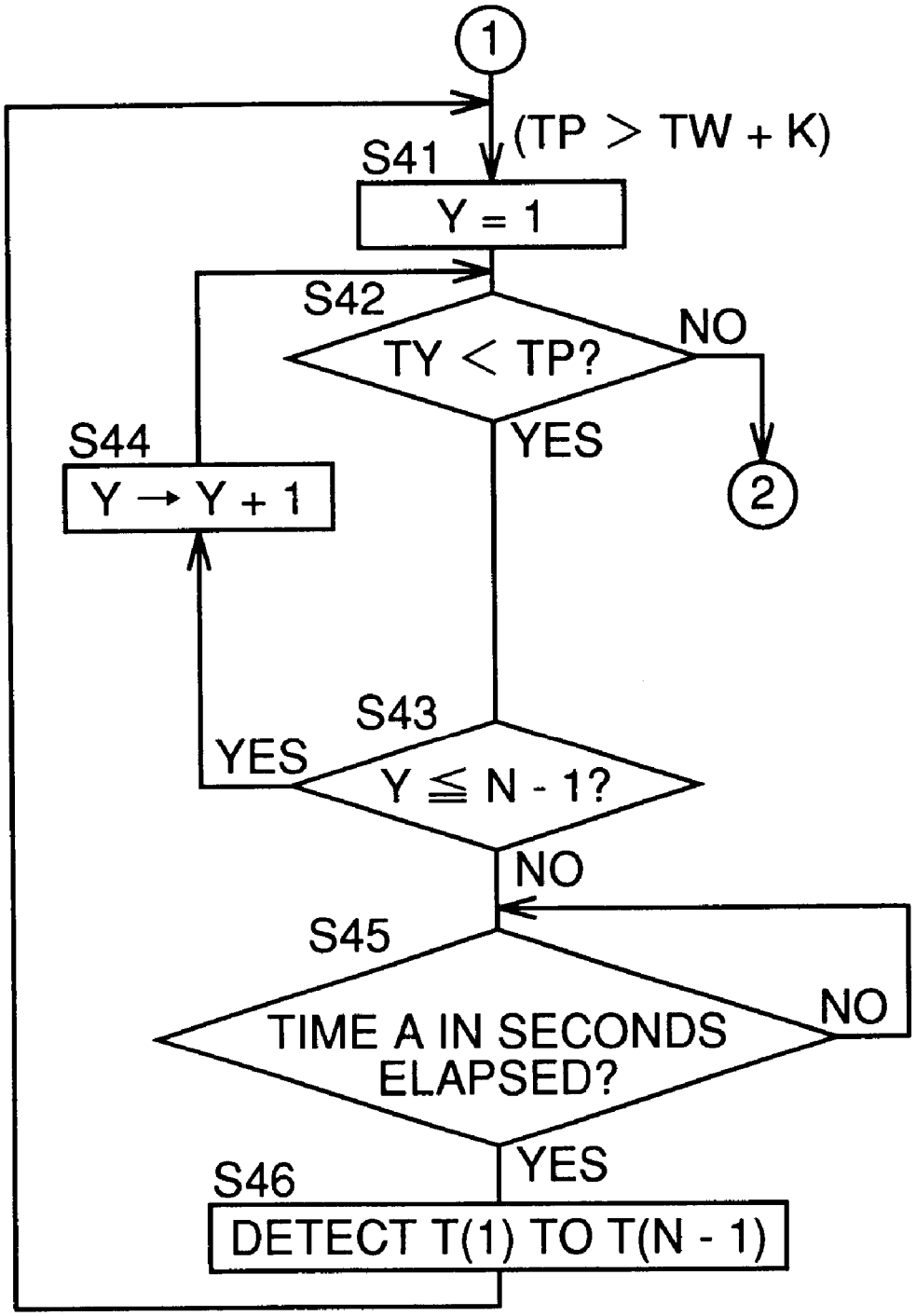
FIG. 17 is a flow chart of a heat-cooking process executed by the control circuit in the second variation of the FIG. 1 microwave oven.

Reference will now be made to FIGS. 15 to 17 to describe in the present variation how an output of each infrared detection element 7A of infrared sensor 7 is used to provide a heat-cooking process.

Note that in the following description, with reference to FIG. 15, the number of infrared detection elements 7A is not limited to any particular number to generally describe microwave oven 1 including infrared detection elements 7A arranged in the direction of the depth of heating chamber 10, and there thus exist N fields of view 70A arranged in direction Y. Thus on turntable 90 the field of view 70A can have a position, if represented by P(N), of P(1) to P(N). Note that P(1) corresponds to the center of turntable 90 and as the number in the parenthesis increases the position represented by P(N) approaches a periphery of turntable 90, and P(N) corresponds to an outermost peripheral position of turntable 90.

When operation panel 6 is operated to provide a heat-cooking process, control circuit 30 initially at S20 controls magnetron 12 to start a heating operation and the control circuit then goes to S21.

At S21 control circuit 30 detects a temperature based on an output of each infrared detection element 70A having its fields of view 70A at a respective one of positions P(1) to P(N). Control circuit 30 associates the temperatures detected at S21 with position P(1) to P(N), respectively, and stores them as T(1) to T (N). Furthermore, control circuit 30 also stores as TW a detected temperature T(N) corresponding to position P(N), at which the temperature is detected.

Then at S22 control circuit 30 determines whether TW minus K (° C.) is greater than TP. If so then the control circuit goes to S23 and if not then control circuit 30 goes to S40.

At S40 control circuit 30 determines whether TW plus K (° C.) is smaller than TP. If so then the control circuit goes to S41 and if not then the control circuit goes to S30.

TP is a temperature set for an object to be heated, adapted to terminate a heating operation when the temperature is attained as the object to be heated is considered as having being sufficiently heated. K represents a constant of approximately five. That is, K° C. is approximately 5° C. If microwave oven 1 provides a heat-cooking process to reflect multiple cooking menus, K is set for each of the menus.

In the heat-cooking process of the present variation the process steps following S23 can be divided into three main blocks S23–S29, S30–S38, and S41–S46. Which block control circuit 30 is to execute depends on the magnitude of TW at the S22 and S40 decisions. Table 1 shows a relationship between TW and the blocks executed by control circuit 30.

TABLE 1

| | TP + K < TW (TP < TW − K) | TP − K ≦ TW ≦ TP + K (TW − K ≦ TP ≦ TW + K) | TP − K > TW (TP > TW + K) |
|---|---|---|---|
| Steps to be Executed | S23–S29 | S30–S38 | S41–S46 |

The S23–S29 steps will initially be described.

At S23 control circuit 30 sets a value of "1" on axis Y for a location at which is detected a temperature to be extracted at 24 to be subject to a decision. More specifically, at S23 control circuit 30 provides a setting to allow T(1) to be subject to a decision at S24.

Then at S24 control circuit 30 extracts a detected temperature T(Y) currently set to be subject to a decision and determines whether the temperature is lower than set temperature TP. If so then the control circuit goes to S25 and if not then the control circuit goes to S27. Note that a detected temperature subject to a decision at S24 is that obtained from those obtained at the immediately previously executed S21 or S29 step which is detected at a location set at the immediately previously executed S23 or S26 step.

At S25 control circuit 30 determines whether a position on axis Y currently set to be extracted as a subject for decision is no more than N−1. If so then the control circuit goes to S26. If not, i.e., if it has attained N then the control circuit goes to S28.

At S26 the control circuit increments the currently set location by one on axis Y to update it and the control circuit then returns to S24. More specifically, the control circuit continues to make the S24 decision until a position having a value "1" on axis Y attains a value of "N" on the axis.

At S28 control circuit 30 determines whether a predetermined period of time A in seconds has elapsed since $T_1$–$T_N$ were detected at the immediate previous S29 or S21, and if so then the control circuit goes to S29. At S29, temperature is detected at each of locations P(1) to P(N−1) and stored as new values T(1) to T(N−1) and the control circuit then goes to S23. Herein, temporal period A in seconds is a period for detecting T(1) to T(N−1). Note that if turntable 90 turns at a rate of B (bpm), time A in seconds and the rate of revolution preferably have a relationship represented by the following equation (6);

$$A=B/I \tag{6}$$

wherein I is an integer.

If expression (6) is established, T(1) to T(N−1) is detected I times whenever turntable 90 rotates once. More specifically, temperature is detected on turntable 90 at a position of a radius forming an angle of $^{360}/_{I}$ to each other.

If at S24 the control circuit determines that TY has attained TP then control circuit 30 at S27 determines whether TY is smaller than TW. If the control circuit determines that TY is no less than TW then the control circuit returns to S25. If the control circuit determines that TY is smaller than TW then the control circuit at S39 controls magnetron 12 to terminate the current heating operation and the control circuit returns.

In the above-described S23–S29 process, whenever time A in seconds elapses temperature is detected at locations P(1) to P(N−1) and stored as T(1) to T(N−1). If any of T(1) to T(N−1) has attained set temperature TP then the control circuit goes through S27 and terminates the current heating operation. Note that in this example T(N) is temperature detected at S21.

The S30–S38 process will now be described.

At S30 control circuit 30 sets a value of "1" on axis Y for a location of at which is detected a temperature subject to a decision to be made at S31 to be subsequently executed.

Then at S31 control circuit 30 extracts detected temperature (TY) currently set to be subject to a decision and control circuit 30 determines whether the temperature is lower than set temperature TP minus K, i.e., TW−K. If so then the control circuit goes to S32 and if not then the control circuit goes to S34. Note that detected temperature TY subject to a decision at S31 is that obtained from those obtained at the immediately previously executed S21 or S38 step. TW is T(N) detected at S21 which is detected at a location set at the immediately previously executed S30 or S33 step.

At S32 control circuit 30 determines whether a location on axis Y that is currently set to be extracted as a subject for a decision is no more than N−1. If so then the control circuit 30 goes to S33. If not then the control circuit goes to S37.

At S33 control circuit 30 increments the currently set location by one on axis Y to update it and the control circuit then goes back to S31. More specifically, the control circuit continues to make the S31 decision until a location having a value "1" on axis Y attains a value of "N" on the axis.

At S37 the control circuit determines whether a predetermined period of time A in seconds has elapsed since T(1) to T(N) were detected at the immediate previous S38 or S21 and if so then the control circuit goes to S38. At S38 temperature is detected at each of location P(1) to P(N−1) and stored new T(1) to T(N−1) and the control circuit goes back to S33. Herein, time A in seconds is similar to that as has been described in the S28 step, i.e., a period for detecting T(1) to T(N−1).

At S31 if control circuit 30 determines that TY has attained TW−K then control circuit 30 goes to S24 and determines whether TY is lower than TW. If TY is no less than TW then the control circuit goes back to S32 and if TY is lower than TW then the control circuit goes to S35.

At S35 control circuit 30 determines whether TP is lower than TW and if so then control circuit 30 at S39 controls magnetron 12 to terminate the current heating operation and the control circuit returns.

If at S35 it determines that TP is no less than TW then control circuit 30 at S36 controls magnetron 12 to provide a further heating operation from that time point for an additional temporal period corresponding to value K in the process of interest and the control circuit at S39 terminates the heating operation and returns. Note that, as has been described above, K is a value previously determined to correspond to a cooking menu. Thus at S36 a heating operation is additionally executed for a period of time corresponding to a cooking menu.

The S41–S46 process steps will now be described.

At S41 control circuit 30 sets a value of "1" on axis Y for a location at which is detected a temperature to be extracted to be subject to the subsequent S42 decision.

Then at S42 control circuit 30 extracts detected temperature (TY) currently set to be subject to a decision and the control circuit determines whether the temperature is lower than set temperature TP. If so then the control circuit goes to S43 and if not then the control circuit at S39 terminates the heating operation and returns.

Note that a detected temperature subject to the S42 decision is that obtained from those obtained at the immediately previously executed S21 or S46 step which is obtained at a location set at the immediately previously executed S41 or S44 step.

At S43 control circuit 30 determines whether a location on axis Y that is currently set to be extracted as a subject for a decision is no more than N−1. If so then the control circuit goes to S44. If not then the control circuit goes to S45.

At S44 control circuit 30 increments the currently set position by one on axis Y to update it and then goes back to S42. More specifically, the control circuit continues to make the S42 decision until a position having a value "1" on axis Y attains a value of "N" on the axis.

At S45 the control circuit determines whether a predetermined period of time A in seconds has elapsed since T(1) to T(N) were immediately previously detected at S46 or S21. If so then the control circuit goes to S46. At S46, temperature is detected for each of locations P(1) to P(N−1) and stored as new T(1) to T(N−1) and then goes back to S41. Herein, as has been described in the S28 step, time A in seconds is a period for detecting T(1) to T(N−1).

Thus in the present variation a heat-cooking process provides different blocks of steps to reflect value TW, as provided on Table 1. Note that in any of the blocks, temperature is detected whenever time A in seconds elapses. Time A in seconds, a period for temperature detection, and revolution rate B (bpm) are preferably have a relationship as represented by expression (6) provided above.

Note that in the present variation the S29 and S28 temperature detection are performed for locations P(1) to P(N−1) and it is omitted for location P(N), since on turntable 90 it is less likely that a food is placed at location P(N). Thus, temperature detection is omitted for location P(N) to maximally reduce the time required for a cooking process.

In the present variation microwave oven 1 includes infrared detection elements 7A having the fields of view 70A that cannot cover the entire bottom side of heating chamber 10 at a time even if all of the fields of view are combined together. However, the heating chamber 10 bottom side has turntable 90, which turns to allow substantially any area on turntable 90 to be covered by one of the fields of view 70A of the multiple infrared detection elements 7A.

As a further variation of microwave oven 1, a description will now be made of a microwave oven including heating chamber 10 having a bottom side provided with a turntable and having its area substantially entirely covered by the fields of view 70A of multiple infrared detection elements 7A at a time such that the chamber's bottom side has any portion thereof covered by one of the fields of view 70A of multiple infrared detection elements 7A.

7. Third Variation

Figure 18:
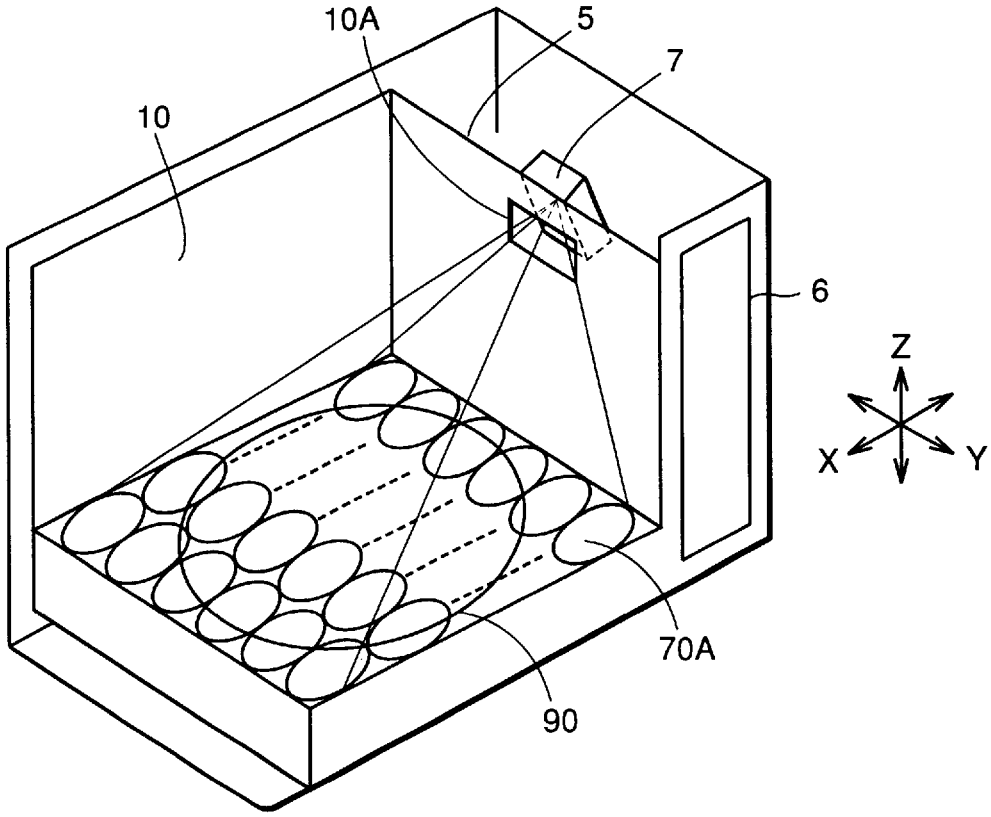
FIG. 18 shows a third variation of the FIG. 1 microwave oven.

In FIG. 18, infrared sensor 7 includes infrared detection elements 7A arranged in a M×N matrix in the directions of the depth and height of heating chamber 10, although not shown in the figure. In FIG. 18, as well as FIG. 9, microwave oven 1 is shown with various components omitted to allow heating chamber 10 to have its interior readily visually observed. In FIG. 18, heating chamber 10 has its width, depth and height defined to correspond to three axes X, Y and Z orthogonal to each other.

In the present variation, microwave oven 1 has heating chamber 10 having a bottom side provided with a round turntable 90. Accordingly, microwave oven 1 preferably has magnetron 12 supplying heating chamber 10 with micro wave at a side wall of heating chamber 10 and also has waveguide 19 and rotative antenna 5 attached to the side wall of heating chamber 10.

In the present variation there exist M infrared detection elements 7A in direction Y and N infrared detection elements 7A in direction Z. Accordingly, on the heating chamber 10 bottom side are projected M fields of view 70A (six of them in FIG. 18 by way of example) in direction Y and N fields of view 70A in direction X. Some of M×N fields of view 70A are projected on turntable 90 and the other thereof are projected outside turntable 90. Note that turntable 90 has any portion thereof covered by one of M×N fields of view 70A.

Figure 19:
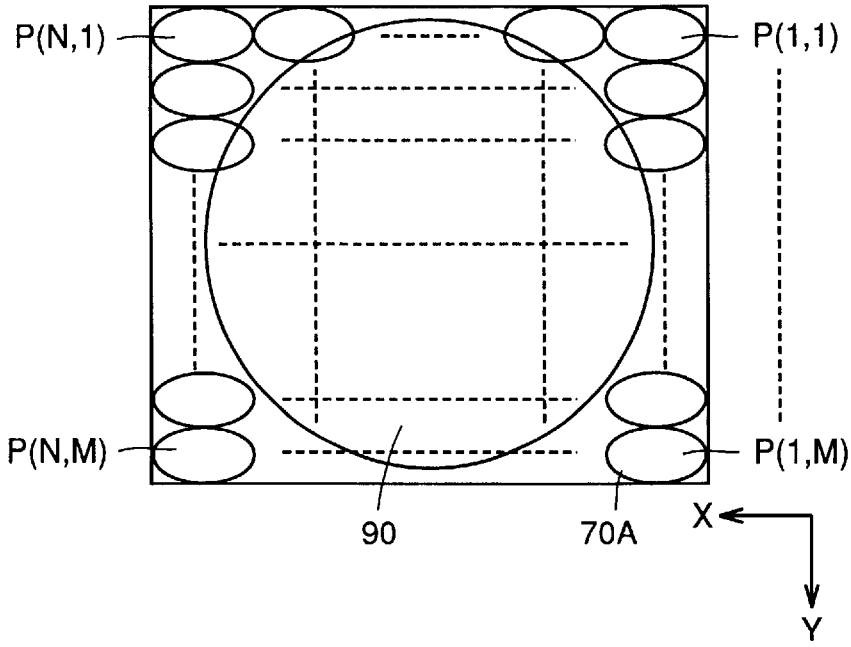
FIG. 19 schematically shows the third variation of the FIG. 1 microwave oven, illustrating a positional relationship between the field of view of the infrared detection element and the bottom plate.
Figure 20:
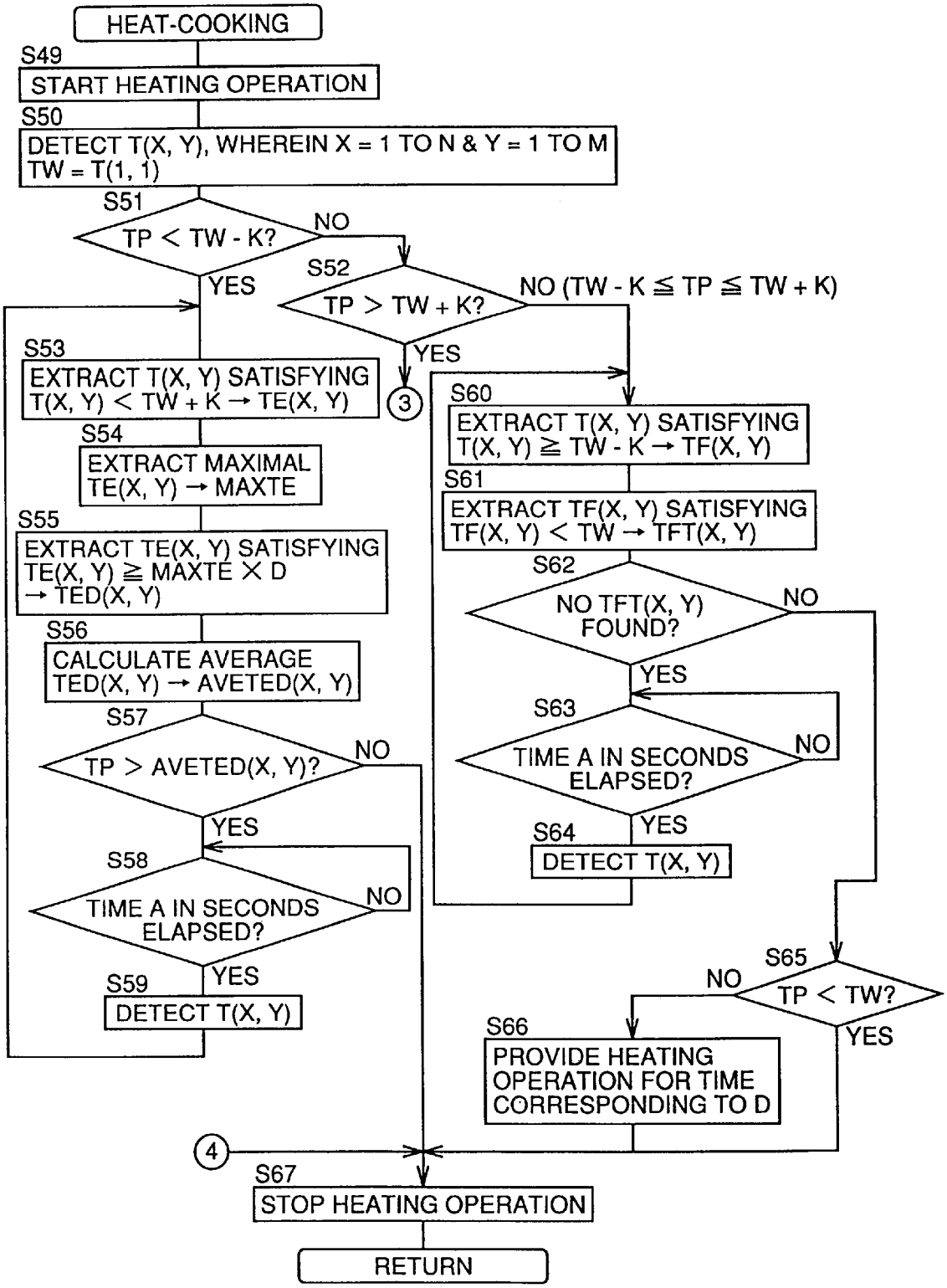
FIG. 20 is a flow chart of a heat-cooking process executed by a control circuit in the third variation of the FIG. 1 microwave oven.
Figure 21:
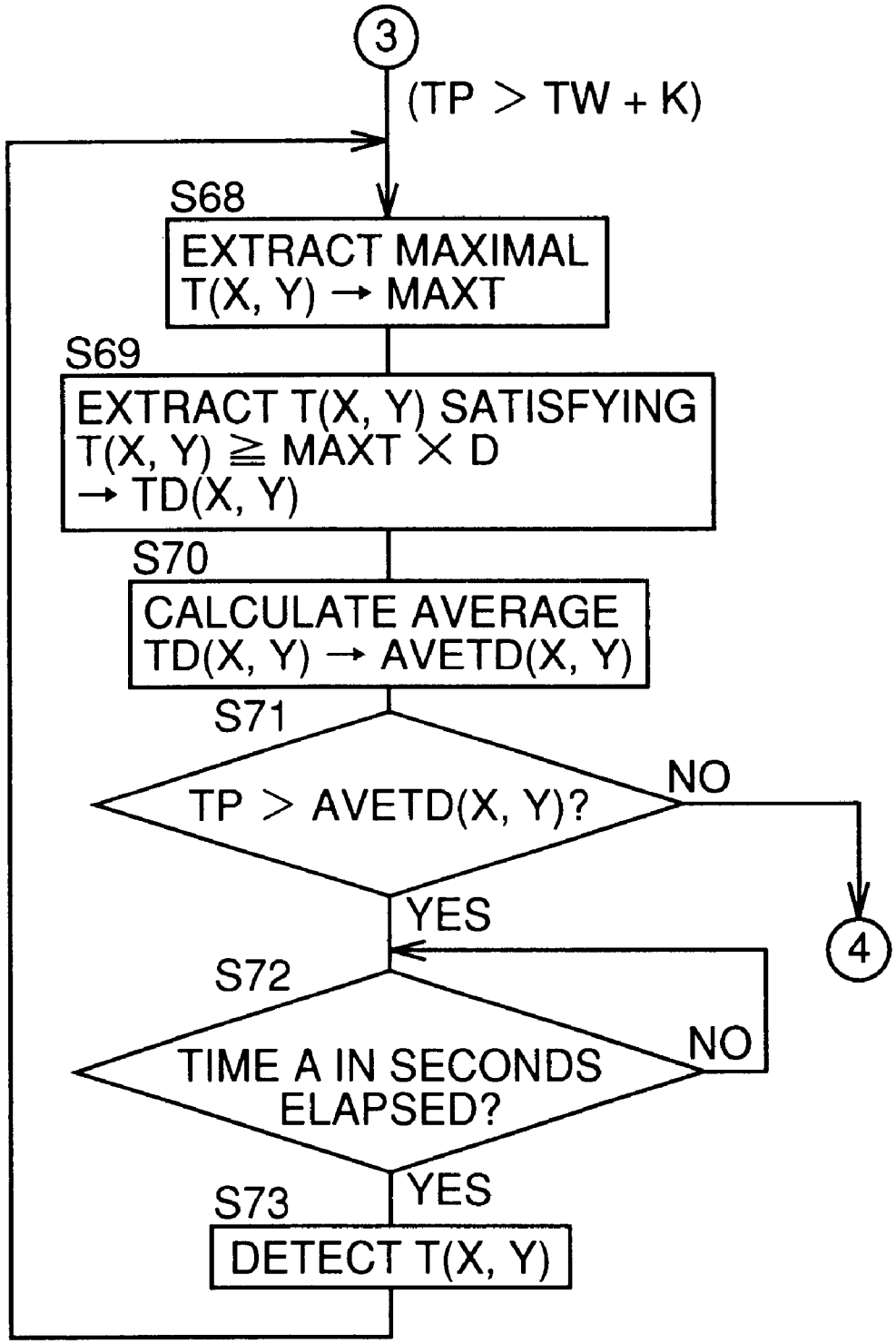
FIG. 21 is a flow chart of a heat-cooking process executed by the control circuit in the third variation of the FIG. 1 microwave oven.

Reference will now be made to FIGS. 19–21 to describe how in the present variation an output of each of M×N infrared detection elements 7A of infrared sensor 7 is used to provide a heat-cooking operation.

Note in the following description that if the field of view 70A has a position represented in the form of "P(X, Y)" then it can have a position represented by P(1, 1) to P(N, M). Note that P(1, 1) represents a deepest, rightmost position in heating chamber 10 (an upper right corner in FIG. 19), and P(N, M) corresponds to a front, leftmost corner in heating chamber 10 (a lower left corner in FIG. 19). Furthermore, in heating chamber 10 the field of view 70A closer to the left side as seen in direction X has a larger coordinate X and that closer to the front side (the lower side in FIG. 19) as seen in direction Y has a larger coordinate Y.

When operation panel 6 is operated to provide a heat-cooking operation, control circuit 30 initially at S49 controls magnetron 12 to start a heating operation.

Then at S50 control circuit 30 detects temperature based on outputs of infrared detection elements 70A having their respective fields of view 70A at positions P(1, 1) to P(N, M), respectively. Note that control circuit 30 associates M×N temperatures detected at S50 with positions P(1, 1) to P(N, M), respectively, and stores them as T(1, 1) to T(N, M). Furthermore, control circuit 30 also stores as TW a detected temperature T(1, 1) corresponding to position P(1, 1).

Then at S51 control circuit 30 determines whether TW minus K (° C.) is greater than TP and if so then the control circuit goes to S53 and if not then the control circuit goes to S52.

At S52 control circuit 30 determines whether TW plus K (° C.) is smaller than TP and if so then the control circuit goes to S68 and if not then the control circuit goes to S60.

TP is a temperature set for an object to be heated, adapted to terminate a heating operation when the temperature is attained as the object to be heated is considered as having been sufficiently heated. K is a constant of approximately five. That is, K° C. is approximately 5° C. If microwave oven 1 provides a heat-cooking operation to accommodate various cooking menus K is set for each cooking menu.

In the present variation the heat-cooking process follows the process steps following S53 that are divided generally into three blocks S53–S59, S60–S66, and S68–S73. Which block of steps control circuits 30 is to execute depends on the magnitude of TW at the S51 and S52 decisions. Table 2 represents a relationship between TW and the blocks executed by control circuit 30.

TABLE 2

| | TP + K < TW (TP < TW − K) | TP − K ≦ TW ≦ TP + K (TW − K ≦ TP ≦ TW + K) | TP − K > TW (TP > TW + K) |
|---|---|---|---|
| Steps to be Executed | S53–S59 | S60–S66 | S68–S73 |

The S53–S59 steps will initially be described.

At S53 control circuit 30 extracts any of T(X, Y), or T(1, 1) to T(N, M), detected at the immediately previously executed S50 or S59 step that is lower than TW plus K (° C.) and the control circuit provides it as TE(X, Y) and then goes to S54.

At S54 control circuit 30 extracts a maximal one of TE(X, Y)s extracted at S53 and stores it as MAXTE.

Then at S55 control circuit 30 extracts any of TE(X, Y)s that has a temperature no less than the product of MAXTE and a constant D and stores it has TED(X, Y). Note that D represents a constant previously determined for each cooking menu and satisfying 0>D>1.

Then at S56 control circuit 30 calculates an average of TED(X, Y)s extracted at S55 and stores it as AVETED(X, Y).

Then at S57 control circuit 30 determines whether AVETED(X, Y) calculated at S56 is lower than TP and if so then the control circuit goes to S58 and if not then the control circuit at S67 controls magnetron 12 to terminate the heating operation and returns.

At S58 control circuit 30 determines whether time A in seconds has elapsed since T(X, Y) was detected at the immediately previously executed S59 or S50 step and if so then the control circuit goes to S59. At S59, temperature is detected for each of positions P(1, 1) to P(N, M) and stored as new T(1, 1) to T(N, M) and then the control circuit returns to S53. Herein, time A in seconds correspond to a period for detecting T(1, 1) to T(N, M). Note that if turntable 90 has a revolution rate of B (bpm), time A in seconds and the revolution rate preferably have a relationship represented by the following expression (7):

$$A=B/I \tag{7}$$

wherein I is an integer.

If expression (7) is established, T(1, 1) to T(N, M) is detected I times whenever turntable 9 turns once. More specifically, temperature is detected on turntable 90 at a location of a radius forming an angle of $^{360}/_{I}$ to each other.

The S60–S66 steps will now be described.

At S60 control circuit 30 extracts any of T(X, Y), or T (1, 1) to T(N, M), detected at the immediately previously executed S50 or S64 step that is no less than TW minus K (° C.) and the control circuit provides it as TF(X, Y).

Then at S61 control circuit 30 extracts any of TE(X, Y) extracted at S60 that is lower than TW and the control circuit stores it as TFT(X, Y).

Then at S62 control circuit 30 determines whether there is no TFT(X, Y) extracted at S61 and if so then the control circuit goes to S63 and if not then the control circuit goes to S65.

At S63 control circuit 30 determines whether a predetermined temporal period A in seconds has elapsed since T(X, Y) was detected at the immediately previously executed S64 or S50 step and if so then the control circuit goes to S64. At S64 temperature is detected for each of positions P(1, 1) to P(N, M) and stored as new T(1, 1) to T(N, M) and the control circuit then goes back to S60. Herein, time A in seconds correspond to a period for detecting T(1, 1) to T(N, M), as has been described in the S58 step.

At S65 control circuit 30 determines whether TP is lower than TW and if so then the control circuit at S67 controls magnetron 12 to terminate the heating operation and then returns.

In contrast, if control circuit 30 at S65 determines that TP is greater than TW then control circuit 30 at S66 controls magnetron 12 to provide an additional heating operation from that time for an additional temporal period corresponding to value D in the process of interest and the control circuit then at S39 terminates the heating operation and returns. Note that, as has been described above, D represents a value previously determined to correspond to a cooking menu. Thus at S66 an additional heating operation is executed for a temporal period corresponding to a cooking menu.

The S68–S73 steps will now be described.

At S68 control circuit 30 extracts a maximal one of T(X, Y), or T(1, 1) to T(N, M), detected at the immediately previously executed S50 or S59 step and provides it as MAXT.

Then at S69 control circuit 30 extracts any of T (X, Y)s detected at the immediately previously executed S50 or S69 that has a value exceeding the product of MAXT and constant D, and control circuit 30 stores it as TD(X, Y). Note that D represents a constant previously determined for each cooking menu, as has been described in S55.

Then at S70 control circuit 30 calculates an average of TD(X, Y)s extracted at S69 and stores it as AVETD(X, Y).

Then at S71 control circuit 30 determines whether AVETD(X, Y) calculated at S70 is higher than TP and if so the control circuit goes to S72 and if not then the control circuit at S67 controls magnetron 12 to terminate the heating operation and the control circuit returns.

At S72 the control circuit determines whether a predetermined temporal period A in seconds has elapsed since T(X, Y) was detected at the immediately previously executed S73 or S50 step and if so then the control circuit goes to S73. At S73, temperature is detected for each of positions P(1, 1) to P(N, M) and stored as new T(1, 1) to T(N, M) and the control circuit then returns to S68. Time A in seconds is a period for detecting T(1, 1) to T(N, M).

In the present variation, a heat-cooking process provides different blocks of steps to reflect value TW, as has been provided in Table 2. Note that in any block, temperature is detected whenever time A in seconds elapses. The temperature detection period of A in seconds and revolution rate B (bpm) preferably have a relationship as represented by equation (7) provided above.

8. Fourth Variation

Figure 22:
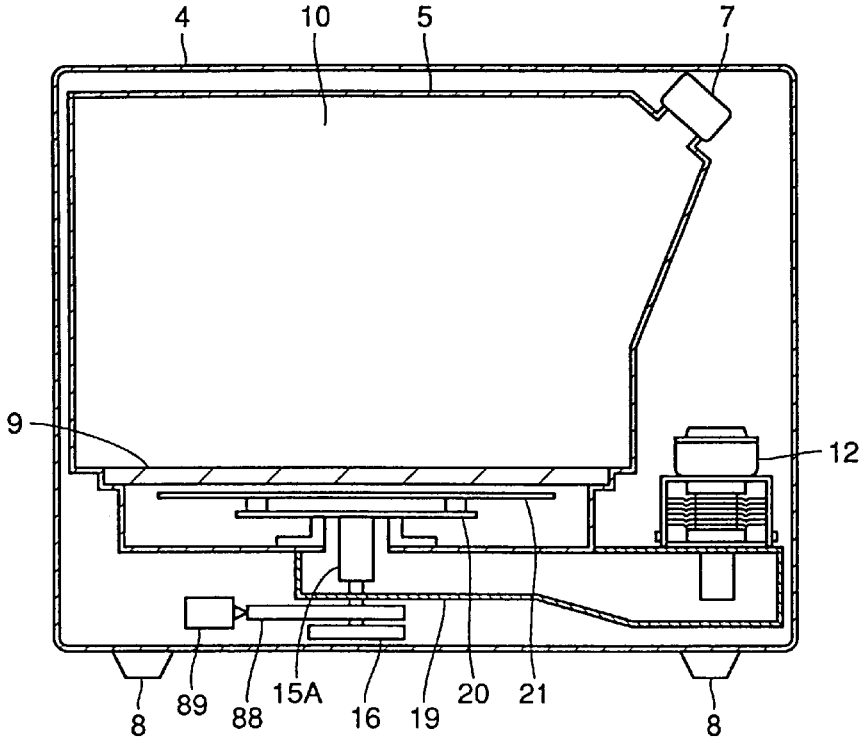
FIG. 22 is a vertical cross section of the microwave oven in a fourth variation of the present invention.

FIG. 22 is a partial cross section of a microwave oven corresponding to FIG. 4.

With reference to FIG. 22, the present variation provides a microwave oven having heating chamber 10 overlying a rotative antenna 20 rather than rotative antenna 15.

Figure 23:
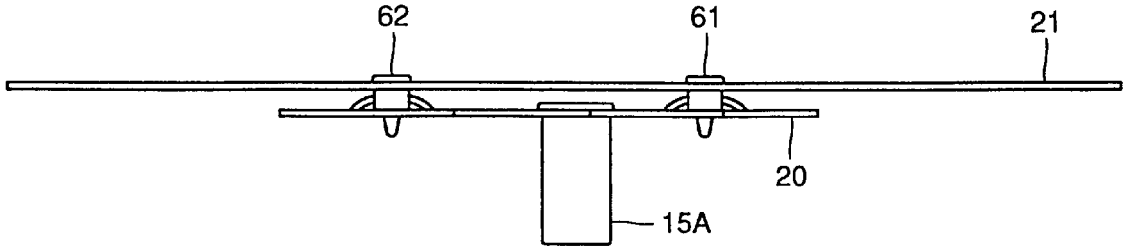
FIG. 23 is a side view in a vicinity of the FIG. 22 rotative antenna and subantenna.

Furthermore, a subantenna 21 is attached to rotative antenna 20. Furthermore, with reference to FIG. 23, rotative antenna 20 and subantenna 21 are each provided in the form of a plate. Subantenna 21 is attached to rotative antenna 20 by an insulator 61, 62. That is, rotative antenna 20 and subantenna 21 are insulated from each other. Note that rotative antenna 21 is attached to spindle 15A. at the top end Below rotative antenna 20 is attached a switch 89 switched on once whenever spindle 15A revolves once. The revolution of spindle 15A is transferred to switch 89 via a well known mechanism provided in a box 88.

Figure 24:
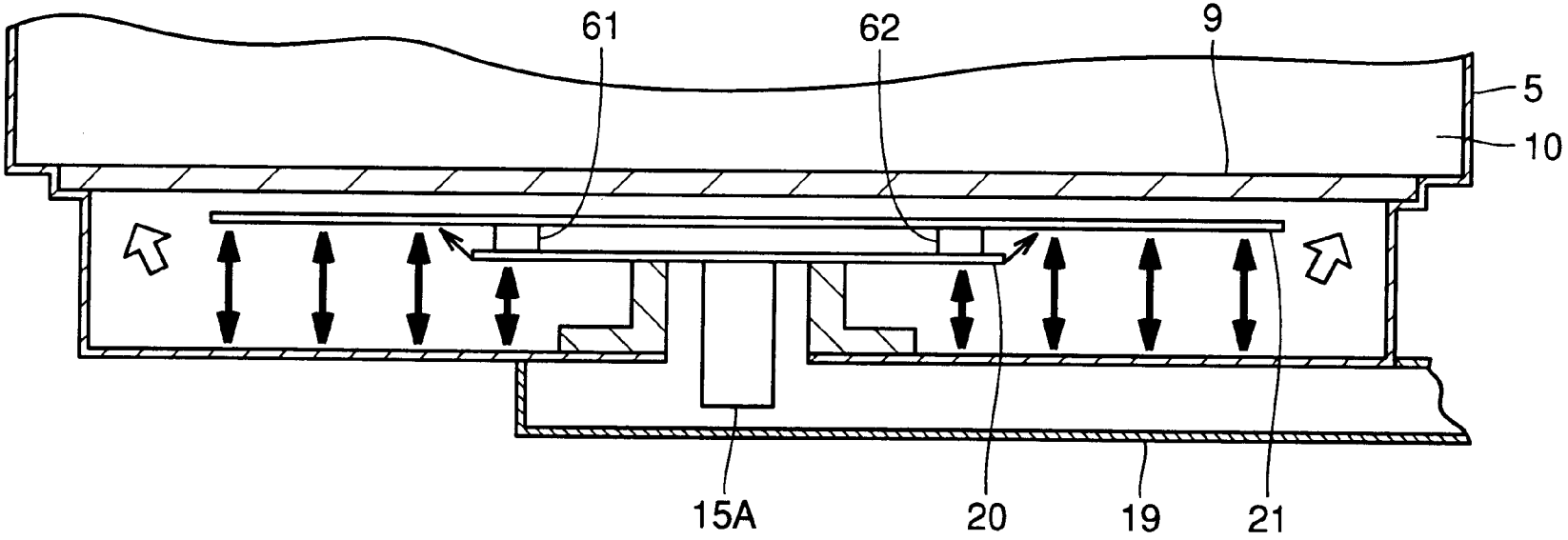
FIG. 24 is an enlarged view below the FIG. 22 heating chamber.

In FIGS. 24 and 25, a thin arrow and a white arrow each represent a microwave radiation pattern and a thick, two-head arrow represents a pattern in which an electrical field is generated. In the microwave oven of the present variation, a microwave guided from magnetron 12 via waveguide 19 is transmitted through rotative antenna 20 and radiated therefrom at a perimeter (as indicated in FIGS. 24 and 25 by thin arrows) and also transmitted between a periphery of rotative antenna 20 and a bottom side of body frame 5 and between subantenna 21 and a bottom side of body frame 5 (as indicated in FIGS. 24 and 25 by thick, two-head arrows) and thus radiated in a vicinity of a periphery of subantenna 21 (as indicated in FIGS. 24 and 25 by white arrows).

To efficiently radiate a microwave from a periphery of rotative antenna 20, the distance from the top end of spindle 15A to the peripheral edge of rotative antenna 20 is preferably set to be one half of the wavelength of the microwave or that plus the wavelength of the microwave that is multiplied by an integer, since rotative antenna 20 thus dimensioned can peripherally have an electrical field having an intensity of a maximal value or a value closer thereto.

When a microwave spreads in rotative antenna 20 a transmission loss is introduced, whereas when it is transmitted between subantenna 21 and a bottom side of body frame 5 such a transmission loss is hardly introduced. As such, subantenna 21 can be formed to correspond to the geometry of hating chamber 10 receiving microwave radiation.

Subantenna 21 is provided with a plurality of holes, as will be described hereinafter, and FIG. 25 shows that an electronic wave propagates through a hole of subantenna 21. An electronic wave transmitted from waveguide 19 is in turn transmitted via spindle 15A to the center of rotative antenna 20 and therefrom toward an edge of rotative antenna 20. Some of the electronic wave transmitted to the edge of rotative antenna 20 is supplied directly into heating chamber 10 and the other thereof is transmitted to subantenna 21. Some of the electronic wave transmitted to subantenna 21 is supplied from an edge of subantenna 21 to heating chamber 10 and the other thereof is supplied from an edge of a hole 8(holes 21A to 21F described hereinafter) to heating chamber 10.

Figure 26:
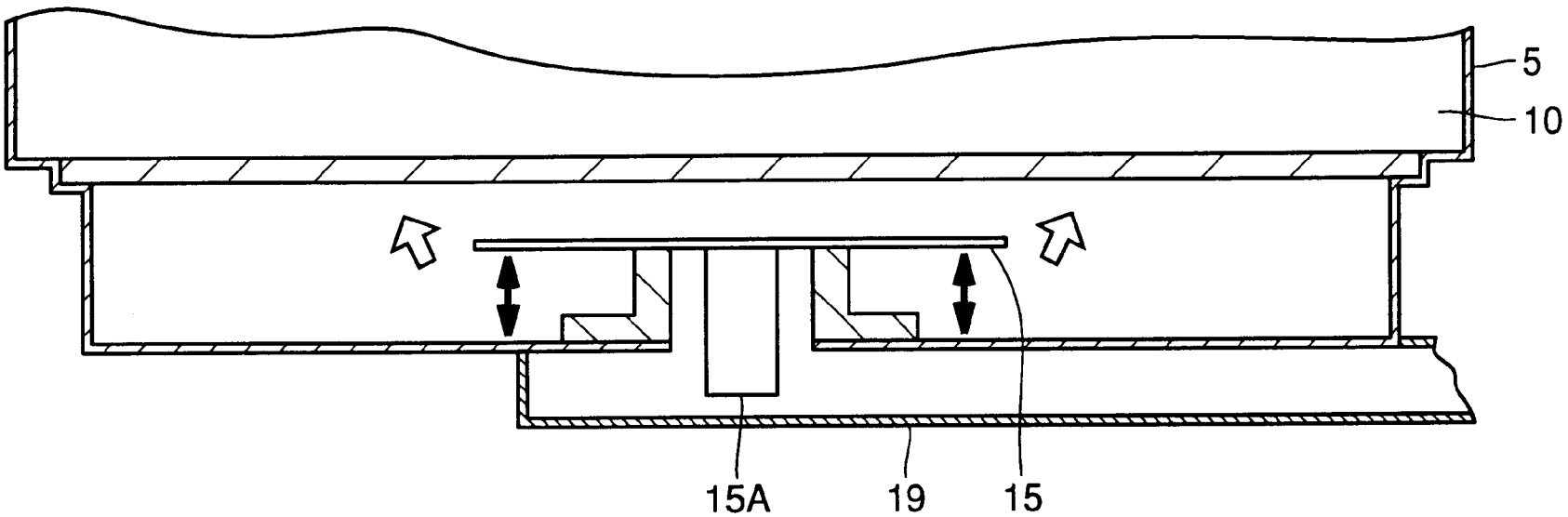
FIG. 26 is an enlarged view below the FIG. 4 heating chamber.
Figure 27:
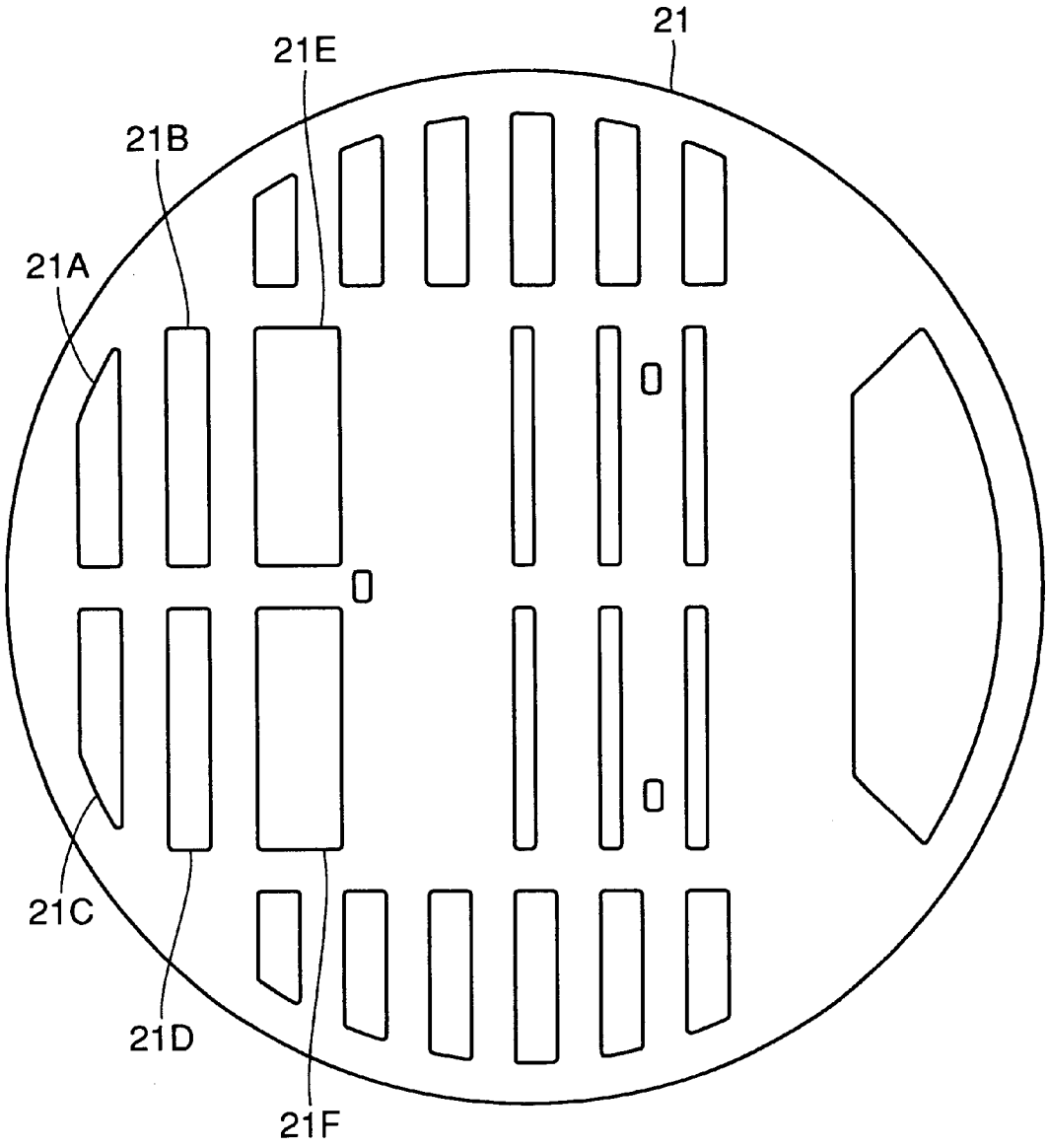
FIG. 27 is a plan view of a subantenna of the FIG. 22 microwave oven.
Figure 29A:
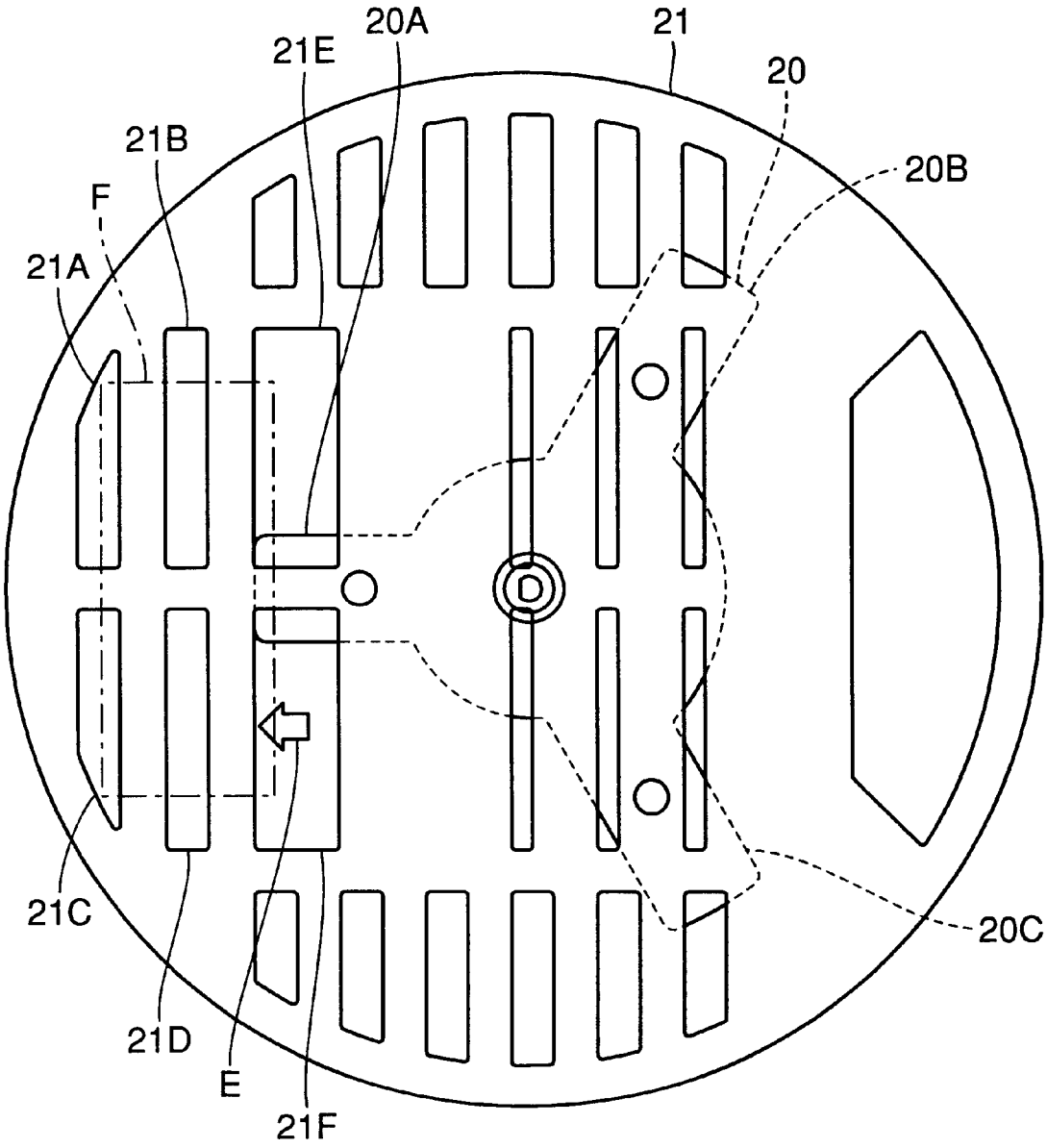
FIG. 29A is a plan view of the FIG. 22 subantenna and rotative antenna overlapping each other.

As can be understood from FIG. 29, in the present variation rotative antenna 20 is generally covered by subantenna 21. More specifically, subantenna 21 has a periphery outer than rotative antenna 20, Thus, subantenna 21 exists closer to heating chamber 10 than rotative antenna 21 and, as seen in a plane parallel to that opposite to heating chamber 10, has a large geometrical dimension and also exists over a large area. This can supply heating chamber 10 with a microwave over an area larger than when there is only rotative antenna 20. Reference will now be made to FIG. 26 to describe further in detail an effect of providing such a subantenna 21.

If under heating chamber 10 subantenna 21 is not provided and rotative antenna 15 is only provided then rotative antenna 15 has a periphery radiating a microwave toward heating chamber 10 only in a vicinity of the center.

In contrast, if rotative antenna 20 and subantenna 21 are both provided, as shown in FIGS. 24 and 25, then not only does rotative antenna 20 have a periphery radiating a microwave toward heating chamber 10 in a vicinity of the bottom center but subantenna 21 also has a periphery radiating a microwave toward heating chamber 10 in a vicinity of the corner.

With reference to FIGS. 27–29A, subantenna 21 is provided with a plurality of holes including holes 21A to 21F. Thus subantenna 21 having received an electronic wave from rotative antenna 20 can radiate a microwave not only from an outer peripheral edge but from the holes.

Since subantenna 21 is fixed to rotative antenna 20, it can revolve in the same period as rotative antenna 20. As such, subantenna 21 can supply heating chamber 10 with a microwave in a pattern that varies as subantenna 21 rotates. More specifically, rotating subantenna 21 allows heating chamber 10 to be supplied with a microwave in a more complicated pattern, i.e., uniformly.

Figure 28:
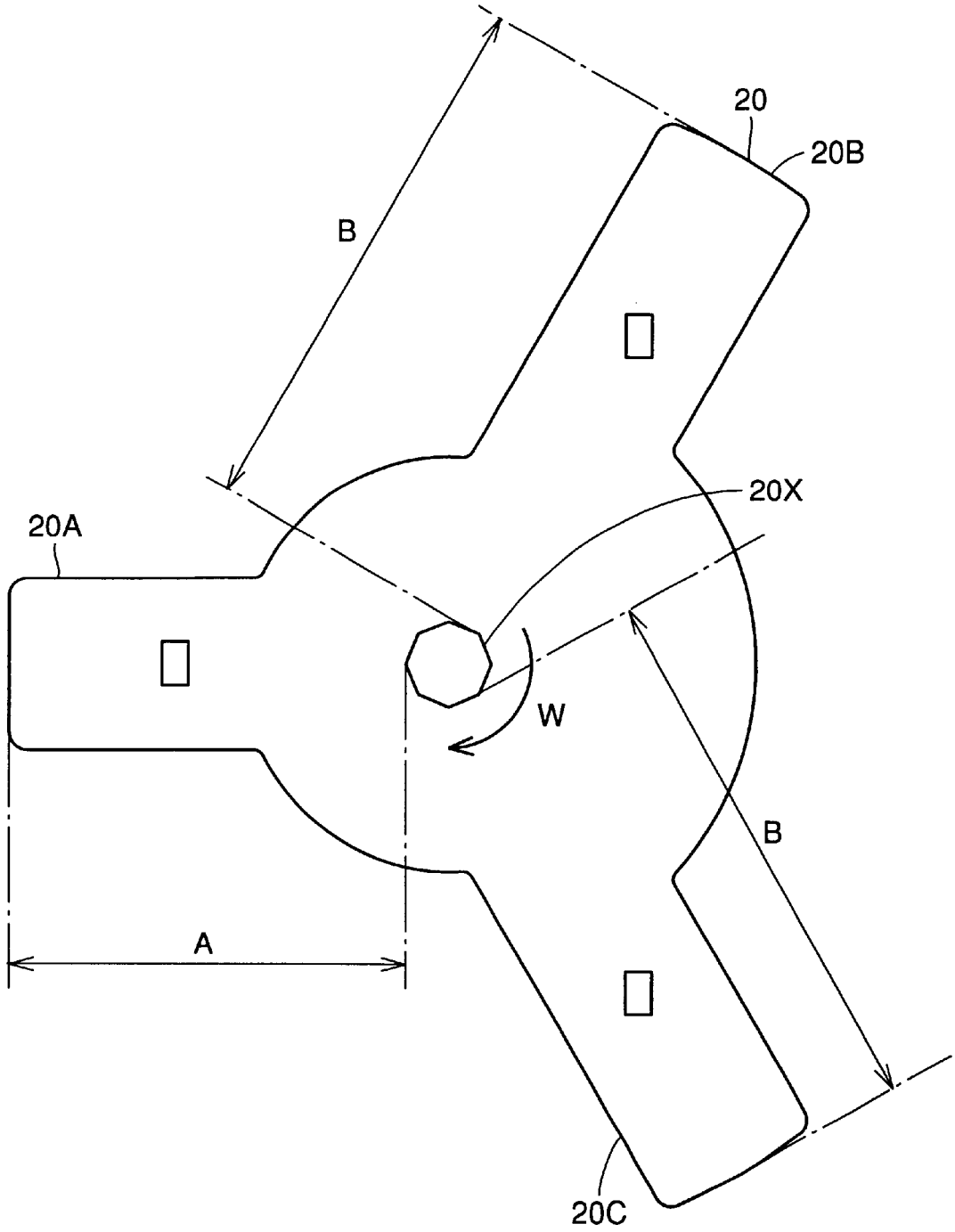
FIG. 28 is a plan view of a rotative antenna of the FIG. 22 microwave oven.

Rotative antenna 20, as shown in FIG. 28, has a center provided with a hole 20X to be connected to spindle 15A. Furthermore, rotative antenna 20 also has portions 20A to 20C extending from hole 20X radially. In a vicinity of hole 20X, rotative antenna 20 has an accurate periphery. Portion 20A has an end spaced from hole 20X by a distance A of approximately 60 mm and portions 20B and 20C each have an end spaced from hole 20X by a distance D of approximately 80 mm. Distance A corresponds to approximately one half in length of the wavelength of a microwave.

An end of rotative antenna 20 radiates a microwave having an intensity depending on that of an electrical field generated at the edge. The intensity of the electrical field depends on the distance from a magnetron antenna of magnetron 12 to spindle 15A, the distance from an end of spindle 15A to a peripheral edge of rotative antenna 20, the relationship between the length and geometry of waveguide 19 and the wavelength of a microwave radiated, and the like. For rotative antenna 20 of the present variation, the portion 20*a* edge radiates a microwave more intense than the portions 20B and 20C edges. In other words, a waveguide is typically designed to intensify an electrical field generated in a vicinity of a power feed port of the waveguide, i.e., in a vicinity of spindle 15A. As such, if the length from a vertex of spindle 15A to an edge of rotative antenna 20 is dimensioned close to one fourth of the wavelength of a microwave that is multiplied by an even number, then the edge has a more intense electrical field. If the length is dimensioned closer to one fourth of the wavelength of a microwave that is multiplied by an odd number, then the edge has a weak electrical field.

In the present variation, subantenna 21 in a vicinity of portion 20A has holes 21A–21E in the form of a slit having its longitudinal direction perpendicular to a main direction in which a microwave propagates (as indicated by an arrow E in FIG. 20A). Holes 21A to 21F allow an intense microwave to be radiated. Holes 21B, 21D, 21E and 21F allow a significantly intense microwave to be radiated. To allow holes 21B, 21D, 21E and 21F to efficiently radiate a microwave, these holes has a longitudinal dimension set to be approximately 55 mm to 60 mm.

Figure 29B:
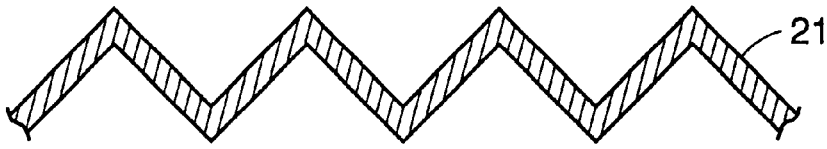
FIG. 29B is a partial cross section of the subantenna of FIG. 22 microwave oven.

In the present variation, rotative antenna 20 and subantenna 21 are stopped to position holes 21A to 21F in heating chamber 10 closer to door 3. Thus, if the microwave oven is operated with these antennas stopped, placing a food in heating chamber 10 closer to the front side allows the food to receive an intensive microwave and thus be heated efficiently. Preferably, bottom plate 9 is for example transparent to allow subantenna 21 to be visible in heating chamber 10 and such is displayed in a vicinity of an area having holes 21A to 21F formed therein (an area F in FIG. 29A), for example by using characters, such as "power zone", to indicate that in that in the zone a food is intensively heated, or by corrugating a surface of the area, i.e., having a cross section as shown in FIG. 29B.

Note that rotative antenna 20 is attached to spindle 15A at the top end that is crimped polygonal rather than round as seen in cross section. Furthermore, as shown in FIG. 28, hole 20X has a cross section in the form of an octagon. Axis 15A crimped to be polygonal as seen in cross section can prevent rotative antenna 20 from sliding relative to spindle 15A when spindle 15A is rotated to rotate rotative antenna 20 in a direction W. In other words, controlling an angle at which spindle 15A rotates reliably controls an angle at which rotative antenna 20 rotates.

In the present variation as described above, rotative antenna 20 is provided with subantenna 21 insulated therefrom and rotative antenna 20 also configures a radiation antenna.

While in the present variation as described above rotative antenna 20 and subantenna 21 are combined together, an effect similar to that achieved by such a combination may be obtained simply by changing a dimension of rotative antenna 20.

Simply changing rotative antenna 20 in dimension, however, imposes limitations on designing the heating chamber for example because: (1) a microwave is mostly radiated from rotative antenna 20 at an edge; (2) as rotative antenna 20 increases in dimension, microwave transmission loss also increases; and (3) to allow rotative antenna 20 to radiate a microwave efficiently, the antenna is required to have a dimension in relation to the wavelength of the microwave and the heating chamber thus cannot be sized as desired (for example, to allow the rotative antenna 20 edge to radiate a microwave with a maximal output, the length from spindle 15A to the rotative antenna 20 edge is required to be closer to one fourth of the wavelength of the microwave that is multiplied by an even number.

In this regard, subantenna 21 only functions to a periphery of subantenna 21 a portion of a microwave radiated from rotative antenna 20 and its dimension does not contribute to transmission loss. Thus, subantenna 21 can be dimensioned as desired regardless of microwave radiation efficiency.

That is, rotative antenna 20 can be designed with a most efficient dimension and its edge can radiate a microwave and a portion of the radiated microwave can also be guided through subantenna 21, dimensioned as desired, to a periphery thereof and thus radiated therefrom. As such, subantenna 21 is only required to have a dimension to consider the size of the heating chamber, which allows the heating chamber to be sized as desired.

Furthermore, since the heating chamber can receive a microwave radiated in a vicinity of an edge of rotative antenna 20 and a periphery of subantenna 21, rotating rotative antenna 20 and subantenna 21 can supply the heating chamber with a microwave radiated more uniformly.

9. Fifth Variation

Figure 30:
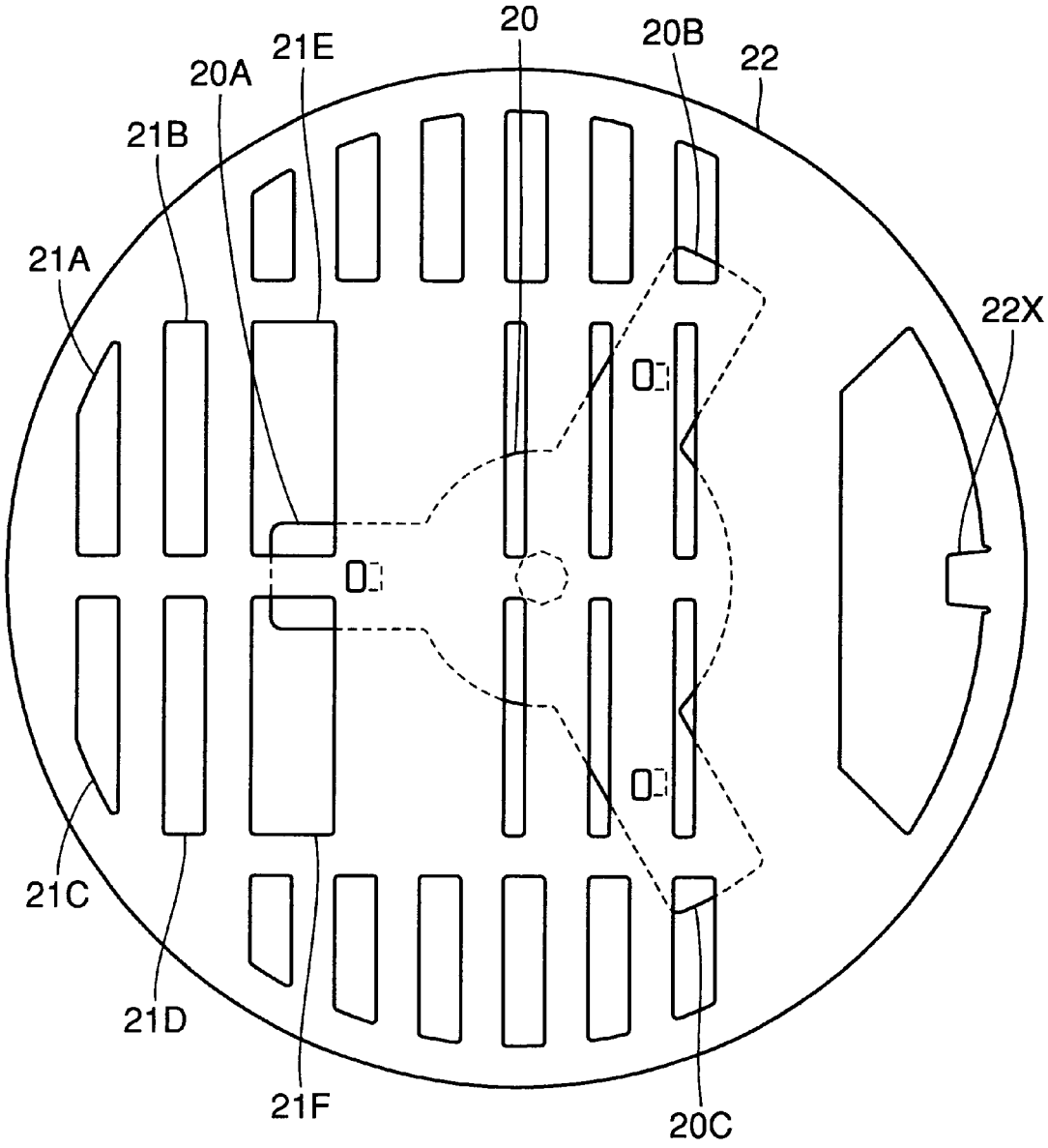
FIG. 30 is a plan view of a subantenna of a fifth variation of the present invention.
Figure 31:
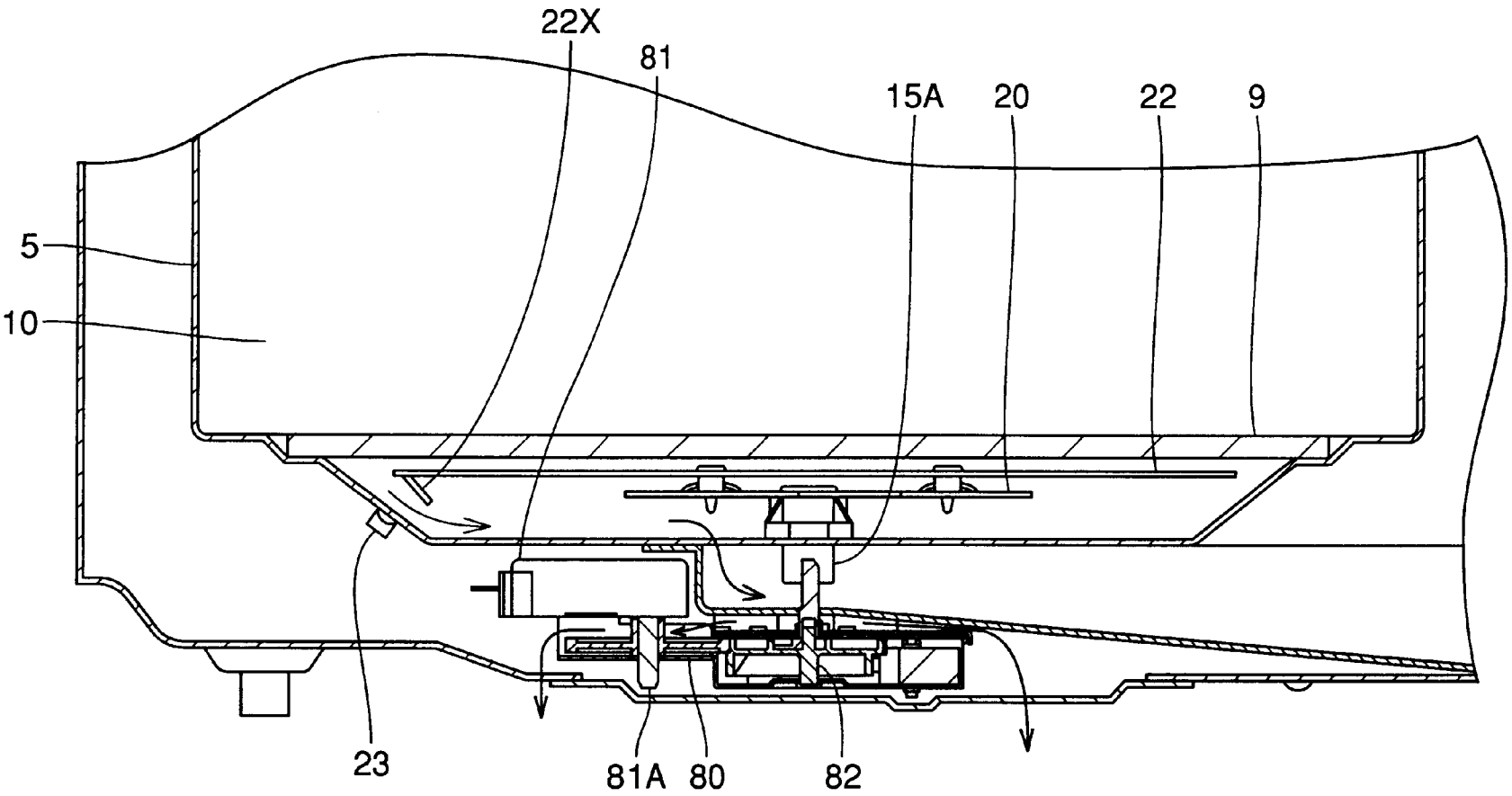
FIG. 31 is a vertical, partial cross section of a microwave oven of the fifth variation of the present invention.
Figure 32:
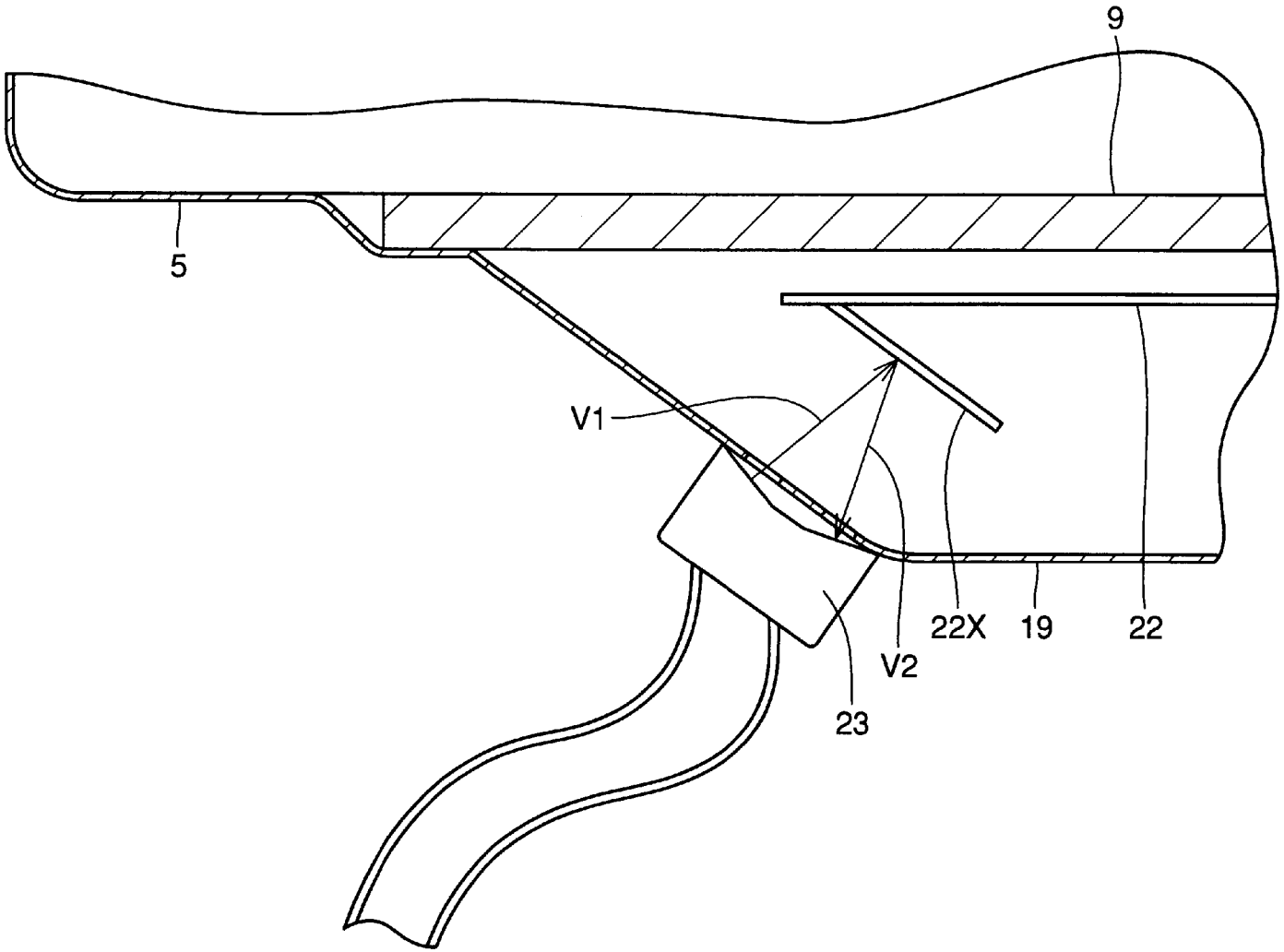
FIG. 32 is a cross section in a vicinity of an optical sensor of the FIG. 31 microwave oven.

With reference to FIGS. 30–32, in the present variation subantenna 22 is subantenna 21 of the fourth variation plus a reflector 22X.

In the present variation a microwave oven includes an optical sensor 23 attached under body frame 5.

Optical sensor 23 includes a light directing element and a light receiving element. The light directing element radiates light as indicated by an arrow V1 at intervals of a predetermined temporal period. Rotative antenna 20 and subantenna 22 fixed to rotative antenna 20 are rotated by driving a motor 81. When subantenna 22 that rotates has a position matching that allowing reflector 22X to face optical sensor 23, the sensor's light receiving element detects a reflection of light V1 that is provided by reflector 22X, as indicated by an arrow V2. From the detection of light V2 by optical sensor 23 is derived that rotative antenna 20 and subantenna 22 have a predetermined position as they rotate. Furthermore, detecting a timing as counted from the time point when optical sensor 23 detects light V2, allows detecting the position of rotative antenna 20 and subantenna 22 as they rotate.

Thus, switch 89 as described in the fourth variation can be dispensed with and rotative antenna 20 and subantenna 22 can have their conditions directly detected as they rotate.

Furthermore in the present variation motor 81 provided to rotate spindle 15A connected to rotative antenna 20 is attached at a (left) side of spindle 15*a*, rather than under the spindle.

Figure 33:
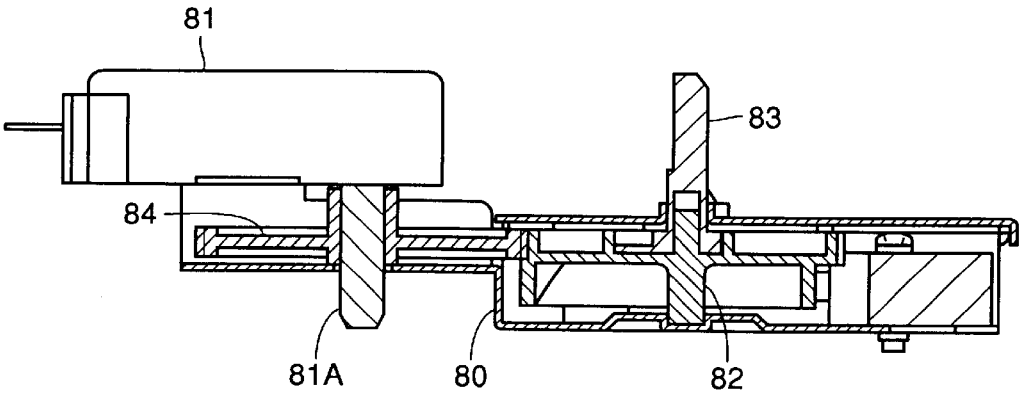
FIG. 33 is a vertical cross section in a vicinity of a motor of the FIG. 31 microwave oven.

With reference to FIG. 33, motor 81 has a spindle 81A which is in turn connected to a cam 84. The cam 84 rotation is transferred to a cam 82 and the cam 82 rotation is transferred to a spindle 83 and the spindle 83 rotation is transferred to spindle 15A (see FIG. 31). In other words, when motor 81 is driven, spindle 81A rotates and its rotation is transferred via cams 84 and 82 and spindle 83 to spindle 15A.

In the present variation, motor 81 is arranged at a side of spindle 15A. Thus motor 81 has a position that does not overlap a passage of food juice dropping from heating chamber 10 that is expected under heating chamber 10, as indicated in FIG. 31 by arrows. Thus if food juice dropping in heating chamber 10 should move downward to under heating chamber 10 and long spindle 15A, it cannot reach motor 81.

10. Sixth Variation

Figure 34:
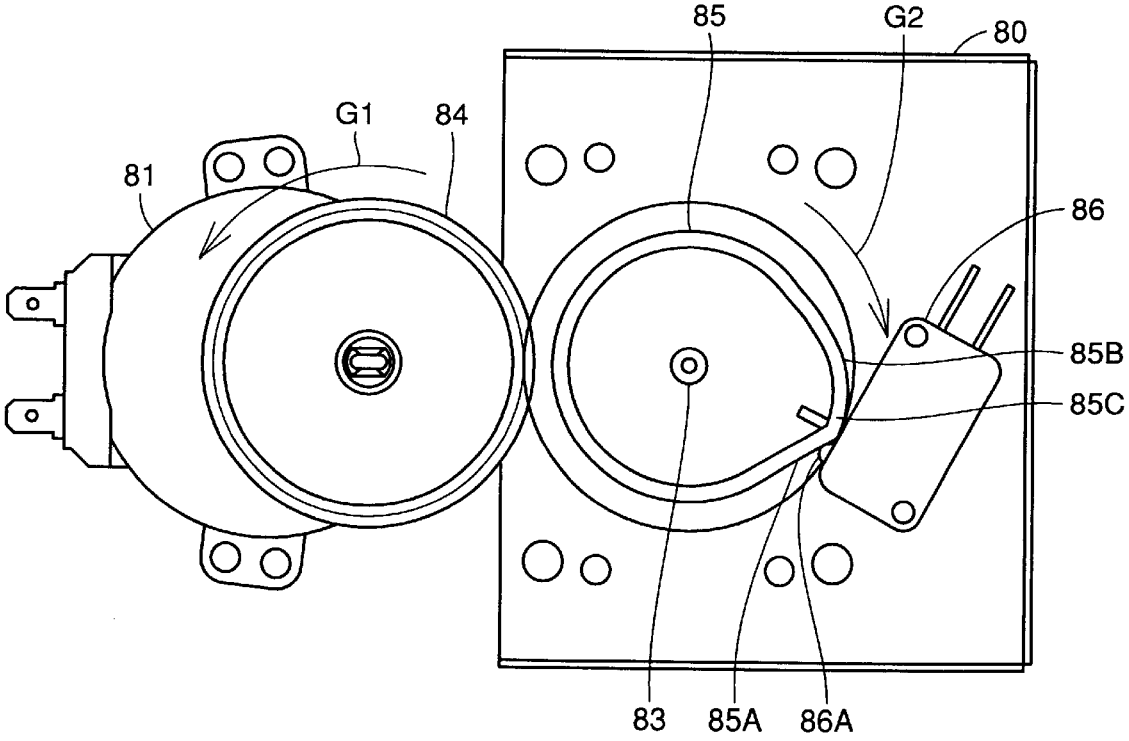
FIG. 34 is a bottom side view in a vicinity of a motor of a microwave oven of a sixth embodiment of the present invention.
Figure 35:
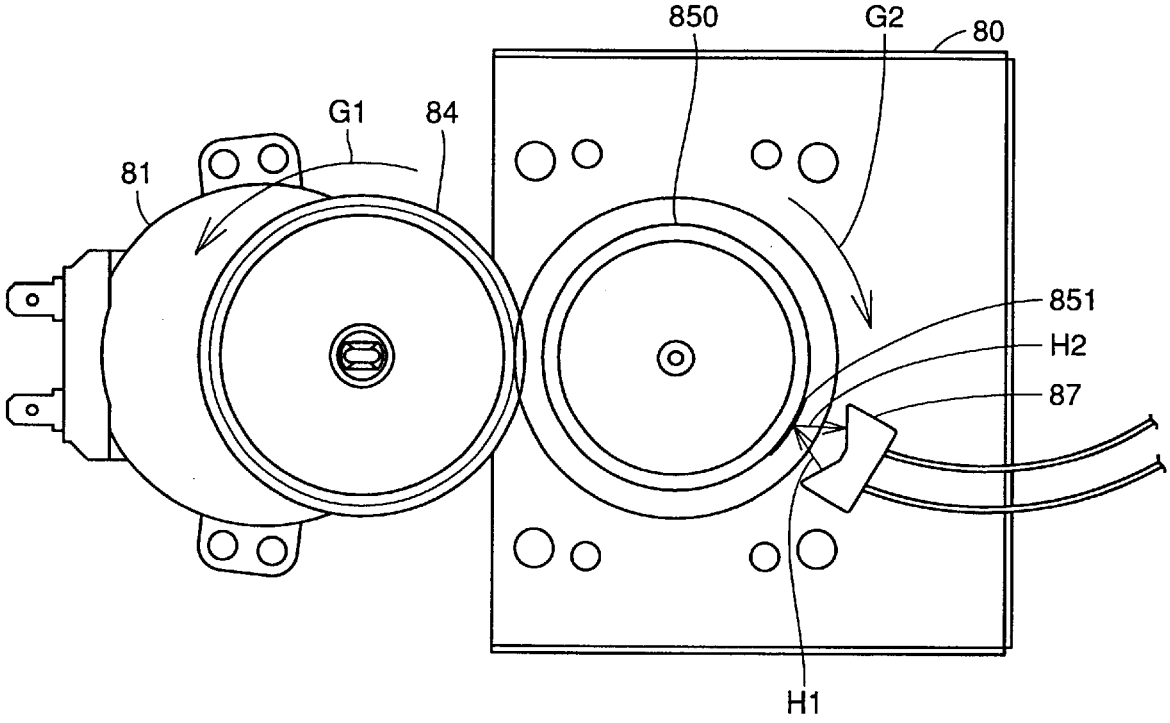
FIG. 35 is a bottom side view in a vicinity of a motor of a microwave oven of a seventh variation of the present invention.

With reference to FIG. 34, the present variation provides a microwave oven corresponding to that of the fifth variation with cam 82 (see FIGS. 31 and 33) replaced by a came 85 having a periphery close to a switch 86 having a switch button 86*a* pressed to switch a predetermined circuit on/off.

In the fifth variation, reflector 22X is employed to detect the conditions of subantenna 22 and rotative antenna 20 as they rotate. In the present variation, in contrast, the condition of cam 85 as it rotates is detected to detect the conditions of subantenna 22 and rotative antenna 20 as they rotate.

The condition of cam 85 as it rotates is detected, as will now be described.

In FIG. 34, G1 denotes a direction in which cam 84 rotates, and G2 denotes that in which cam 85 rotates. Cam 85 is basically round in geometry, although it has a protrusion 85C. Protrusion 85C is adjacent in the direction of rotation to a portion 85A, which suddenly reduces in distance, as measured from the center (spindle 83), as it moves farther away from portion 85C. Portion 85C is also adjacent in the opposite direction of rotation to portion 85B, which reduces in distance, as measured from the center (spindle 83), more gradually than portion 85A. If cam 85 having such a peripheral geometry rotates in a direction G2, it can quickly press switch pattern 86A with portion 85A and gradually release it with portion 85B.

Thus in the microwave oven of the present variation the condition of cam 85 as it rotates can be detected by switch 86 to detect those of rotative antenna 20 and subantenna 22 as they rotate. In doing so, switch button 86A is quickly pressed and gradually released. Thus switch 86 can quickly respond to the condition of rotating cam 85 and switch button 86A can also be free from rough operation.

Furthermore, in the present variation, rotating rotative antenna 20 and subantenna 22 are controlled to stop at a specific position after magnetron 12 has stopped its heating operation. More specifically, these antennas' rotation is stopped when two seconds have elapsed after switch button 86A that is pressed is released following magnetron 12 having stopped its heating operation, when holes 21A to 21F of subantenna 22 are positioned closer to the front side of heating chamber 10 than the remainder of subantenna 22. Note that holes 21A to 21F of subantenna 22 are, as well as those of subantenna 21 described for example with reference to FIG. 29, are formed in the antenna at a location allowing a relatively intensive microwave radiation. More specifically in the microwave oven of the present variation when magnetron 12 stops its heating operation heating chamber 10 can have its internal front side heated intensively. Note that the heating chamber's internal front side is the door 3 side, a location readily accessible by a user to place a food. Thus in the microwave oven of the present variation when magnetron 12 starts a heating operation heating chamber 10 can have a portion readily accessible to place a food that is initially, intensively heated.

Furthermore in the present variation switch button 86A does not remain pressed for a long period of time. This ensures that whenever switch button 86A pressed is relieved of external force pressing the button the exact button is released. Thus switch 86 can have an extended longevity.

11. Seventh Variation

The present variation provides a microwave oven with cam 85 of the sixth variation replaced by a cam 850. Cam 850 does not have such a protrusion as cam 85 of the sixth variation, although it has a reflector 851. Furthermore in a vicinity of a circumference of cam 850 is provided an optical sensor 87.

Optical sensor 87 includes a light directing element and a light receiving element. The light directing element radiates light, as indicated by an arrow H1, successively at predetermined temporal intervals. Cam 850 rotates in a direction G2. When the light receiving elements detects light indicated by an arrow H2, there is detected that rotating cam 850 has a position allowing reflector 851 to reflect light H1.

12. Eighth Variation

The fifth to seventh variations have described mechanisms provided to detect an angle of rotative antenna 20 and subantenna 21 or 22 as they rotate. In the present variation these mechanisms are used to control an angle of rotating rotative antenna 20 and subantenna 21 or 22 that is formed when they stop. Note that these antennas' stop position is controlled to heat a food in heating chamber 10 in a pattern suitable for the arrangement of the food. A pattern used to heat a food in heating chamber 10 will now be described.

Figure 36:
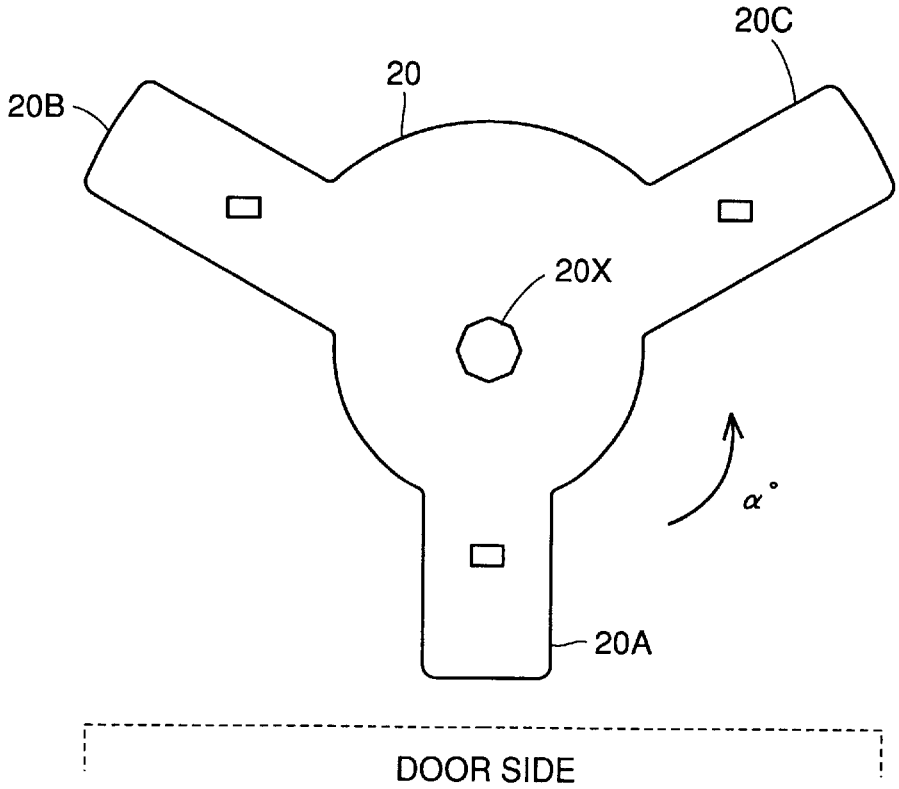
FIG. 36 is a plan view of a typical rotative antenna.

As shown in FIG. 36, for the sake of convenience, rotative antenna 20 with portion 20A facing door 3 has a state of 0° and with hole 20X serving as its center rotative antenna 20 rotates by $\alpha°$ in the direction indicated by the arrow in the figure (counterclockwise in FIG. 36) and then stops. In FIG. 36, the letters "door side" opposite to rotative antenna 20 with a broken line therebetween indicates a positional relationship of door 3 relative to rotative antenna 20.

Figure 37:
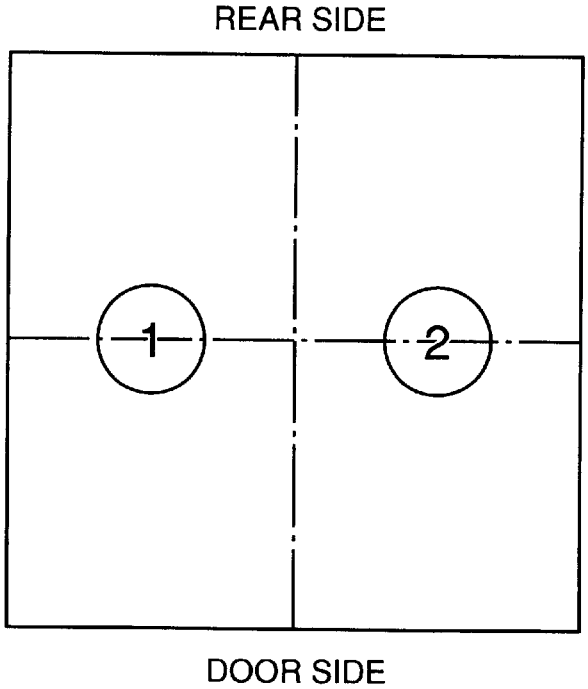
FIG. 37 schematically shows a bottom of a heating chamber.

As shown in FIG. 37, heating chamber 10 has a bottom side divided into areas ① and ② for the sake of convenience. Areas ① and ② are located on the left and right sides, respectively, of heating chamber 10, as seen from the front side, i.e., the door 3 side. Table 3 shows temperature elevation of a food placed in each of areas ① and ② and heated by magnetron 12 for a period of time with rotative antenna 20 stopped at predetermined angles of 0°, 90°, 180° and 270° or continuing to rotate.

TABLE 3

| Rotation Angle α° | Temperature Elevation of Load ① (° C.) | Temperature Elevation of Load ② (° C.) |
|---|---|---|
| Continuous Rotation | 18.6 | 19.3 |
| 0° | 20.4 | 19.1 |
| 90° | 16.8 | 22.3 |
| 180° | 17.5 | 18.9 |
| 270° | 21.8 | 17.5 |

With reference to Table 3, if the foods are heated with rotative antenna 21 rotating, the foods placed in areas ① and ② have a difference in temperature elevation of less than 1° C. That is, it can be said that the areas experience substantially uniform temperature elevation. In contrast, if the foods are heated with rotative antenna 20 stopped, areas ① and ② can have a difference in temperature elevation.

More specifically, if the foods are heated with rotative antenna 20 stopped to position portion 20A on the right side as seen at door 3, i.e., rotated and stopped at 90°, the food in area 2, on the right side as seen at door 3, is heated more than 5° C. higher than that in area ①, on the left side as seen at door 3.

Furthermore, if the foods are heated with portion 20A positioned on the left side as seen at door, i.e., rotated and stopped at 270°, the food in area ①, on the left side as seen at door, is heated more than 4° C. higher than that in area ②, on the right side as seen at door 3.

In contrast, if portion 20A is positioned in heating chamber 10 on the front side or the rear side, i.e., at 0° or 180°, the foods in areas ① and ② do not have a significant difference in temperature elevation.

Thus, rotative antenna 10 having different stop positions results in heating chamber 10 internally having different portions intensively heated. Furthermore in the microwave oven of the present variation when a heating operation starts infrared sensor 7 is used to detect the pattern of the arrangement of a food placed in heating chamber 10. More specifically, a decision is made on in which one of the FIG. 37 areas ① and ② a food exists, or if heating chamber 10 is divided into more areas a decision is made on which one of the areas a food exists. To do so, an area increased in temperature after a heating operation is started is determined as an area having the food arranged thereon.

Then the microwave oven refers to the food's arrangement pattern to select a heating pattern intensively heating the area having the food arranged thereon (that intensively heating area ① or ② on Table 3). At an angle corresponding to the selected heating pattern rotative antenna 20 (or 21, 22) is stopped to heat the food. The Table 3 contents is stored for example in control circuit 30.

Note that heating chamber 10 can be divided into further more areas and food temperature elevations in such areas for different angles of rotation α° can be stored as a Table 3. Thus Table 3 can contain further more heating patterns to provide a heat-cooking operation to better correspond to a food's actual arrangement pattern in heating chamber 10.

Thus, a food's arrangement pattern in heating chamber 10 can be considered to stop the rotative antenna at a position to more efficiently heat the food.

13. Ninth Variation

Figure 38:
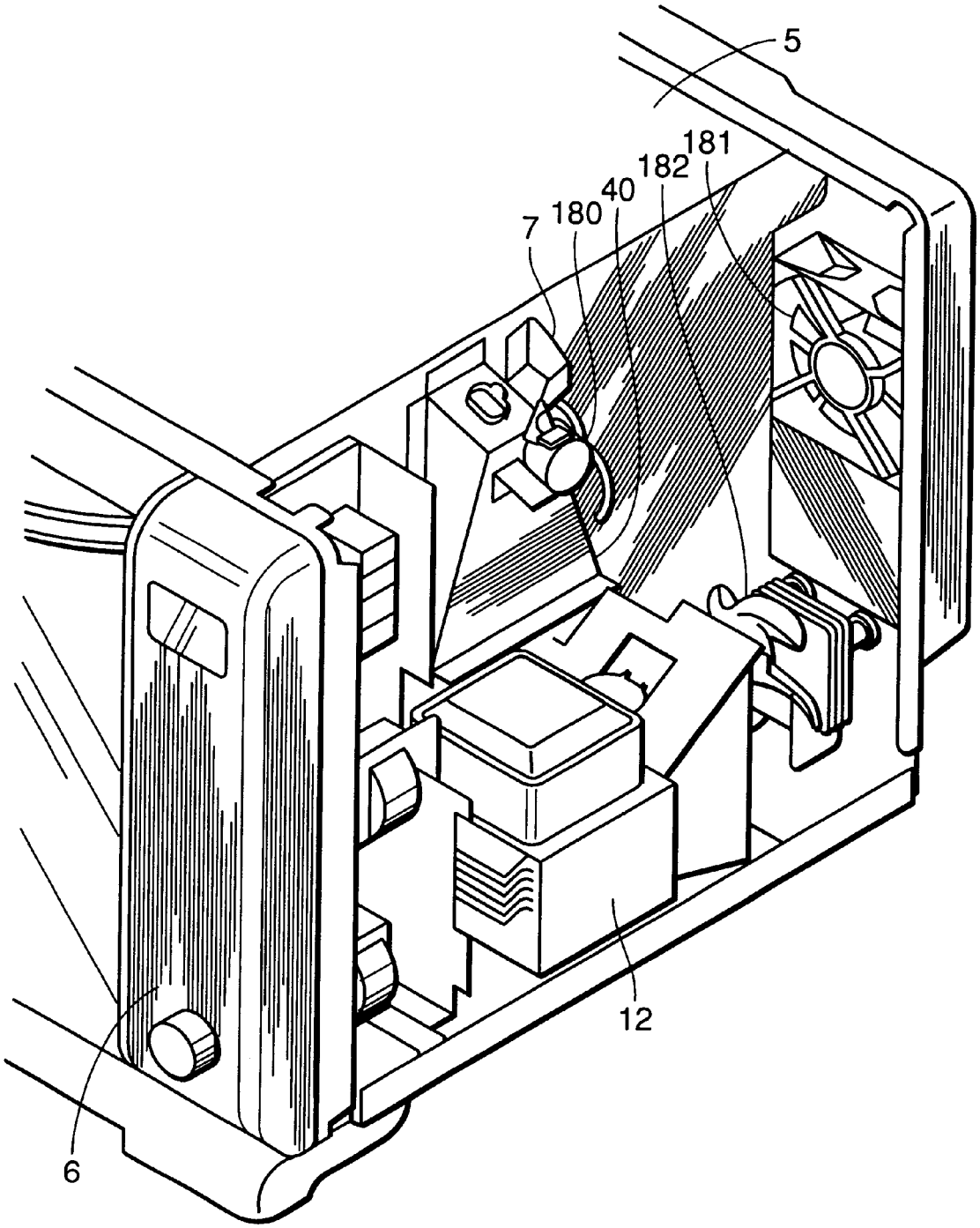
FIG. 38 is a partial, perspective, right-side view of a microwave oven of a ninth variation of the present invention; with the exterior removed therefrom.
Figure 39:
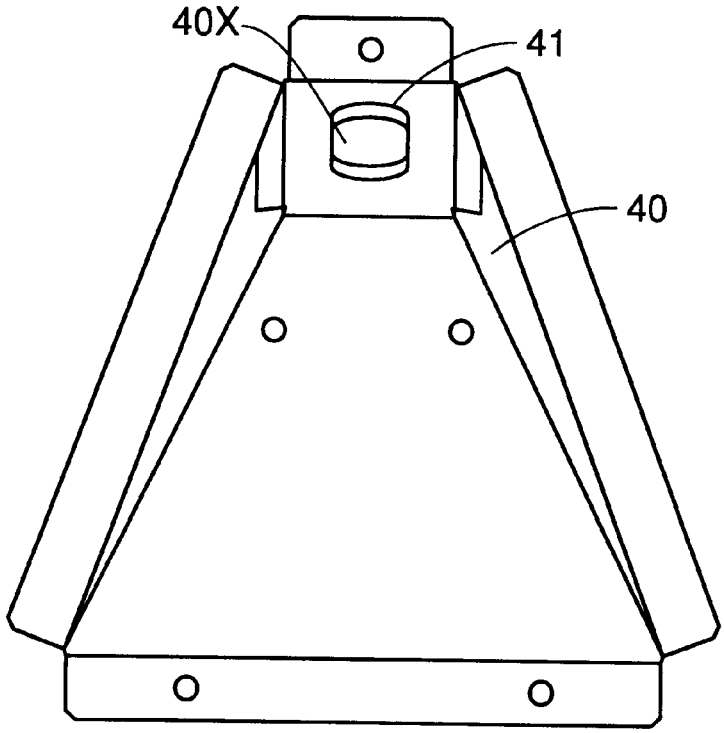
FIG. 39 is a right side view of the FIG. 38 detection path member.
Figure 40:
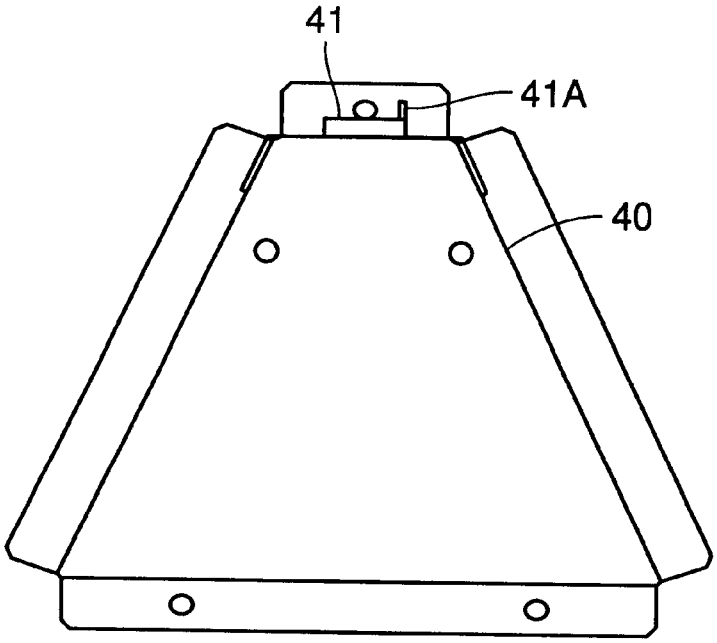
FIG. 40 is a bottom side view of the FIG. 38 detection path member.
Figure 41:
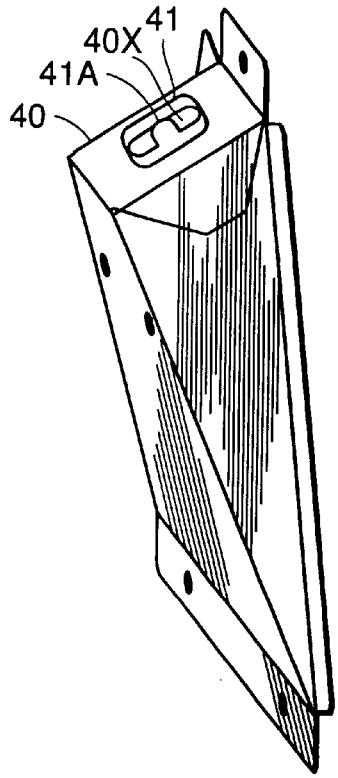
FIG. 41 is a perspective, right-side view of the FIG. 38 detection path member, as seen from behind.

FIG. 38 shows a variation of microwave oven 1, corresponding to FIG. 3.

In the present variation the microwave oven has a detection path member 40 having an upper portion with infrared sensor 7 attached thereto. Furthermore, detection path member 70 has a right portion with a motor 180 attached thereto to move a field of view of infrared sensor 7.

Detection path member 40 has a top end provided with a hole 40X surrounded by a cylinder 41 provided by barring a top end of detection path member 40 in the form of a sheer cylinder on the top end surface of detection path member 40.

With reference to FIGS. 39–42, cylinder 41 is formed to be partially increased in height to have a protrusion 41A. In other words, cylinder 41, with only protrusion 41A increased in height, can readily be formed, barred.

Figure 42:
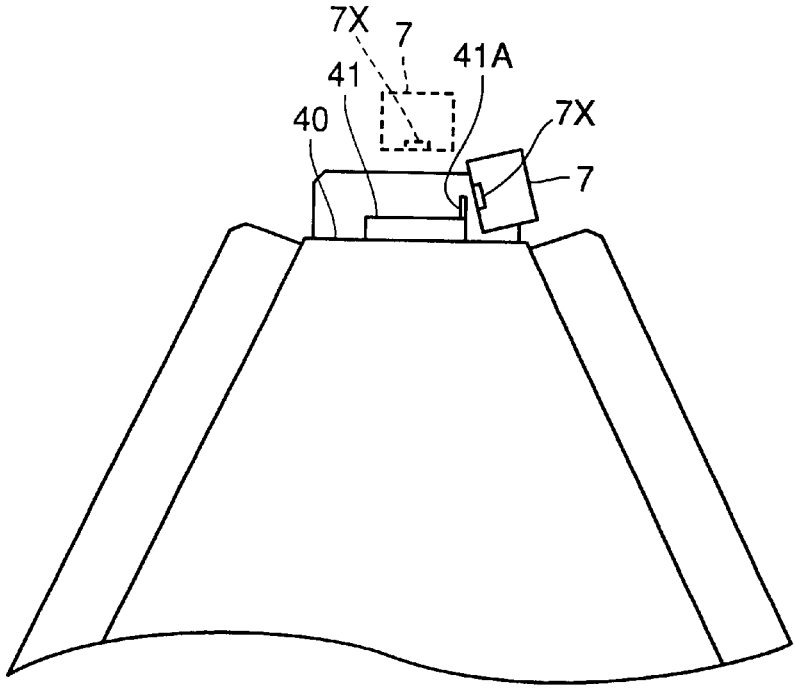
FIG. 42 illustrates a positional relationship between the FIG. 38 detection path member and an infrared sensor.

As shown in FIG. 42, infrared sensor 7 takes infrared radiation in through a detection hole 7X to detect an amount of infrared radiation. In the present variation, as shown in FIG. 42, when infrared sensor 7 is operated to detect an amount of infrared radiation in heating chamber 10 it has a position for example as indicated by the broken line and when it is not operated to detect infrared radiation it has a position allowing detection hole 7X facing protrusion 41A, as indicated by a solid line in FIG. 42. The position of infrared sensor 7 when it is not operated for detection, as shown in FIG. 42, corresponds to the position of infrared sensor 7 as shown in FIG. 38. More specifically, protrusion 41A of cylinder 41 is located windward of any other portions of cylinder 41 as fans 181, 182 operates. As such, infrared sensor 7, detecting through hole 41X an amount of infrared evaluation in heating chamber 10, is moved windward of hole 40X when it is not operated for detection. Note that infrared sensor 7 and its field of view is moved by sensor motor 7Z (see FIG. 9B).

Thus, infrared sensor 7 when it is not operated for detection can have a detection component free of contaminants attributed for example to food juice scattering in heating chamber 10.

Note that in the present variation when infrared sensor 7 is operated for detection or when the sensor in operation for detection is shifted to stop its operation for detection the sensor moves back and forth relative to heating chamber 10. More specifically, it moves in direction Y in FIGS. 14 and 15. More specifically, the present variation corresponds to a microwave oven including infrared sensor 7 having the field of view 70A moving back and forth relative to heating chamber 10, as has been described with reference to FIGS. 14 and 15. It should be noted, however, that in the present variation infrared sensor 7 is only required to have a position windward of hole 40X when it is not operated for detection, and it is not limited to an application with infrared sensor 7 moving back and forth relative to heating chamber 10.

Furthermore, cylinder 41 can be provided with protrusion 41A simply by barring a top end of detection path member 40 to increase cylinder 41 in height only partially, rather than entirely, to ensure a shelter for infrared sensor 7 when it is not operated for detection, and also to readily form cylinder 41. Furthermore, the shelter can be positioned not so far from the position of infrared sensor 7 when it is operated for detection.

Furthermore in the present variation fans 181, 182 are attached to cool magnetron 12 and other components. Infrared sensor 7 when it is not operate for detection is positioned windward of cylinder 41 as fans 181, 182 operate. This ensures that infrared sensor 7 can have its detection component free of food juice scattering in heat chamber 10.

In the present variation infrared sensor 7 has a field of view moving in a manner, as will now be described with reference to FIGS. 43–46. In the present variation infrared sensor 7 is attached external to heating chamber 10 on an upper right side surface.

Figure 43:
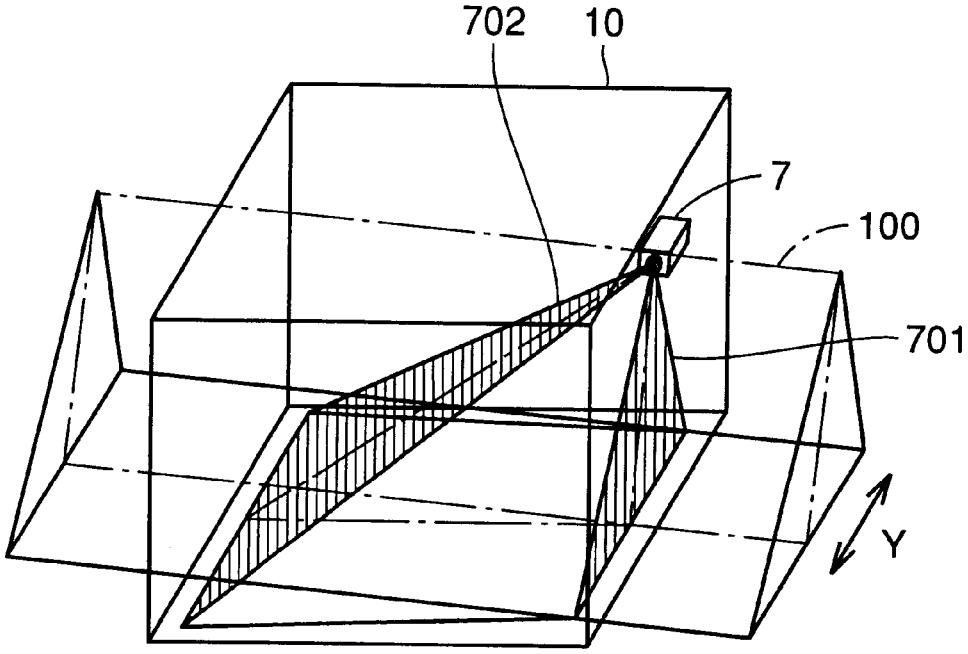
FIG. 43 schematically shows a field of view of an infrared sensor provided in a heating chamber of the ninth variation of the present invention.

In the present variation infrared sensor 7 can have a field of view movable back and forth relative to heating chamber 10, i.e., (in a direction indicated in FIG. 43 by a two-head arrow Y). In FIG. 43, a collection of the sensor's fields of view that is provided rightmost in heating chamber 10 is shown in the form of a plane, i.e., a field of view 701, and that of the sensor's fields of view which is provided leftmost in heating chamber 10 is shown in the form of a plane, i.e., a field of view 702. In FIG. 43, a prism 100 is drawn to assist in describing a manner in which the field of view of infrared sensor 7 moves.

Figure 44:
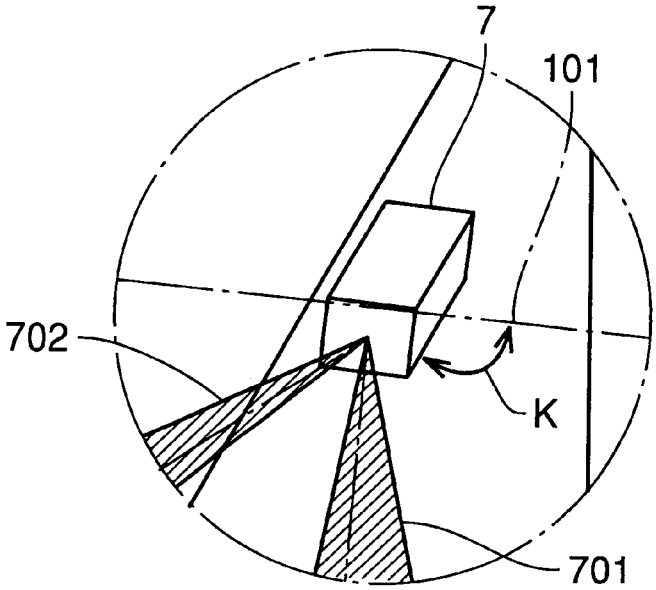
FIG. 44 is an enlarged view in a vicinity of the FIG. 43 infrared sensor.

The field of view 701 corresponds to a rightmost plane in heating chamber 10 in an area coverable by the field of view of infrared sensor 7. As shown in FIG. 44, infrared sensor 7 can pivot in a direction indicated by a two-head arrow K around an axis corresponding to a line located at a topmost portion of prism 100 (a line 101 in FIG. 44) to move its field of view back and forth relative to heating chamber 10. In FIG. 43, the field of view 701 is a plane parallel to a side plane of the prism. In other words, the field of view 701 is perpendicular to line 101. This can minimize an area in heating chamber 10 on a side provided with infrared sensor 7 (the right side in FIG. 43) that is located on the front and rear sides and hence otherwise uncoverable by the sensor's field of view.

If infrared sensor 7 is attached to heating chamber 7 on a rearside and thus pivots rightward and leftward, infrared sensor 7 preferably pivots around an axis perpendicular to a plane corresponding to a collection of the sensor's fields of view that is provided most rearward.

More specifically, in the present variation if infrared sensor 7 pivots to move its field of view it pivots around an axis perpendicular to a plane within the entire region coverable by the sensor's field of view that is located in heating chamber 10 closest to the side of the heating chamber having the sensor attached thereto, as this can reduce in heating chamber 10 on a side having the sensor attached thereto an area uncoverable by the sensor's field of view. Thus, infrared sensor 7 can have a field of view covering heating chamber 10 over a wider area.

Figure 45:
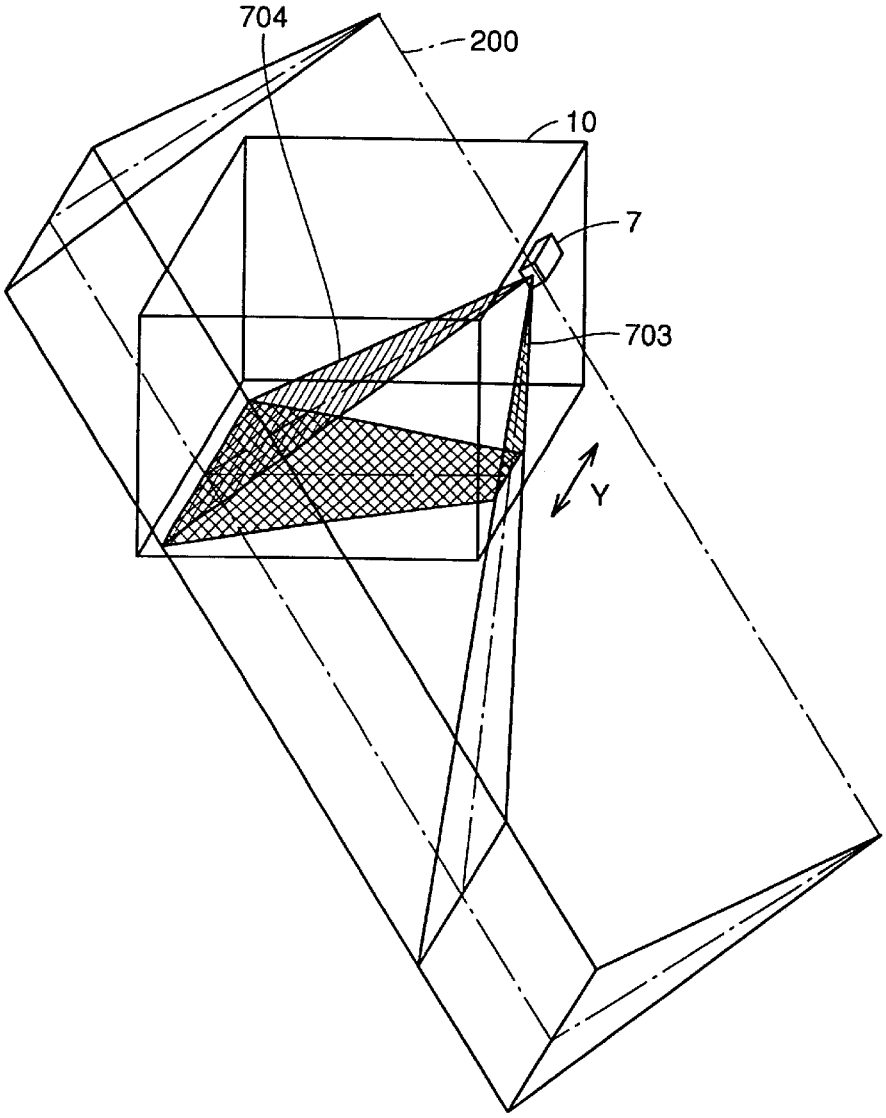
FIG. 45 shows an infrared sensor pivoting as compared in the ninth variation of the present invention.
Figure 46:
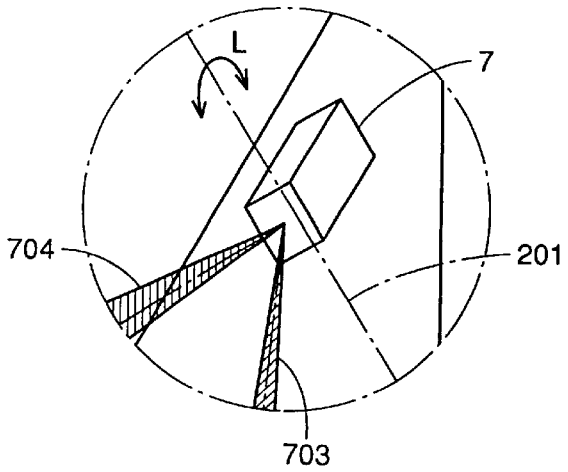
FIG. 46 is an enlarged view in a vicinity of the FIG. 45 infrared sensor.

This effect can be described more specifically with reference to FIGS. 45 and 46. In FIG. 45, a prism 200 is shown to assist in describing how infrared sensor 7 moves.

In the FIGS. 45 and 46 comparison example, infrared sensor 7 has a field of view also moving back and forth (in a direction indicated by a two-head arrow Y) as infrared sensor 7 pivots. Of areas coverable by the pivoting sensor's field of view, the rightmost and leftmost planes are shown as fields of view 703 and 704, respectively.

In this comparative example, infrared sensor 7 pivots around an axis corresponding to a rightmost line of prism 200 (a line 201 shown in FIG. 46). More specifically, as can be understood from FIG. 46, in this comparative example the field of view 703 and line 201 form an acute angle. As such, the field of view 703 and heating chamber 10 form a line shorter in dimension than the depth of heating chamber 10 at that portion. More specifically, when FIG. 43 is compared with FIG. 45, infrared sensor 7 can have a field of view covering in a much larger corner area closer to a side of heating chamber 10 having infrared sensor 7 attached thereto (i.e., the right side of the heating chamber 10) in FIG. 43 than in FIG. 45.

It can thus be said that if infrared sensor pivots to move its field of view the sensor preferably pivots around an axis perpendicular to a plane within the entire region coverable by the sensor's field of view that is located in heating chamber 10 closest to a side of the heating chamber having the sensor attached thereto.

14. Tenth Variation

Figure 47:
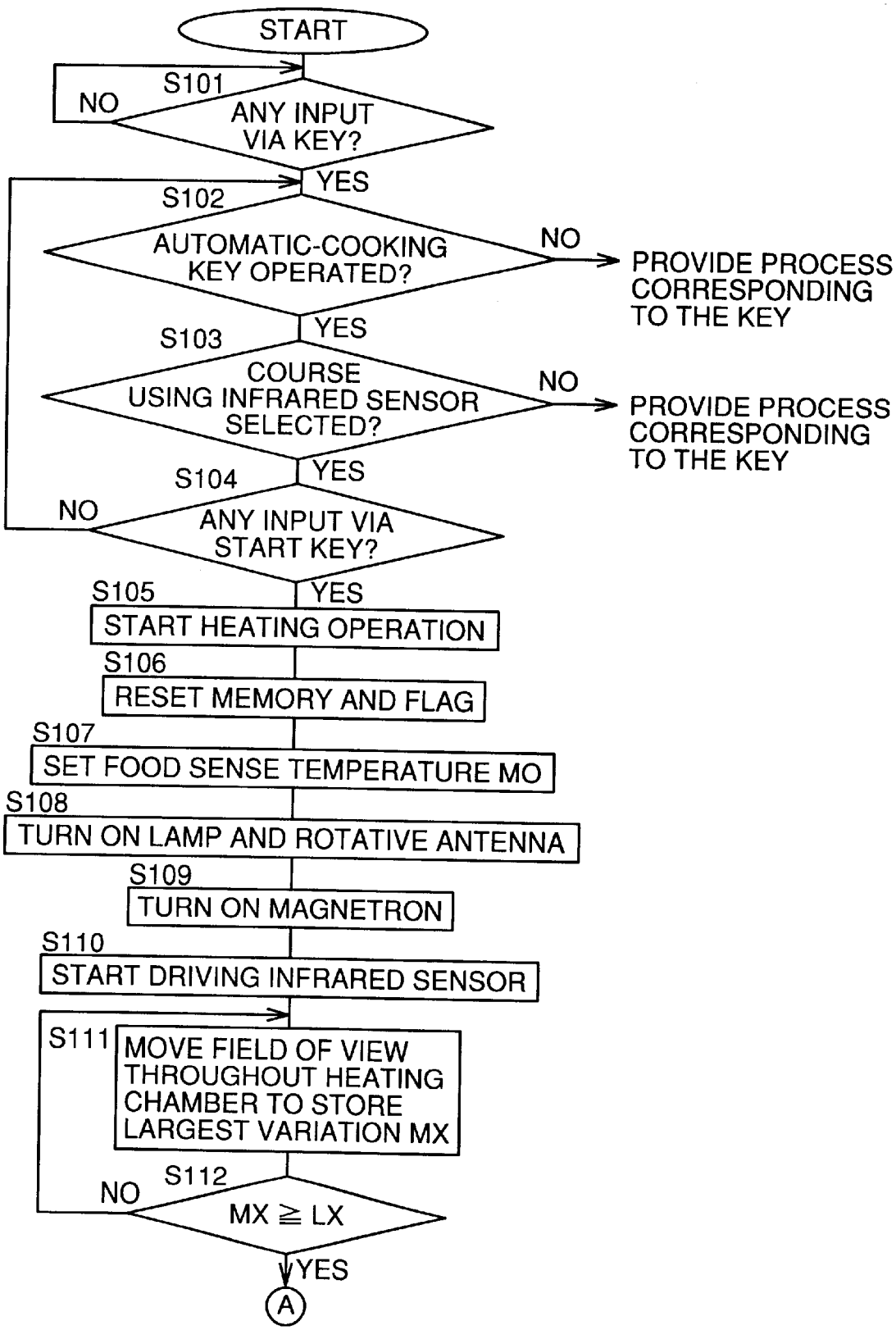
FIG. 47 is a flow chart representing a controlling manner of a microwave oven in a tenth variation of the present invention.
Figure 48:
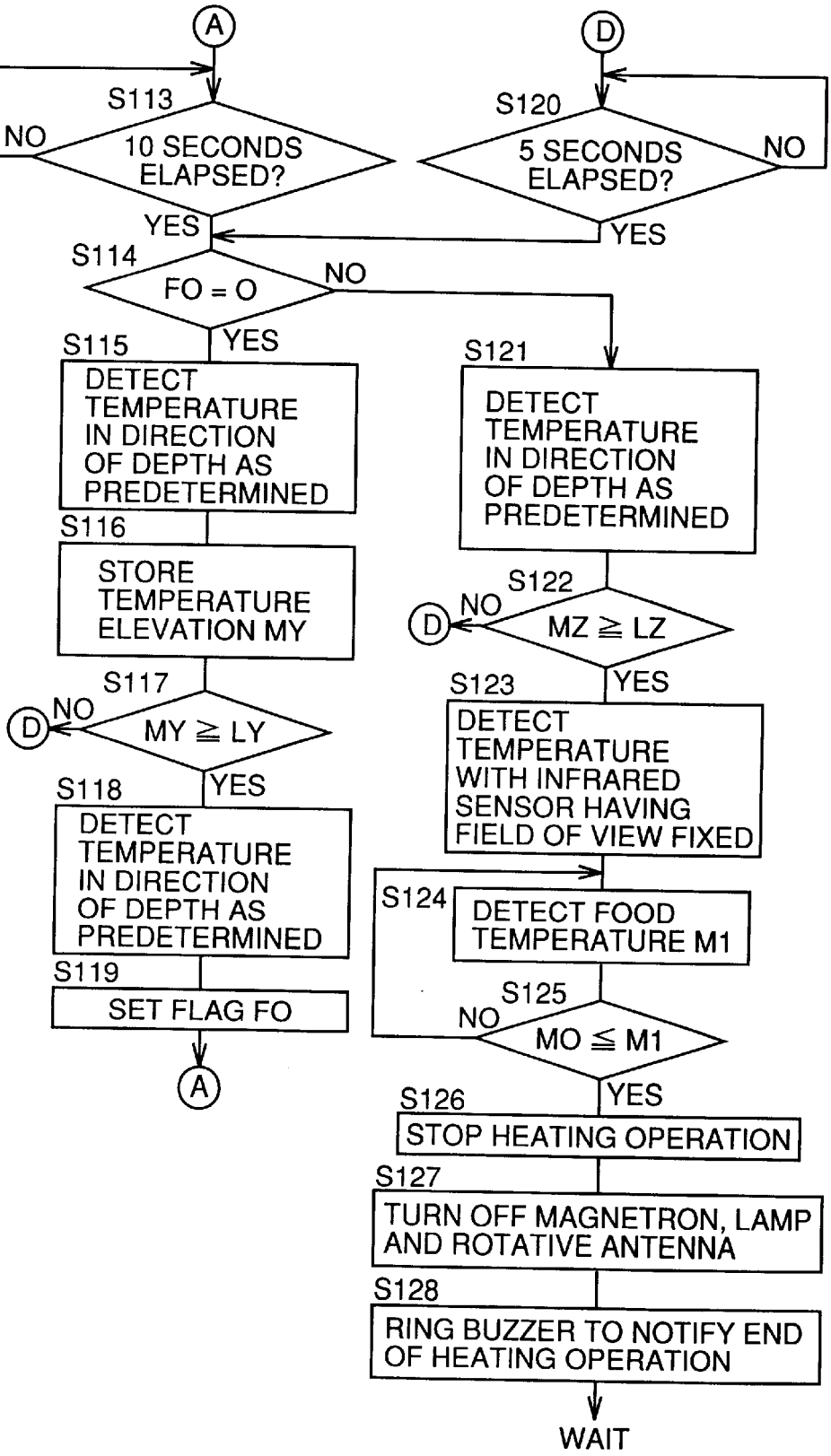
FIG. 48 is a flow chart representing a controlling manner of a microwave oven in the tenth variation of the present invention.

Reference will now be made to FIGS. 47 and 48 and 10 to describe a tenth variation of the present embodiment. The present variation mainly describes that in the microwave oven during a heat-cooking process infrared sensor 7 is employed to detect the temperature of a food in heating chamber 10 to automatically determine a timing at which the heating operation is terminated, as controlled in a manner as described hereinafter.

In the present variation, sensor motor 7Z (shown in FIG. 9B) can move the sensor 7 field of view in the direction of the width of heating chamber 10 (direction X in FIG. 10) and the direction of the depth of heating chamber 10 (direction Y in FIG. 10).

Initially at S101 the control determines whether the microwave oven has received an input via a key. If so then the control goes to S102.

Then at S102 the control determines whether at S101 the microwave oven has received the input via a key instructing the microwave oven to provide a cooking and automatically detecting the end of the cooking (an automatic-cooking key). If so then the control goes to S103 and if not then the control provides a process corresponding to the key of interest.

At S103 the control determines whether the automatic-cooking key detected at S102 selects a course using infrared sensor 7 to detect the temperature of a food in heating chamber 10. If so then the control goes to S104 and if not then the control provides a process corresponding to the course of interest.

At S104 the control determines whether a key starting a heat-cooking operation (a start key) has been operated. If so then the control goes to S105.

At S105 the control starts magnetron 12 to provide a heating operation and then goes to S106.

At S106 the control resets contents recorded in memory about automatic-cooking and a flag and then goes to S107.

At S107 the control sets a food sense temperature M0 and then goes to S108. Food sense temperature M0 is a target temperature for a heating operation. More specifically, when infrared sensor 7 senses the temperature the control terminates the current heating operation.

At S108 the control turns on a lamp illuminating heating chamber 10 and starts rotation of rotative antenna 15 and then goes to S109.

At S109 the control starts magnetron 12 and then goes to S110.

A S110 the control controls infrared sensor 7 to start temperature detection and then goes to S111.

At S111 the control controls infrared sensor 7 to move its field of view in heating chamber 10 back and forth to scan more than one location to detect a highest temperature and then goes to S112. The S111 step will now be described more specifically with reference to FIG. 10.

In the present variation infrared sensor 7 has a field of view moving in heating chamber 10 back and forth relative thereto (or in direction Y in FIG. 10) and rightward and leftward (or in direction X in FIG. 10). At S111 if a field of view is represented in an X-Y coordinate system as p(X, Y), the field of view moves in a line with X=1 and Y varying from N to 1, then in a line with X=M1 and Y varying from 1 to N, and then in a line with X=M2 and Y varying from N to 1, wherein 1<M1<M2<M, i.e., it moves in the direction of the depth from a front side to a rear side, to a right side, from a rear side to a front side, further to a left side, from a front side to a rear side and the like to move throughout heating chamber 10. While the field of view moves throughout heating chamber 10, infrared sensor 7 senses temperature. A largest variation in temperature detected in heating chamber 10 in the direction of the depth thereof, is stored in memory. Temperature is detected in heating chamber 10 along a plurality of lines extending in direction Y and for each line there is calculated a difference between the largest and smallest value in temperature. The largest value of such differences correspond to the largest variation in temperature in the direction of the depth of the chamber.

At S112 the control determines whether the largest variation MX stored at S111 is at least a predetermined temperature LX. If so then the control goes to S113 and if not then the control returns to S111 and again extracts largest variation MX.

At S113 the control determines whether ten seconds have elapsed since the latest temperature detection provided by infrared sensor 7 and if so then the control goes to S114.

At S114 the control determines whether a flag F0 is reset. If so then the control goes to S115 and if it is set then the control goes to S121.

At S115 the control moves the field of view of infrared sensor 7 in a line having the direction of the depth having detected MX subjected to the latest S112 decision and the control circuit again controls infrared sensor 7 to sense temperature and then goes to S116. Note that at S115 infrared sensor 7 has its field of view moving at a rate lower than at S111. More specifically, the rate at which the field of view moves at S115 can be one fourth that at which the field of view moves at S111. More specifically in the present variation infrared sensor 7 has its field of view moving throughout heating chamber 10 at a relatively high speed to locate a food (S111–S112) and once it generally determines a line on which the food exists it detects the temperature of the food precisely (S115). Then temperature detection is provided on the line of interest to locate the food on the line of interest (S116 to S119).

At S116 the control stores in memory a temperature elevation MY subjected to the S115 temperature detection on a line at a point having attained a highest temperature value and then goes to S117.

At S117 the control determines whether MY stored at S116 is equal to or exceeds a predetermined temperature LY. If so then the control goes to S118 and, having made a decision that a food exists at a location subjected to the latest S116 MY detection, detects temperature with infrared sensor 7 having its field of view move in the direction of the depth including the location of interest and then goes to S119. The rate at which the field of view moves at S118 is equal to that at which the field of view moves at S115.

At S119 the control sets flag F0 and returns to S113. Subsequently if flag F0 remains set then the control goes to S121.

At S121 the control controls infrared sensor 7 to move the field of view in a line in the direction of the depth, as predetermined, subjected to the S118 temperature detection, to detect temperature, and the control stores a variation MZ in temperature at a location on the line of interest having a highest temperature value detected and then goes to S122. Note that the rate at which the field of view moves at S121 is equal to that at which the field of view moves at S115.

At S122 the control determines whether MZ stored at S121 is equal to or exceeds a predetermined temperature LZ. If so then the control goes to S123 and if not then the control goes to S120.

At S120 the control determines whether five seconds have elapsed since the immediate previous temperature detection performed with a field of view moving in a line and if so then the control goes to S114.

In contrast at S123 the control controls infrared sensor 7 to have a field of view fixed at a location having MZ stored at S121 and continue to detect temperature and then the control goes to S124.

At S124 in the field of view a food temperature M1 is detected and then the control goes to S125.

At S125 the control determines whether temperature M1 detected at the immediately previously executed S125 has attained M0 set at S127. If not then the control goes back to S124 and if so then the control moves to S126.

At S126 the control provides a setting to terminate a heating operation and then goes to S127. At S127 the control stops the heating operation provided by magnetron 12, turns off the lamp illuminating heating chamber 10 and stops the rotation of rotative antenna 15 and the control then goes to S128. At S128 the control controls a buzzer or the like to notify the user that the current heating operation ends. Then the microwave oven is placed in a waiting state.

15. Eleventh Variation

Figure 49:
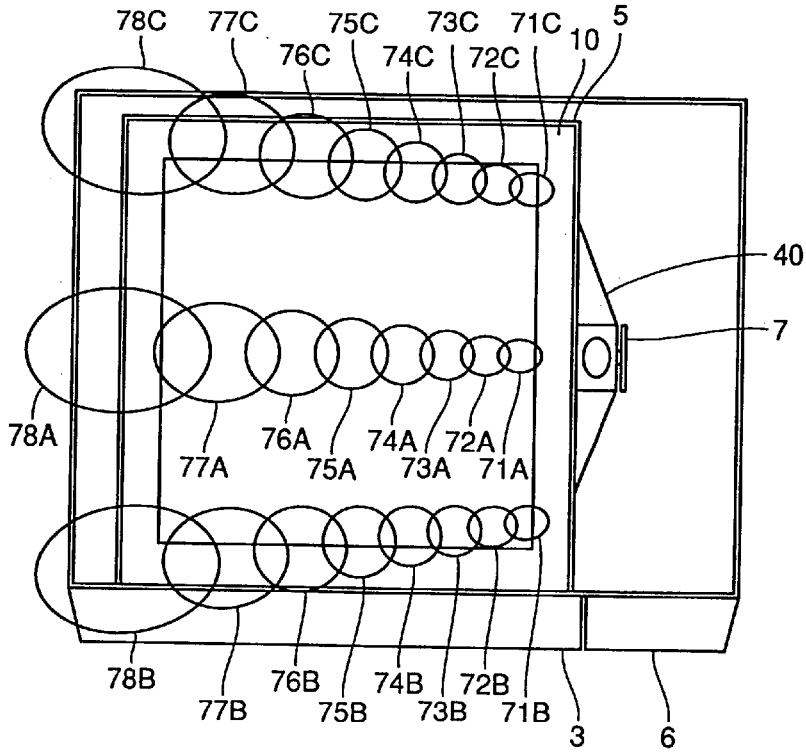
FIG. 49 is a view for illustrating how a field of view moves in the microwave oven of an eleventh variation of the present invention.

With reference to FIG. 49, infrared sensor 7 includes eight infrared detection elements. At a time point these eight infrared detection elements have their respective fields of view 71A–78A projected on a bottom plane of heating chamber 10. Since the fields of view 71A–78A together cover substantially the entire area of heating chamber 10 widthwise, heating chamber 10 has any area thereof widthwise covered by the field of view of an infrared detection element.

In the present variation, infrared sensor 7 is driven by sensor motor 7Z (see FIG. 9B) to pivot in a predetermined manner to move the fields of view 71A–78A back and forth relative to heating chamber 10 to provide fields of view 71B–78B and 71C–78C, respectively. Thus, heating chamber 10 has any area thereof covered by the field of view of an infrared detection element.

Furthermore in the present variation each infrared detection element moves keeping a fixed distance as measured from the bottom plane of heating chamber 10 covered by the field of view of the infrared detection element. Thus in heating chamber 10 on the bottom plane an infrared detection element has a field of view covering a uniform area. More specifically, in heating chamber 10 on the bottom plane the fields of view 71A–71C each cover an area of the same size and so do the fields of view 72A–72C and 78A–78C. Since each field of view thus moves, each infrared detection element can have a field of view covering a constant area of heating chamber 10. Thus in the present variation each infrared detection element can detect temperature with constant precision, since the amount of infrared radiation that the infrared detection element can detect depends on the size of the area covered by the field of view of the infrared detection element.

16. Twelfth Variation

Figure 50:
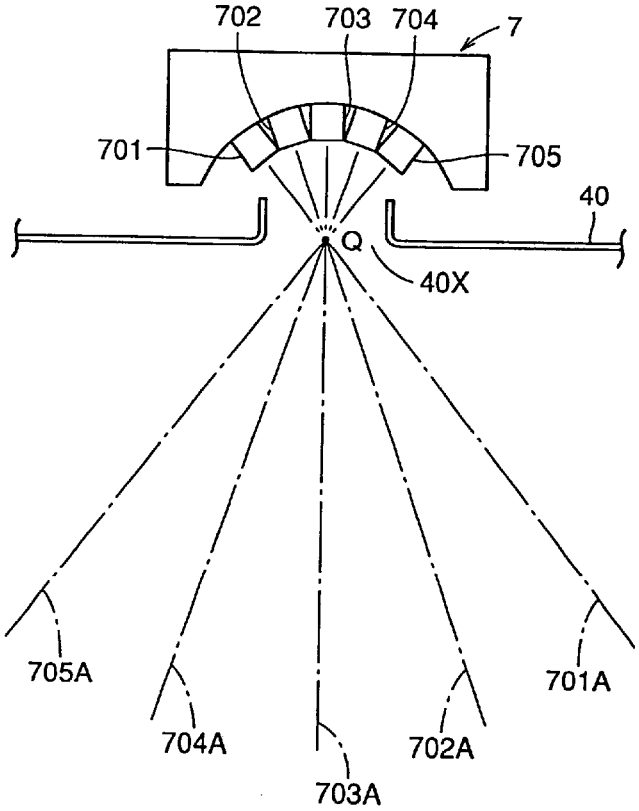
FIG. 50 is an enlarged view in a vicinity of an infrared sensor of a microwave oven of a twelfth variation of the present invention.
Figure 51:
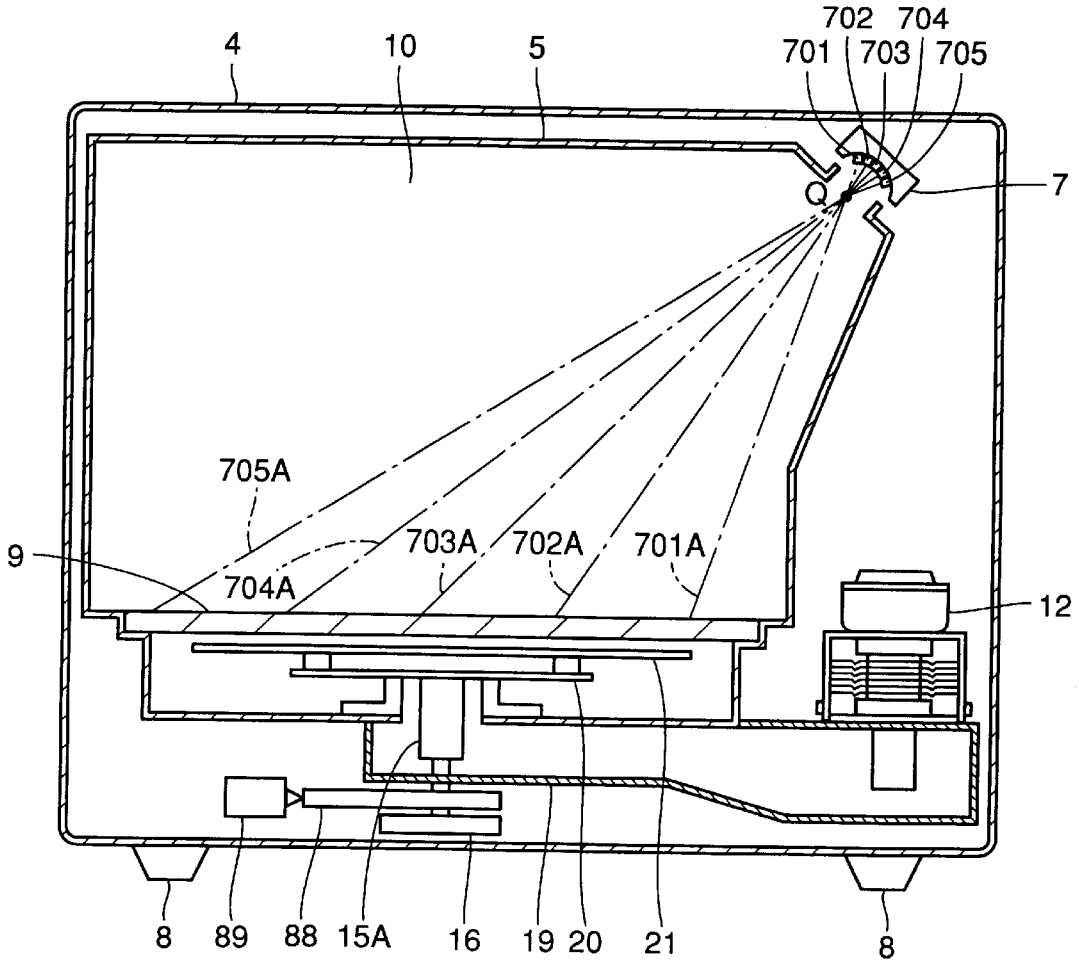
FIG. 51 is a vertical cross section of the microwave oven of the twelfth variation of the present invention.

With reference to FIGS. 50 and 51, infrared sensor 7 includes five infrared detection elements 701–705. Also drawn in FIGS. 50 and 51 are centerlines 701A–705A each representing the center of the field of view of a respective one of infrared detection elements 701–705.

In the present variation infrared detection elements 701–705 have their respective fields of view passing through hole 40X provided in detection path member 40 and thus reaching heating chamber 10. Infrared detection elements 701–705 are arranged to allow their respective fields of view to have their respective centerlines 701A–705A traversing each other in hole 40X at a point Q. As such, hole 40X can be minimized in diameter.

Hole 40X reduced in diameter can further prevent food juice and the like scattering in heating chamber 10 from reaching infrared detection elements 701–705.

Figure 52:
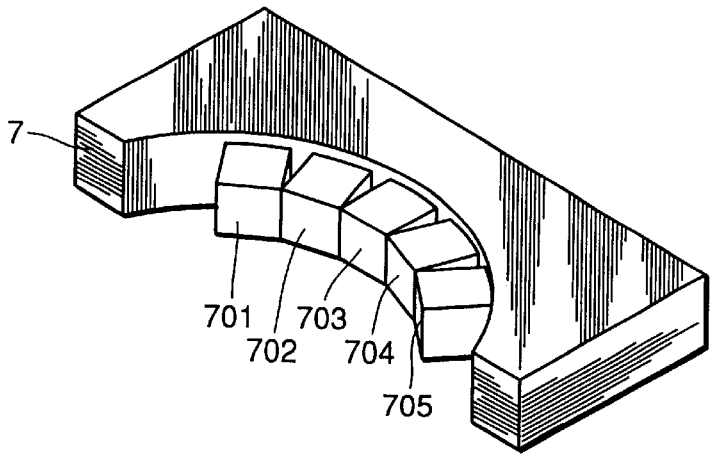
FIG. 52 shows an exemplary, specific configuration of an infrared sensor of the microwave oven of the twelfth variation of the present invention.
Figure 53:
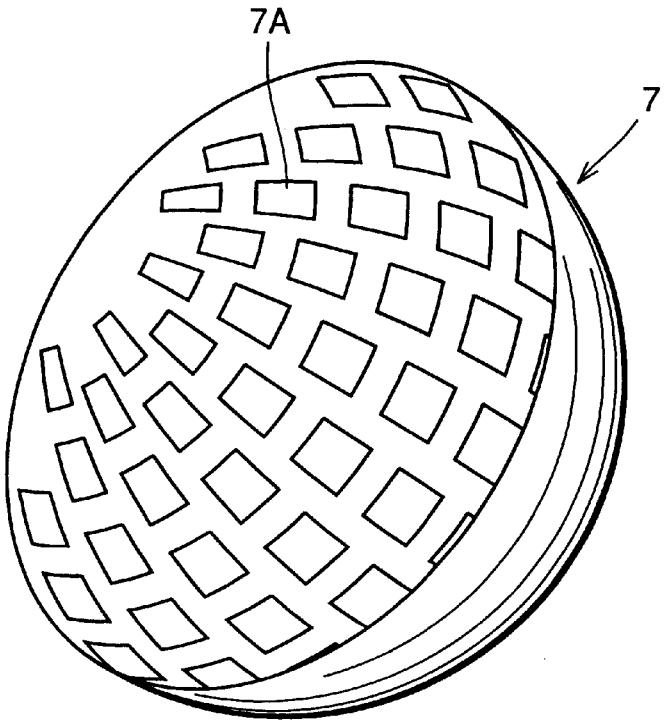
FIG. 53 shows another exemplary, specific configuration of the infrared sensor of the microwave oven of the twelfth variation of the present invention.

Note that in the present variation infrared sensor 7 may have infrared detection elements 701–705 arranged in a line, as shown in FIG. 52, or it may have a plurality of infrared detection elements 7A on an internal wall surface of a sphere two-dimensionally, as shown in FIG. 53. Note that in both FIGS. 52 and 53, the plurality of infrared detection elements 7A and 701–705 have their respective fields of view having their respective centers traversing each other in hole 40X before extending into heating chamber 10. Furthermore, if the FIG. 53 infrared sensor is used, heating chamber 10 is entirely covered by the fields of view of infrared detection elements 7A at one time such that any area of the chamber is covered by the field of view of an infrared detection element 7A.

17. Thirteenth Variation

Figure 54:
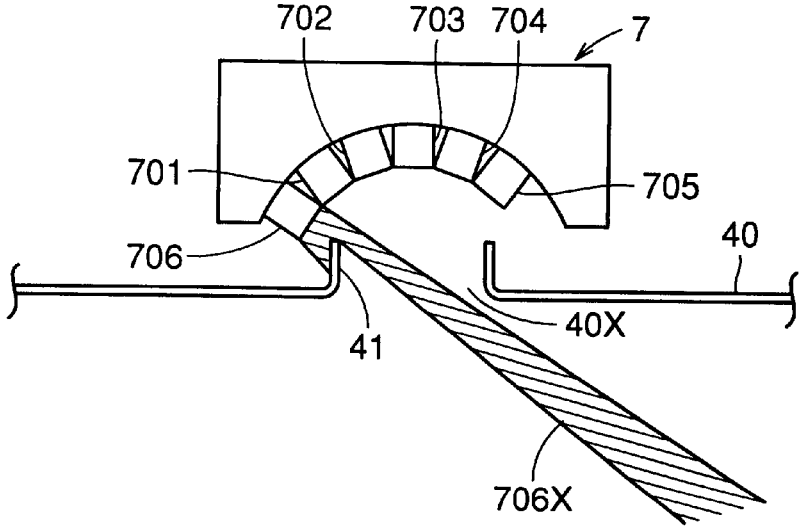
FIG. 54 is an enlarged view in a vicinity of an infrared sensor of a microwave oven of a thirteenth variation of the present invention.

With reference to FIG. 54, in the present variation infrared sensor 7 includes infrared detection elements 701–705 described with reference to FIG. 50 plus an infrared detection element 706. While infrared detection elements 701–705 have their respective fields of view all directed through hole 40X to heating chamber 10, infrared detection element 706 has a field of view half blocked by a detection path member 40 and thus failing to enter heating chamber 10.

In the present variation if in heating chamber 10 infrared detection element 706 has a field if view 706X detecting a food then the control determines that the food's temperature cannot be detected accurately and the control stops the current heating operation, as will now be described more specifically with reference to FIG. 55.

Figure 55:
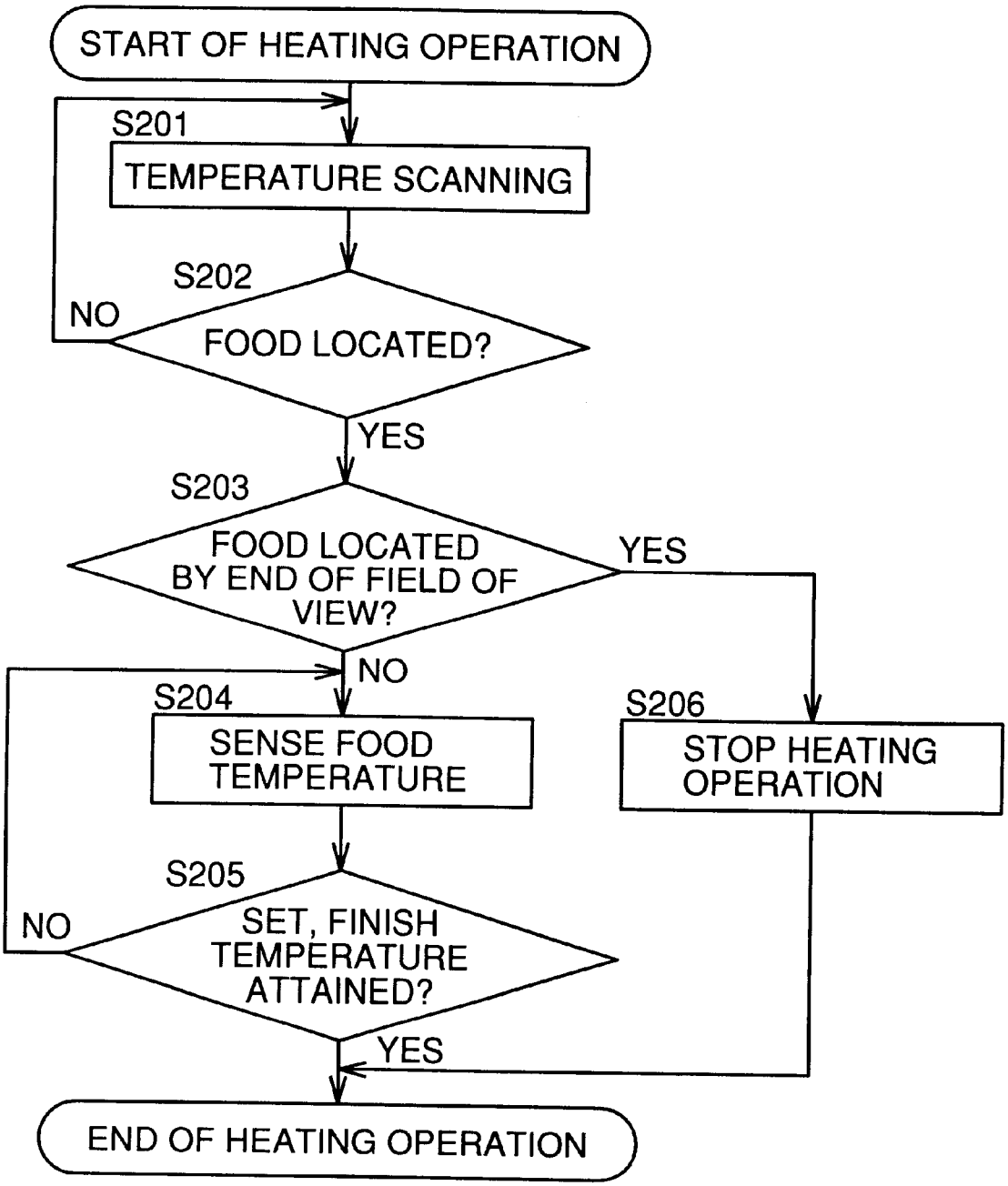
FIG. 55 is a flow chart representing a controlling manner in the microwave oven of the thirteenth variation of the present invention.

With reference to FIG. 55, in the present variation the control initially controls magnetron 12 to start a heating operation and then at S201 drives sensor motor 7Z (see FIG. 9B) to allow any area of heating chamber 10 to be covered by the field of view of an infrared detection element. In other words, the infrared detection elements have their fields of view scanning throughout heating chamber 10 for temperature detection.

Then at S201 the control determines whether a food has been located in heating chamber 10. This decision is made based for example on whether there has been detected an area heated as time elapses. If such an area has been detected the control determines that the area includes the food and the control goes to S203.

Figure 56:
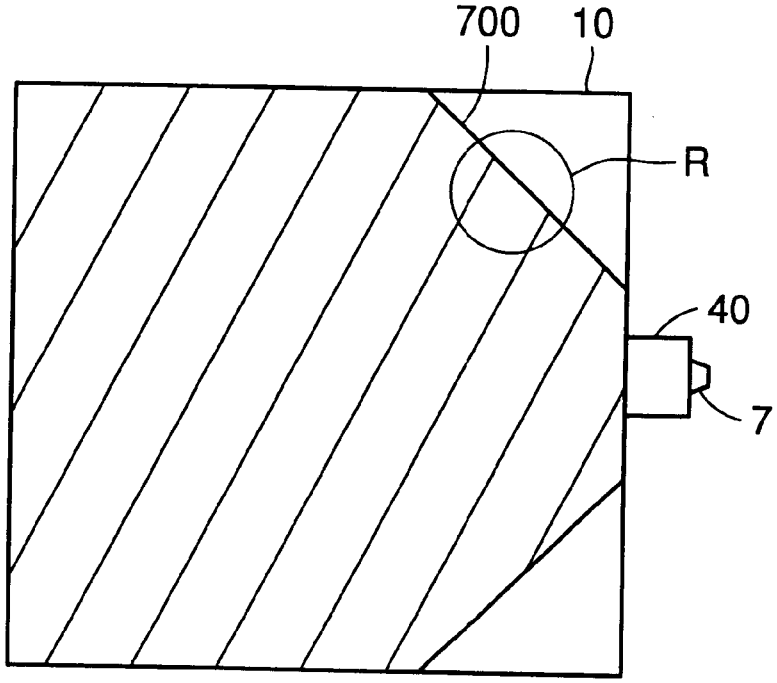
FIG. 56 is a flow chart representing a controlling manner in the microwave oven of the thirteenth variation of the present invention.

At S203 the control determines whether the food is located by an end of the field of view of infrared sensor 7. Herein, the field of view of infrared sensor 7 corresponds to a collection of the fields of view of infrared detection elements 701–706 and the end of the field of view of infrared sensor 7 corresponds to the field of view 706X, the field of view of infrared detection element 706 that is introduced into heating chamber 10. That the field of view 706 covers a food means that the food is only partially covered by the field of view of infrared sensor 7. More specifically, if infrared sensor 7 has a total field of view 700 in heating chamber 10, as shown in FIG. 56, a food R exists in heating chamber 10, only partially covered by the total field of view 700.

Thus infrared sensor 7 (or infrared detection elements 700–706) can hardly sense the temperature of food R accurately. As such, if at S203 the control determines that the food is located by an end of the field of view of infrared sensor 7 then it goes to S206 and at that time point controls magnetron 12 to stop the current heating operation to terminate the current process.

Note that if at S203 the control determines that the food is located by an end of the field of view of infrared sensor 7 then at S204 the control continues to detect the temperature of the food and if the food has attained a set, finish temperature corresponding to a temperature at which a heating operation should be terminated the control (S205) stops the current heating operation and ends the current process.

The techniques disclosed in the embodiments and variations may be used individually or combined together.

Furthermore, as long as they are allowed, the techniques disclosed in the embodiments and variations are applicable to both infrared sensor 7 including a single infrared detection element and that including a plurality of infrared detection elements.

Figure 57:
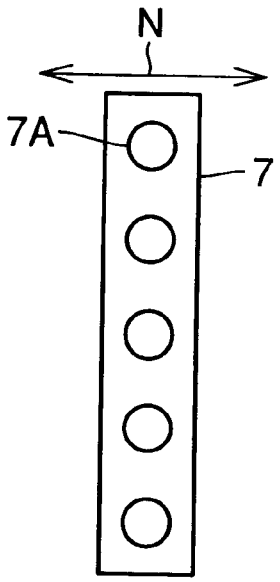
FIG. 57 represents a direction in which moves an infrared sensor recommended in the present invention.
Figure 58:
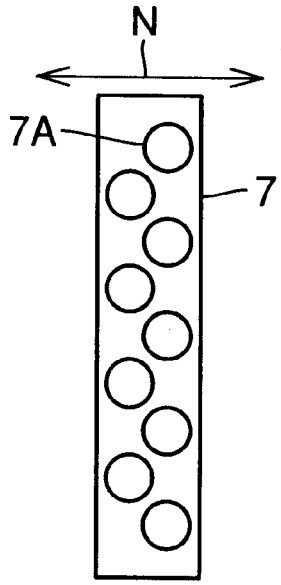
FIG. 58 represents a direction in which moves an infrared sensor recommended in the present invention.
Figure 59:
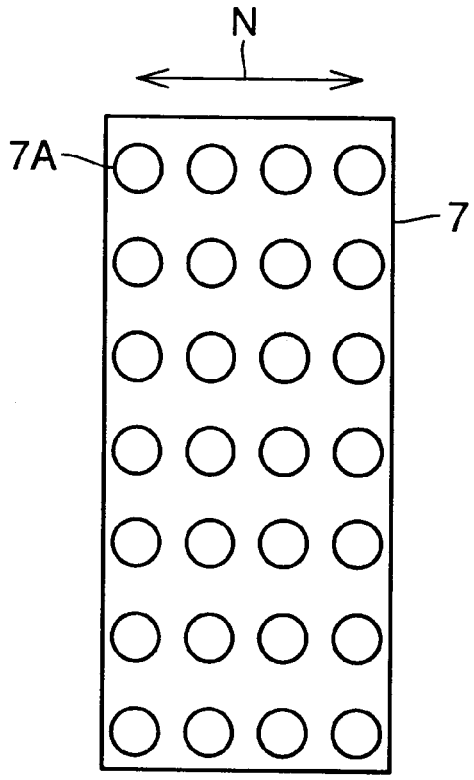
FIG. 59 represents a direction in which moves an infrared sensor recommended in the present invention.

Furthermore, if infrared sensor 7 includes a plurality of infrared detection elements arranged in a rectangle and the exact infrared sensor 7 moves to move the fields of view of the infrared detection elements, infrared sensor 7 should move at least in a direction in which a shorter side of the rectangle extends. For example, if infrared sensor 7 includes infrared detection elements 7A arranged in a line, as shown in FIG. 57, or in multiple lines, as shown in FIGS. 58 and 59, infrared sensor 7 should move in a direction indicated by a two-head arrow N. Moving infrared sensor 7 in direction N can provide a maximal variation of an area further covered by a field of view of infrared detection element 7*a*, relative to the distance in which each infrared sensor 7 moves. In other words, temperature can be detected throughout heating chamber 10 more rapidly.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave oven accommodating an object to be heated, comprising a heating chamber further comprising a bottom surface, for receiving food thereon, and a side wall intersecting said bottom surface, a plurality of infrared detection elements mounted outside said side wall above a point on an intersection of said side wall and said bottom surface, the infrared detection elements comprising respective fields of view in said heating chamber to detect respective amounts of infrared radiation in said fields of view, said plurality of infrared detection elements being arranged to have said fields of view which align substantially in a first direction to cover an elongated area on said bottom surface, said first direction being substantially perpendicular to said side wall, further comprising a drive unit driving said plurality of infrared detection elements to move said elongated area along said bottom surface in a second direction traversing said first direction.

2. The microwave oven of claim 1, wherein said second direction is perpendicular to said first direction, whereby a predetermined rectangle is scanned by said drive unit and said infrared detection elements; and said drive unit drives said plurality of infrared detection elements to move along a shorter side of said predetermined rectangle.

3. A microwave oven according to claim 1, further comprising:

a heating unit provided to heat said object to be heated;

a temperature calculation unit calculating from an output received from each said infrared detection element a temperature of said object to be heated attained in each said field of view; and a control unit referring to said temperature to control said heating unit, wherein said control unit calculates a variation in said temperature introduced within a predetermined temporal period for each said field of view, sets said field of view, sets said variation having a largest value and said variation having a value having at least a predetermined percentage relative to said variation having said largest value as specific variations for said predetermined temporal period, sets as a specific field of view said field of view corresponding to said specific variation for said predetermined temporal period, and refers to said temperature in said specific field of view to control said heating unit.

4. The microwave oven of claim 3, said microwave oven including more than one said infrared detection element arranged in said first direction, further comprising means for controlling said more than one said infrared detection element to detect said temperature while moving said more than one said infrared detection element in said second direction traversing said first direction.

* * * * *

UNITED STATES PATENT AND TRADEMARK OFFICE

CERTIFICATE OF CORRECTION

PATENT NO. : 6,630,655 B2
DATED : October 7, 2003
INVENTOR(S) : Eiji Fukunaga et al.

It is certified that error appears in the above-identified patent and that said Letters Patent is hereby corrected as shown below:

Column 36,
Line 64, change "A microwave oven according to claim 1," into -- The microwave oven of claim 1, --

Column 37,
Lines 9-10, delete "sets said field of view,"

Column 38,
Line 5, state "4." into -- 5. --.
Line 5, change "claim 3," into -- claim 4, --.
Between lines 4 and 5, insert claim 4 as follows:
-- 4. A micro oven according to claim 1, further comprising means for determining in a field of view corresponding to a respective one of a plurality of areas internal to said heating chamber, a temperature of the object to be heated attained in said field of view;

means for calculating for each of said areas a variation in said temperature introduced within a predetermined temporal period; and means for referring only to said temperature in said area corresponding to said variation having a largest value and said temperature in said area corresponding to said variation having a value of at least a predetermined percentage relative to said variation having said largest value, to control a heating operation. --

Signed and Sealed this

Fifth Day of October, 2004

JON W. DUDAS
*Director of the United States Patent and Trademark Office*